US009007351B2

(12) United States Patent
Umezaki

(10) Patent No.: US 9,007,351 B2
(45) Date of Patent: Apr. 14, 2015

(54) DISPLAY DEVICE

(71) Applicant: Semiconductor Energy Laboratory Co., Ltd., Atsugi-shi, Kanagawa-ken (JP)

(72) Inventor: Atsushi Umezaki, Isehara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 14/159,693

(22) Filed: Jan. 21, 2014

(65) Prior Publication Data

US 2014/0132577 A1 May 15, 2014

Related U.S. Application Data

(62) Division of application No. 13/014,026, filed on Jan. 26, 2011, now Pat. No. 8,638,322.

(30) Foreign Application Priority Data

Feb. 5, 2010 (JP) ..... 2010-024872

(51) Int. Cl.
*G09G 3/36* (2006.01)

(52) U.S. Cl.
CPC ..... *G09G 3/3611* (2013.01); *G09G 3/3659* (2013.01); *G09G 2300/0439* (2013.01); *G09G 2300/0814* (2013.01)

(58) Field of Classification Search
CPC ... G09G 3/3614; G09G 5/003; G09G 3/3659; G09G 2300/0885; G02F 1/136286
USPC ..... 345/87, 204, 205, 98–100; 349/43, 49
See application file for complete search history.

(56) References Cited

U.S. PATENT DOCUMENTS 5,731,856 A 3/1998 Kim et al.
5,744,864 A 4/1998 Cillessen et al.

(Continued)

FOREIGN PATENT DOCUMENTS

EP 1 737 044 A 12/2006
EP 2 226 847 A 9/2010

(Continued)

OTHER PUBLICATIONS

Fortunato et al., "Wide-Bandgap High-Mobility ZnO Thin-Film Transistors Produced At Room Temperature," Appl. Phys. Lett. (Applied Physics Letters), Sep. 27, 2004, vol. 85, No. 13, pp. 2541-2543.

(Continued)

*Primary Examiner* — Abbas Abdulselam
(74) *Attorney, Agent, or Firm* — Eric J. Robinson; Robinson Intellectual Property Law Office, P.C.

(57) ABSTRACT

A display device in which partial driving can be performed with a simplified configuration of a circuit including a wiring. One of signal processing circuits includes a first transistor that controls the potential of its respective gate signal line, and a second transistor that outputs a start signal for the subsequent stage and a reset signal for the preceding stage. A signal for controlling whether the gate signal line is in an active state (a state where a selection signal is output) or a non-active state (a state where a selection signal is not output or a non-selection signal continues to be output) is input to the first transistor. A clock signal is input to the second transistor. Thus, the number of wirings necessary for operating the device is reduced.

18 Claims, 28 Drawing Sheets

(56) References Cited

U.S. PATENT DOCUMENTS

| | | | | |
|---|---|---|---|---|
| 6,294,274 | B1 | 9/2001 | Kawazoe et al. | |
| 6,563,174 | B2 | 5/2003 | Kawasaki et al. | |
| 6,727,522 | B1 | 4/2004 | Kawasaki et al. | |
| 6,967,436 | B2 | 11/2005 | Park | |
| 7,049,190 | B2 | 5/2006 | Takeda et al. | |
| 7,061,014 | B2 | 6/2006 | Hosono et al. | |
| 7,064,346 | B2 | 6/2006 | Kawasaki et al. | |
| 7,105,868 | B2 | 9/2006 | Nause et al. | |
| 7,211,825 | B2 | 5/2007 | Shih et al. | |
| 7,282,782 | B2 | 10/2007 | Hoffman et al. | |
| 7,292,218 | B2 | 11/2007 | Lin et al. | |
| 7,297,977 | B2 | 11/2007 | Hoffman et al. | |
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,436,923 | B2 | 10/2008 | Tobita | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,674,650 | B2 | 3/2010 | Akimoto et al. | |
| 7,732,819 | B2 | 6/2010 | Akimoto et al. | |
| 7,936,332 | B2 | 5/2011 | Lee et al. | |
| 7,964,876 | B2 * | 6/2011 | Umezaki | 257/72 |
| 7,978,277 | B2 * | 7/2011 | Kimura | 349/48 |
| 8,085,235 | B2 | 12/2011 | Jeon et al. | |
| 8,089,446 | B2 | 1/2012 | Pak et al. | |
| RE43,354 | E | 5/2012 | Bae | |
| 2001/0046027 | A1 | 11/2001 | Tai et al. | |
| 2002/0056838 | A1 | 5/2002 | Ogawa | |
| 2002/0132454 | A1 | 9/2002 | Ohtsu et al. | |
| 2003/0189401 | A1 | 10/2003 | Kido et al. | |
| 2003/0218222 | A1 | 11/2003 | Wager et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0104836 | A1 | 5/2005 | Lin et al. | |
| 2005/0134545 | A1 * | 6/2005 | Jang et al. | 345/100 |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0040792 | A1 | 2/2007 | Kwag et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0055225 | A1 | 3/2008 | Pak et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0219401 | A1 | 9/2008 | Tobita | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0278667 | A1 | 11/2008 | Kobashi | |
| 2008/0296568 | A1 | 12/2008 | Ryu et al. | |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0231246 | A1 | 9/2009 | Seo et al. | |
| 2009/0278122 | A1 | 11/2009 | Hosono et al. | |
| 2009/0280600 | A1 | 11/2009 | Hosono et al. | |
| 2009/0295699 | A1 | 12/2009 | Korenari et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |

FOREIGN PATENT DOCUMENTS

| | | | |
|---|---|---|---|
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 2000-044236 | A | 2/2000 |
| JP | 2000-150900 | A | 5/2000 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2005-108368 | A | 4/2005 |
| JP | 2005-149691 | A | 6/2005 |
| JP | 2007-004176 | A | 1/2007 |
| JP | 2008-058939 | A | 3/2008 |
| JP | 2008-140490 | A | 6/2008 |
| JP | 2008-217902 | A | 9/2008 |
| JP | 2009-134814 | A | 6/2009 |
| WO | WO 2004/114391 | | 12/2004 |

OTHER PUBLICATIONS

Dembo et al., "RFCPUS on Glass and Plastic Substrates Fabricated by TFT Transfer Technology," IEDM 05: Technical Digest of International Electron Devices Meeting, Dec. 5, 2005, pp. 1067-1069.

Ikeda et al., "Full-Functional System Liquid Crystal Display Using CG-Silicon Technology," SID Digest '04: SID International Symposium Digest of Technical Papers, 2004, vol. 35, pp. 860-863.

Nomura et al., "Room-Temperature Fabrication of Transparent Flexible Thin-Film Transistors Using Amorphous Oxide Semiconductors," Nature, Nov. 25, 2004, vol. 432, pp. 488-492.

(56) References Cited

OTHER PUBLICATIONS

Park et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Takahashi et al., "Theoretical Analysis of IGZO Transparent Amorphous Oxide Semiconductor," IDW '08: Proceedings of the 15th International Display Workshops, Dec. 3, 2008, pp. 1637-1640.
Hayashi et al., "42.1: Invited Paper: Improved Amorphous In—Ga—Zn—O TFTs," SID Digest '08: SID International Symposium Digest of Technical Papers, May 20, 2008, vol. 39, pp. 621-624.
Prins et al., "A Ferroelectric Transparent Thin-Film Transistor," Appl. Phys. Lett. (Applied Physics Letters), Jun. 17, 1996, vol. 68, No. 25, pp. 3650-3652.
Nakamura et al., "The Phase Relations in the $In_2O_3$—$Ga_2ZnO_4$—ZnO System at 1350° C.," Journal of Solid State Chemistry, Aug. 1, 1991, vol. 93, No. 2, pp. 298-315.
Kimizuka et al., "Syntheses and Single-Crystal Data of Homologous Compounds, $In_2O_3(ZnO)_m$, (m=3, 4, and 5), $InGaO_3(ZnO)_3$, and $Ga_2O_3(ZnO)_m$ (m=7, 8, 9, and 16) in the $In_2O_3$—$ZnGa_2O_4$—ZnO System," Journal of Solid State Chemistry, Apr. 1, 1995, vol. 116, No. 1, pp. 170-178.
Nomura et al., "Thin-Film Transistor Fabricated in Single-Crystalline Transparent Oxide Semiconductor," Science, May 23, 2003, vol. 300, No. 5623, pp. 1269-1272.
Masuda et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Asakuma et al., "Crystallization and Reduction of Sol-Gel-Derived Zinc Oxide Films by Irradiation with Ultraviolet Lamp," Journal of Sol-Gel Science and Technology, 2003, vol. 26, pp. 181-184.
Osada et al., "15.2: Development of Driver-Integrated Panel using Amorphous In—Ga—Zn—Oxide TFT," SID Digest '09: SID International Symposium Digest of Technical Papers, May 31, 2009, pp. 184-187.
Nomura et al., "Carrier transport in transparent oxide semiconductor with intrinsic structural randomness probed using single-crystalline $InGaO_3(ZnO)_5$ films," Appl. Phys. Lett. (Applied Physics Letters), Sep. 13, 2004, vol. 85, No. 11, pp. 1993-1995.
Li et al., "Modulated Structures of Homologous Compounds $InMO_3(ZnO)_m$, (*M*=In,Ga; *m*=Integer) Described by Four-Dimensional Superspace Group," Journal of Solid State Chemistry, 1998, vol. 139, pp. 347-355.
Son et al., "42.4L: Late-News Paper: 4 Inch QVGA AMOLED Driven by the Threshold Voltage Controlled Amorphous GIZO ($Ga_2O_3$—$In_2O_3$—ZnO) TFT," SID Digest '08: SID International Symposium Digest of Technical Papers, May 20, 2008, vol. 39, pp. 633-636.
Lee et al., "World's Largest (15-inch) XGA AMLCD Panel Using IGZO Oxide TFT," SID Digest '08: SID International Symposium Digest of Technical Papers, May 20, 2008, vol. 39, pp. 625-628.
Nowatari et al., "60.2: Intermediate Connector with Suppressed Voltage Loss for White Tandem OLEDs," SID Digest '09: SID International Symposium Digest of Technical Papers, May 31, 2009, vol. 40, pp. 899-902.
Kanno et al., "White Stacked Electrophosphorecent Organic Light-Emitting Devices Employing $MoO_3$ as a Charge-Generation Layer," Adv. Mater. (Advanced Materials), 2006, vol. 18, No. 3, pp. 339-342.
Tsuda et al., "Ultra Low Power Consumption Technologies for Mobile TFT-LCDs," IDW '02: Proceedings of the 9$^{th}$ International Display Workshops, Dec. 4, 2002, pp. 295-298.
Van de Walle, "Hydrogen as a Cause of Doping in Zinc Oxide," Phys. Rev. Lett. (Physical Review Letters), Jul. 31, 2000, vol. 85, No. 5, pp. 1012-1015.
Fung et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.
Jeong et al., "3.1: Distinguished Paper: 12.1-Inch WXGA AMOLED Display Driven by Indium—Gallium—Zinc Oxide TFTs Array," SID Digest '08: SID International Symposium Digest of Technical Papers, May 20, 2008, vol. 39, No. 1, pp. 1-4.
Park et al., "High performance amorphous oxide thin film transistors with self-aligned top-gate structure," IEDM 09: Technical Digest of International Electron Devices Meeting, Dec. 7, 2009, pp. 191-194.
Kurokawa et al., "UHF RFCPUs on Flexible and Glass Substrates for Secure RFID Systems," Journal of Solid-State Circuits, 2008, vol. 43, No. 1, pp. 292-299.
Ohara et al., "Amorphous In—Ga—Zn—Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Coates et al., "Optical Studies of the Amorphous Liquid-Cholesteric Liquid Crystal Transition: The "Blue Phase"," Physics Letters, Sep. 10, 1973, vol. 45A, No. 2, pp. 115-116.
Cho et al., "21.2: Al and Sn-doped Zinc Indium Oxide Thin Film Transistors for AMOLED Back-Plane," SID Digest '09: SID International Symposium Digest of Technical Papers, May 31, 2009, pp. 280-283.
Lee et al., "15.4: Excellent Performance of Indium—Oxide-Based Thin-Film Transistors by DC Sputtering," SID Digest '09: SID International Symposium Digest of Technical Papers, May 31, 2009, pp. 191-193.
Jin et al., "65.2: Distinguished Paper: World-Largest (6.5") Flexible Full Color Top Emission AMOLED Display on Plastic Film and Its Bending Properties," SID Digest '09: SID International Symposium Digest of Technical Papers, May 31, 2009, pp. 983-985.
Sakata et al., "Development of 4.0-In. AMOLED Display with Driver Circuit Using Amorphous In—Ga—Zn—Oxide TFTs," IDW '09: Proceedings of the 16$^{th}$ International Display Workshops, 2009, pp. 689-692.
Park et al., "Amorphous Indium—Gallium—Zinc Oxide TFTs and their Application for Large Size AMOLED," AM-FPD '08 Digest of Technical Papers, Jul. 2, 2008, pp. 275-278.
Park et al., "Challenge to Future Displays: Transparent AM-OLED Driven by PEALD Grown ZnO TFT," IMID '07 Digest, 2007, pp. 1249-1252.
Godo et al., "Temperature Dependence of Characteristics and Electronic Structure for Amorphous In—Ga—Zn—Oxide TFT," AM-FPD '09 Digest of Technical Papers, Jul. 1, 2009, pp. 41-44.
Osada et al., "Development of Driver-Integrated Panel using Amorphous In—Ga—Zn—Oxide TFT," AM-FPD '09 Digest of Technical Papers, Jul. 1, 2009, pp. 33-36.
Hirao et al., "Novel Top-Gate Zinc Oxide Thin-Film Transistors (ZnO TFTs) for AMLCDs," Journal of the SID, 2007, vol. 15, No. 1, pp. 17-22.
Hosono, "68.3: Invited Paper: Transparent Amorphous Oxide Semiconductors for High Performance TFT," SID Digest '07: SID International Symposium Digest of Technical Papers, 2007, vol. 38, pp. 1830-1833.
Godo et al., "P-9: Numerical Analysis on Temperature Dependence of Characteristics of Amorphous In—Ga—Zn—Oxide TFT," SID Digest '09: SID International Symposium Digest of Technical Papers, May 31, 2009, pp. 1110-1112.
Ohara et al., "21.3: 4.0 In. QVGA AMOLED Display Using In—Ga—Zn—Oxide TFTs with a Novel Passivation Layer," SID Digest '09: SID International Symposium Digest of Technical Papers, May 31, 2009, pp. 284-287.
Miyasaka, "Suftla Flexible Microelectronics on their Way to Business," SID Digest '07: SID International Symposium Digest of Technical Papers, 2007, vol. 38, pp. 1673-1676.
Chern et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Kikuchi et al., "39.1: Invited Paper: Optically Isotropic Nano-Structured Liquid Crystal Composites for Display Applications," SID Digest '09: SID International Symposium Digest of Technical Papers, May 31, 2009, pp. 578-581.

(56) References Cited

OTHER PUBLICATIONS

Asaoka et al., "29.1: Polarizer-Free Reflective LCD Combined With Ultra Low-Power Driving Technology," SID Digest '09: SID International Symposium Digest of Technical Papers, May 31, 2009, pp. 395-398.
Lee et al., "Current Status of, Challenges to, and Perspective View of AM-OLED," IDW '06: Proceedings of the 13th International Display Workshops, Dec. 7, 2006, pp. 663-666.
Kikuchi et al., "62.2: Invited Paper: Fast Electro-Optical Switching in Polymer-Stabilized Liquid Crystalline Blue Phases for Display Application," SID Digest '07: SID International Symposium Digest of Technical Papers, 2007, vol. 38, pp. 1737-1740.
Nakamura, "Synthesis of Homologous Compound with New Long-Period Structure," NIRIM Newsletter, Mar. 1, 1995, vol. 150, pp. 1-4.
Kikuchi et al., "Polymer-Stabilized Liquid Crystal Blue Phases," Nature Materials, Sep. 2, 2002, vol. 1, pp. 64-68.
Kimizuka et al., "Spinel, $YbFe_2O_4$, and $Yb_2Fe_3O_7$ Types of Structures for Compounds in the $In_2O_3$ and $Sc_2O_3$—$A_2O_3$—BO Systems [A: Fe, Ga, or Al; B: Mg, Mn, Fe, Ni, Cu, or Zn] at Temperatures Over 1000° C.," Journal of Solid State Chemistry, 1985, vol. 60, pp. 382-384.
Kitzerow et al., "Observation of Blue Phases in Chiral Networks," Liquid Crystals, 1993, vol. 14, No. 3, pp. 911-916.
Costello et al., "Electron Microscopy of a Cholesteric Liquid Crystal and its Blue Phase," Phys. Rev. A (Physical Review A), May 1, 1984, vol. 29, No. 5, pp. 2957-2959.
Meiboom et al., "Theory of the Blue Phase of Cholesteric Liquid Crystals," Phys. Rev. Lett. (Physical Review Letters), May 4, 1981, vol. 46, No. 18, pp. 1216-1219.
Park et al., "42.3: Transparent ZnO Thin Film Transistor for the Application of High Aperture Ratio Bottom Emission AM-OLED Display," SID Digest '08: SID International Symposium Digest of Technical Papers, May 20, 2008, vol. 39, pp. 629-632.
Orita et al., "Mechanism of Electrical Conductivity of Transparent $InGaZnO_4$," Phys. Rev. B (Physical Review B), Jan. 15, 2000, vol. 61, No. 3, pp. 1811-1816.
Nomura et al., "Amorphous Oxide Semiconductors for High-Performance Flexible Thin-Film Transistors," Jpn. J. Appl. Phys. (Japanese Journal of Applied Physics), 2006, vol. 45, No. 5B, pp. 4303-4308.
Janotti et al., "Native Point Defects in ZnO," Phys. Rev. B (Physical Review. B), Oct. 4, 2007, vol. 76, No. 16, pp. 165202-1-165202-22.
Park et al., "Electronic Transport Properties of Amorphous Indium—Gallium—Zinc Oxide Semiconductor Upon Exposure to Water," Appl. Phys. Lett. (Applied Physics Letters), 2008, vol. 92, pp. 072104-1-072104-3.
Hsieh et al., "P-29: Modeling of Amorphous Oxide Semiconductor Thin Film Transistors and Subgap Density of States," SID Digest '08: SID International Symposium Digest of Technical Papers, May 20, 2008, vol. 39, pp. 1277-1280.
Janotti et al., "Oxygen Vacancies in ZnO," Appl. Phys. Lett. (Applied Physics Letters), 2005, vol. 87, pp. 122102-1-122102-3.
Oba et al., "Defect energetics in ZnO: A hybrid Hartree-Fock density functional study," Phys. Rev. B (Physical Review B), 2008, vol. 77, pp. 245202-1-245202-6.
Orita et al., "Amorphous transparent conductive oxide $InGaO_3(ZnO)_m$ (m<4): a Zn 4s conductor," Philosophical Magazine, 2001, vol. 81, No. 5, pp. 501-515.
Hosono et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Mo et al., "Amorphous Oxide TFT Backplanes for Large Size AMOLED Displays," IDW '08: Proceedings of the 6th International Display Workshops, Dec. 3, 2008, pp. 581-584.
Kim et al., "High-Performance oxide thin film transistors passivated by various gas plasmas," 214th ECS Meeting, 2008, No. 2317, ECS.
Clark et al., "First Principles Methods Using CASTEP," Zeitschrift fur Kristallographie, 2005, vol. 220, pp. 567-570.
Lany et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Park et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Oh et al., "Improving the Gate Stability of ZnO Thin-Film Transistors with Aluminum Oxide Dielectric Layers," J. Electrochem. Soc. (Journal of the Electrochemical Society), 2008, vol. 155, No. 12, pp. H1009-H1014.
Ueno et al., "Field-Effect Transistor on $SrTiO_3$ with Sputtered $Al_2O_3$ Gate Insulator," Appl. Phys. Lett. (Applied Physics Letters), Sep. 1, 2003, vol. 83, No. 9, pp. 1755-1757.
International Search Report (Application No. PCT/JP2010/073900) dated Feb. 8, 2011.
Written Opinion (Application No. PCT/JP2010/073900) dated Feb. 8, 2011.

* cited by examiner

| Operation | V111 | V113 | 102 | 101 | V112 | V114 |
|---|---|---|---|---|---|---|
| DR1 | V1 | V1 | ON | ON | V1 | V1 |
| DR2 | V1 | V2 | ON | ON | V1 | V2 |
| DR3 | V2 | V1 | ON | ON | V2 | V1 |
| DR4 | V2 | V2 | ON | ON | V2 | V2 |
| DR5 | V1 | V1 | OFF | OFF | Z | Z |
| DR6 | V1 | V2 | OFF | OFF | Z | Z |
| DR7 | V2 | V1 | OFF | OFF | Z | Z |
| DR8 | V2 | V2 | OFF | OFF | Z | Z |

DISPLAY DEVICE

TECHNICAL FIELD

One embodiment of the present invention relates to a display device. An example of the display device is a liquid crystal display device. Moreover, one of the technical fields herein is a display device in which a pixel is selected by a gate signal line and a source signal line (or a video signal line) to display an image.

BACKGROUND ART

Display devices in which only part of an image is rewritten so that power consumption can be reduced have been developed. Such a display device includes a gate driver circuit with which only some of gate signal lines can be driven (such driving can be referred to as partial driving) in order to rewrite part of an image.

Patent Document 1 discloses a gate driver circuit that can realize partial driving. In Patent Document 1, the gate driver circuit is divided into a plurality of groups. Different start pulses are input to the plurality of groups. By controlling start pulses input to each group, the gate driver circuit in Patent Document 1 realizes partial driving.

REFERENCE

Patent Document 1: Japanese Published Patent Application No. 2007-004176

DISCLOSURE OF INVENTION

However, in a conventional gate driver circuit, which section of gate signal lines is selected is determined by groups already divided and start pulses input to each group. Therefore, selection of only a given part of the gate signal lines cannot be achieved. Moreover, since start pulses input to one group need to be different from those input to another group, the number of signals necessary for driving the gate driver circuit is increased. For that reason, when the gate driver circuit is formed over a substrate where a pixel portion is formed, the number of connections between the substrate where the pixel portion is formed and an external circuit is increased.

An object of one embodiment of the present invention is to provide a display device in which partial driving can be performed with a simplified configuration of a circuit including a wiring.

A display device according to one embodiment of the present invention includes a plurality of stages of signal processing circuits corresponding to gate signal lines in a pixel region. One of the signal processing circuits includes a first transistor that controls a potential of its respective gate signal line, and a second transistor that outputs a start signal for the subsequent-stage signal processing circuit and a reset signal for the preceding-stage signal processing circuit. A signal for controlling whether the gate signal line is in an active state (a state where a selection signal is output) or a non-active state (a state where a selection signal is not output or a state where a non-selection signal continues to be output) is input to the first transistor. A clock signal is input to the second transistor. With this structure, the number of wirings necessary for operating the device is reduced.

In a display device including a plurality of stages of signal processing circuit portions corresponding to a plurality of gate signal lines extended in a region including pixels arranged in matrix, the driver circuit has a configuration for selecting a given gate signal line in the pixel region. The signal processing circuit portion for selecting a given gate signal line includes a first transistor and a second transistor. A signal for controlling an active state and a non-active state is input to a first terminal of the first transistor. A second terminal of the first transistor is connected to its respective gate signal line. A clock signal is input to a first terminal of the second transistor. A second terminal of the second transistor outputs a start signal for the subsequent-stage signal processing circuit portion and a reset signal for the preceding-stage signal processing circuit portion. Moreover, the signal processing circuit portion also includes a circuit portion that controls gate potentials of the first and second transistors. A plurality of stages of signal processing circuit portions are provided, and the signal processing circuit portions can be sequentially selected and a signal or a potential output to the gate signal line can be selected with the above structure. Thus, the display device can be operated so that a signal for driving a pixel can be supplied to a given gate signal line.

A display device including m stages of signal processing circuit portions corresponding to a plurality of gate signal lines extended in a region including pixels arranged in matrix includes a first wiring, a second wiring, a third wiring, and a fourth wiring. A clock signal is input to the first wiring. A signal for selecting an active state where a clock signal is input or a non-active state where a constant potential is input is input to the second wiring. A clock signal of opposite phase to the clock signal input to the first wiring is input to the third wiring. A signal for selecting an active state where a clock signal of opposite phase is input or a non-active state where a constant potential is input is input to the fourth wiring in synchronization with the signal input to the second wiring. The display device employs a configuration for selecting a given gate signal line in the pixel region. The n-th stage signal processing circuit portion ($1<n<m$) includes a first transistor having a first terminal connected to the second wiring, and a second terminal connected to the n-th gate signal line; a second transistor having a first terminal connected to the first wiring, and a second terminal connected to a reset signal input terminal of the (n−1)th stage signal processing circuit portion and a start signal input terminal of the (n+1)th stage signal processing circuit portion; and a circuit portion for controlling gate potentials of the first and second transistors. The (n+1)th stage signal processing circuit portion ($1<n<m$) includes a third transistor having a first terminal connected to the fourth wiring, and a second terminal connected to the (n+1)th gate signal line; a fourth transistor having a first terminal connected to the third wiring, and a second terminal connected to a reset signal input terminal of the n-th stage signal processing circuit portion and a start signal input terminal of the (n+2)th stage signal processing circuit portion; and a circuit portion for controlling gate potentials of the third and fourth transistors. In the case where m stages of signal processing circuit portions are provided, by signals transmitted through the first to fourth wirings, the signal processing circuit portions can be sequentially selected and a signal or a potential output to the gate signal line can be selected. Thus, the display device can be operated so that a signal for driving a pixel can be supplied to a given gate signal line.

In other words, the first to fourth transistors provided in the signal processing circuit portion for selecting a gate signal line have the structure described below. In the n-th stage signal processing circuit portion ($1<n<m$), a first transistor has a first terminal to which a signal for selecting an active state where a clock signal is input or a non-active state where a constant potential is input is input, and a second terminal that outputs a signal to the n-th gate signal line. A second transistor has a first terminal to which a clock signal is input, and a second terminal that outputs a reset signal to the (n−1)th stage signal processing circuit portion and a start signal to the (n+1)th stage signal processing circuit portion. In the (n+1)th stage signal processing circuit portion (1<n<m), a third transistor has a first terminal to which a signal for selecting an active state where a clock signal of opposite phase is input or a non-active state where a constant potential is input is input in synchronization with the clock signal, and a second terminal that outputs a signal to the (n+1)th gate signal line. A fourth transistor has a first terminal to which a clock signal of opposite phase to the clock signal is input, and a second terminal that outputs a reset signal to the n-th stage signal processing circuit portion and a start signal to the (n+2)th stage signal processing circuit portion. The first and third transistors operate so as to control an active state (a state where a selection signal is output) and a non-active state (a state where a selection signal is not output or a state where a non-selection signal continues to be output) of the gate signal line. The second and fourth transistors control operation of the preceding-stage and subsequent-stage signal processing circuit portions. Thus, the display device can be operated so that a signal for driving a pixel can be supplied to a given gate signal line.

In this specification and the like, explicit singular forms preferably mean singular forms. However, the singular form can also include the plural without limitation to the above. Similarly, explicit plural forms preferably mean plural forms. However, the plural form can include the singular without limitation to the above.

For example, in this specification and the like, the terms "first", "second," "third," and the like are used for distinguishing various elements, members, regions, layers, and areas from each other. Therefore, the terms "first", "second", "third," and the like do not limit the number of the elements, members, regions, layers, areas, or the like. Further, for example, "first" can be replaced with "second", "third", or the like.

In this specification and the like, the terms "over" and "below" do not necessarily mean the positions "directly on" and "directly under", respectively. For example, the expression "a gate electrode over a gate insulating layer" does not exclude the case where a component is placed between the gate insulating layer and the gate electrode. Moreover, the terms "over" and "below" are only used for convenience of description and can be switched to each other in the case where the relation of components is reversed, unless otherwise specified.

In this specification and the like, the terms "electrode", "wiring", and "terminal" do not have functional limitations. For example, an "electrode" is sometimes used as part of a "wiring", and vice versa. Furthermore, the term "electrode" or "wiring" can also mean a plurality of "electrodes" or "wirings" formed in an integrated manner. In addition, a "terminal" is not limited to representing a specific portion. For example, a "first terminal" can include a portion corresponding to a source electrode or a drain electrode of a transistor, or a conductor electrically connected to a region that substantially functions as a source region or a drain region of a transistor.

According to one embodiment of the present invention, in a driver circuit of a display device, the configuration of the circuit including a wiring can be simplified. That is, a display device in which partial driving can be performed can be provided by providing a wiring (e.g., a clock signal line) to which a signal for controlling an active state (a state where a selection signal is output) and a non-active state (a state where a selection signal is not output or a state where a non-selection signal continues to be output) is input.

BEST MODE FOR CARRYING OUT THE INVENTION

Figure 1A:
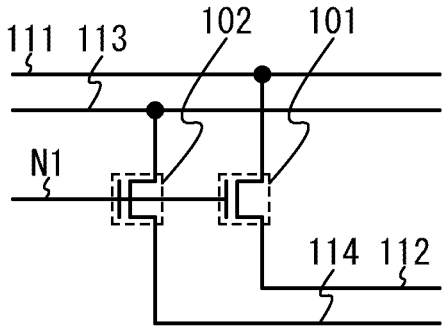
FIGS. 1A and 1B each illustrate a configuration of a circuit according to one embodiment.

Embodiments will be described below with reference to the accompanying drawings. Note that the embodiments can be carried out in many different modes, and it is easily understood by those skilled in the art that modes and details can be modified in various ways without departing from the spirit and the scope of the present invention. Therefore, the present invention is not interpreted as being limited to the description of the embodiments. Note that in structures described below, the same portions or portions having similar functions are denoted by the same reference numerals in different drawings, and description thereof is not repeated. In the drawings, the size, the thickness of a layer, or a region is sometimes exaggerated for simplicity. Therefore, embodiments of the present invention are not limited to such scales.

(Configuration of Circuit According to One Embodiment)

FIG. 1A illustrates an example of a configuration of a circuit whose output signal with respect to an input signal is controlled by a transistor 101 and a transistor 102.

The case where the transistors 101 and 102 included in the circuit in FIG. 1A are n-channel transistors will be described. An n-channel transistor is turned on when a potential difference (Vgs) between a gate and a source exceeds the threshold voltage. Note that a p-channel transistor can be alternatively used in the circuit in FIG. 1A.

The connection relation in the circuit in FIG. 1A is as follows. A first terminal (e.g., one of a source electrode and a drain electrode) of the transistor 101 is connected to a wiring 111. A second terminal (e.g., the other of the source electrode and the drain electrode) of the transistor 101 is connected to a wiring 112. A first terminal of the transistor 102 is connected to a wiring 113. A second terminal of the transistor 102 is connected to a wiring 114. A gate of the transistor 102 is connected to a gate of the transistor 101. Note that a portion where the gate of the transistor 101 and the gate of the transistor 102 are connected is denoted by a node N1.

The wirings 111 to 114 will be described below.

A digital signal such as a clock signal is input to the wirings 111 and 113. That is, each of the wirings 111 and 113 is a wiring for transmitting a signal such as a clock signal to an element included in the circuit, such as the transistor 101. Thus, the wirings 111 and 113 have a function of a signal line or a clock signal line.

Note that for convenience, an H-level potential of a signal input to the wirings 111 and 113 is represented by a potential V1, and an L-level potential of a signal input to the wirings 111 and 113 is represented by a potential V2.

One of the signal input to the wiring 111 and the signal input to the wiring 113 is in either an active state or a non-active state. The other of the signal input to the wiring 111 and the signal input to the wiring 113 is in an active state. In this specification and the like, the expression "a signal is in a non-active state" means that the signal has a constant value (e.g., a value equal to the potential V1, a value equal to the potential V2, or a value equal to a ground potential). Moreover, in this specification and the like, the expression "a signal is in an active state" means that the signals is in any state except "a non-active state".

The wiring 112 is connected to the terminal on the output side (the second terminal) of the transistor 101. For that reason, a signal controlled by the transistor 101 is output from the wiring 112. That is, the wiring 112 is a wiring for transmitting an output signal controlled by the transistor 101 to a load or the like connected to the wiring 112. Thus, the wiring 112 has a function of a signal line or an output signal line.

When a digital signal is input to the wiring 111, a signal output from the wiring 112 is also a digital signal. An H-level potential of the signal output from the wiring 112 is approximately equal to the H-level potential (e.g., the potential V1) of the signal input to the wiring 111. Moreover, an L-level potential of the signal output from the wiring 112 is approximately equal to the L-level potential (e.g., the potential V2) of the signal input to the wiring 111.

The wiring 114 is connected to the terminal on the output side (the second terminal) of the transistor 102. For that reason, a signal controlled by the transistor 102 is output from the wiring 114. That is, the wiring 114 is a wiring for transmitting an output signal controlled by the transistor 102 to a load or the like connected to the wiring 114. Thus, the wiring 114 has a function of a signal line or an output signal line.

When a digital signal is input to the wiring 113, a signal output from the wiring 114 is also a digital signal. An H-level potential of the signal output from the wiring 114 is approximately equal to the H-level potential (e.g., the potential V1) of the signal input to the wiring 113. Moreover, an L-level potential of the signal output from the wiring 114 is approximately equal to the L-level potential (e.g., the potential V2) of the signal input to the wiring 113.

Note that the circuit illustrated in FIG. 1A can be used as part of a driver circuit for gate signal lines in a display device. In that case, one of the wirings 112 and 114 is extended to a pixel portion and has a function of a gate signal line (also referred to as a gate line, a scan line, or a selection line) connected to a gate of a transistor (e.g., a selection transistor) provided in each pixel. The other of the wirings 112 and 114 can be used as a wiring for transmitting a transfer signal (a start signal or a reset signal).

Examples of functions of the transistors 101 and 102 will be described.

The transistor 101 has a function of a switch that controls electrical continuity between the wiring 111 and the wiring 112, a function of controlling timing of raising or lowering the potential of the wiring 112, and/or a function of controlling timing of raising the potential of the node N1.

The transistor 102 has a function of a switch that controls electrical continuity between the wiring 113 and the wiring 114, a function of controlling timing of raising or lowering the potential of the wiring 114, and/or a function of controlling timing of raising the potential of the node N1.

Figures 2A, 2B:
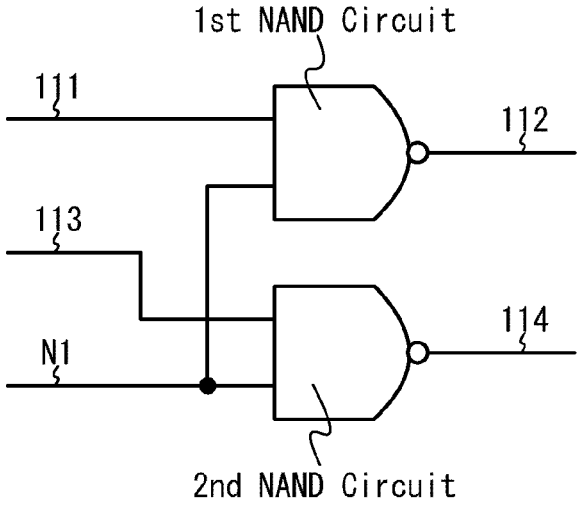
FIG. 2A illustrates an example of a truth table for explaining operation of the circuit in FIG. 1A.
FIG. 2B illustrates an example of a logic circuit for explaining the operation.

FIGS. 2A and 2B show that at least eight operations (referred to as operations DR1 to DR8) are realized by a combination of the potential of the wiring 111, the potential of the wiring 114, and conduction states of the transistors 101 and 102 in the circuit illustrated in FIG. 1A. FIG. 2A is an example of a truth table for explaining these eight operations. FIG. 2B illustrates an example of a logic circuit for realizing these eight operations.

Figure 3A:
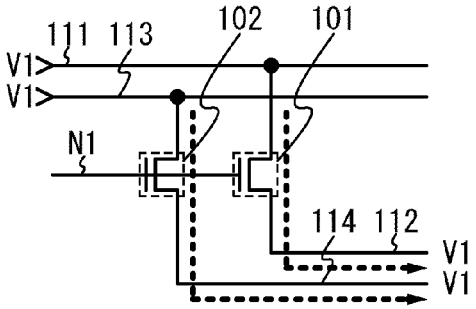
FIGS. 3A to 3H each illustrate an example of a schematic diagram for explaining operation of the circuit in FIG. 1A.

In the operation DR1, the potential of the wiring 111 is equal to the potential V1, and the potential of the wiring 113 is equal to the potential V1. The transistor 101 is turned on, and electrical continuity is established between the wiring 111 and the wiring 112. The transistor 102 is turned on, and electrical continuity is established between the wiring 113 and the wiring 114. Thus, the potential of the wiring 111 is supplied to the wiring 112, so that the potential of the wiring 112 is equal to the potential V1. The potential of the wiring 113 is supplied to the wiring 114, so that the potential of the wiring 114 is equal to the potential V1 (see FIG. 3A).

Figure 3B:
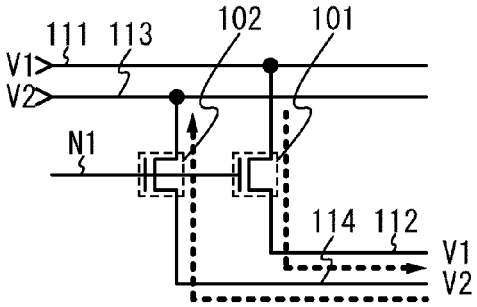

In the operation DR2, the potential of the wiring 111 is equal to the potential V1, and the potential of the wiring 113 is equal to the potential V2. The transistor 101 is turned on, and electrical continuity is established between the wiring 111 and the wiring 112. The transistor 102 is turned on, and electrical continuity is established between the wiring 113 and the wiring 114. Thus, the potential of the wiring 111 is supplied to the wiring 112, so that the potential of the wiring 112 is equal to the potential V1. The potential of the wiring 113 is supplied to the wiring 114, so that the potential of the wiring 114 is equal to the potential V2 (see FIG. 3B).

Figure 3C:
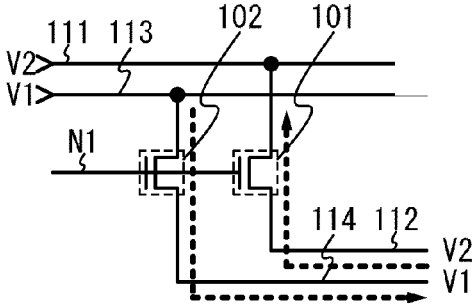

In the operation DR3, the potential of the wiring 111 is equal to the potential V2, and the potential of the wiring 113 is equal to the potential V1. The transistor 101 is turned on, and electrical continuity is established between the wiring 111 and the wiring 112. The transistor 102 is turned on, and electrical continuity is established between the wiring 113 and the wiring 114. Thus, the potential of the wiring 111 is supplied to the wiring 112, so that the potential of the wiring 112 is equal to the potential V2. The potential of the wiring 113 is supplied to the wiring 114, so that the potential of the wiring 114 is equal to the potential V1 (see FIG. 3C).

Figure 3D:
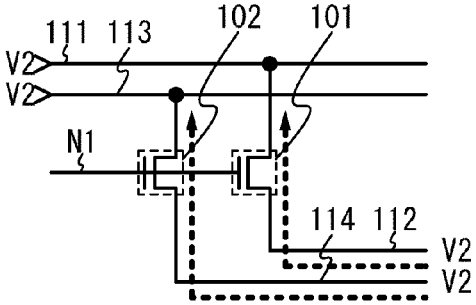
Figure 3E:
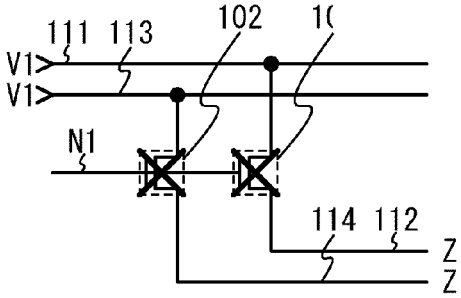
Figure 3F:
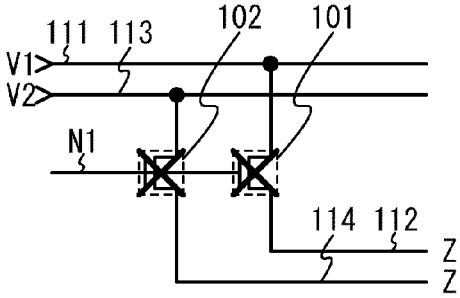
Figure 3G:
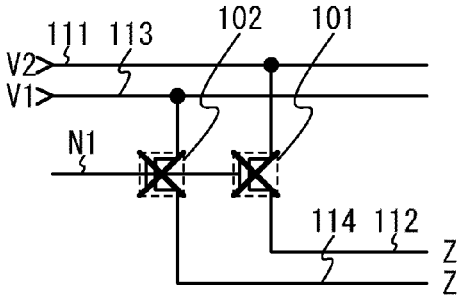
Figure 3H:
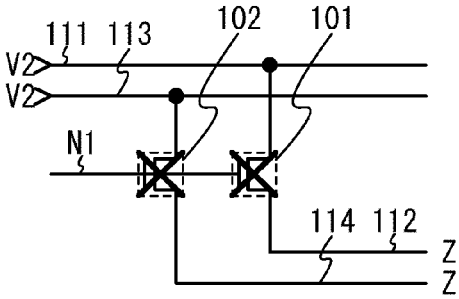

In the operation DR4, the potential of the wiring 111 is equal to the potential V2, and the potential of the wiring 113 is equal to the potential V2. The transistor 101 is turned on, and electrical continuity is established between the wiring 111 and the wiring 112. The transistor 102 is turned on, and electrical continuity is established between the wiring 113 and the wiring 114. Thus, the potential of the wiring 111 is supplied to the wiring 112, so that the potential of the wiring 112 is equal to the potential V2. The potential of the wiring 113 is supplied to the wiring 114, so that the potential of the wiring 114 is equal to the potential V2 (see FIG. 3D).

In the operations DR5 to DR8, the transistor 101 is turned off, and electrical continuity between the wiring 111 and the wiring 112 is broken. The transistor 102 is turned off, and electrical continuity between the wiring 113 and the wiring 114 is broken. Thus, the wiring 112 is in a high impedance state (shown as Z), and the potential of the wiring 112 remains the same as that before the operations DR5 to DR8. The wiring 114 is in a high impedance state (shown as Z), and the potential of the wiring 114 remains the same as that before the operations DR5 to DR8 (see FIGS. 3E to 3H).

For example, when the circuit in FIG. 1A performs one of the operations DR5 to DR8 after performing the operation DR1, the potential of the wiring 112 is equal to the potential V1, and the potential of the wiring 114 is equal to the potential V1. When the circuit in FIG. 1A performs one of the operations DR5 to DR8 after performing the operation DR2, the potential of the wiring 112 is equal to the potential V1, and the potential of the wiring 114 is equal to the potential V2. When the circuit in FIG. 1A performs one of the operations DR5 to DR8 after performing the operation DR3, the potential of the wiring 112 is equal to the potential V2, and the potential of the wiring 114 is equal to the potential V1. When the circuit in FIG. 1A performs one of the operations DR5 to DR8 after performing the operation DR4, the potential of the wiring 112 is equal to the potential V2, and the potential of the wiring 114 is equal to the potential V2.

In the case where the transistors 101 and 102 are turned on and at least one of the potential of the wiring 112 and the potential of the wiring 114 is equal to the potential V1 as in the operations DR1 to DR3, the potential of the node N1 is higher than V1+Vth101 (Vth101 is the threshold voltage of the transistor 101) and higher than V1+Vth102 (Vth102 is the threshold voltage of the transistor 102). In the case where the transistors 101 and 102 are turned on and both the potential of the wiring 112 and the potential of the wiring 114 are equal to the potential V2 as in the operation DR4, the potential of the node N1 is higher than V2+Vth101 and higher than V2+Vth102. In the case where the transistors 101 and 102 are turned off as in the operations DR5 to DR8, the potential of the node N1 is lower than V2+Vth101 and lower than V2+Vth102 (is preferably a value equal to V2).

As described above, in the circuit in FIG. 1A, the potential of the wiring 112 and the potential of the wiring 114 can be made equal to or different from each other by controlling the potential of the wiring 111 and the potential of the wiring 113.

Without limitation to the above-described signals, various other signals or voltages can be input to the wirings 111 and 113. One example will be described below.

An H-level potential of a signal input to the wiring 111 and an H-level potential of a signal input to the wiring 113 can be different from each other. When a load such as a transistor is connected to the wiring 114, the amplitude voltage of a signal output from the wiring 114 is preferably large in some cases in order to drive the load such as the transistor. In such a case, the H-level potential of the signal input to the wiring 113 can be made higher than the H-level potential of the signal input to the wiring 111; accordingly, a large load can be driven while power consumption is reduced.

A predetermined voltage (e.g., a voltage V1 or a voltage V2) can be supplied to one or both of the wirings 111 and 113. For that reason, the wiring 111 and/or the wiring 113 can have a function of a power supply line. Note that the voltage V1 is equal to the difference between a reference potential (e.g., a ground potential) and the potential V1. The voltage V2 is equal to the difference between a reference potential (e.g., a ground potential) and the potential V2.

The circuit in FIG. 1A can perform various other operations without limitation to the operations shown in the truth table in FIG. 2A (e.g., the operations DR1 to DR8). Some examples will be described below.

In the operations DR1 to DR8, one of the transistors 101 and 102 can be turned on and the other can be turned off. In that case, the gate of the transistor 101 and the gate of the transistor 102 are assumed to be connected to different wirings or different nodes.

In addition, one or both of the wirings 111 and 113 can be in a floating state. That is, it is possible to stop the supply of a signal, voltage, or the like to one or both of the wirings 111 and 113. For example, in the operations DR5 to DR8, one or both of the wirings 111 and 113 can be in a floating state. Since the transistors 101 and 102 are turned off in the operations DR5 to DR8, the potentials of the wirings 111 and 113 do not adversely affect the operations. For that reason, it is preferable that one or both of the wirings 111 and 113 be in a floating state in order to reduce power consumption.

As another example, the potential V2 can be supplied to one or both of the wirings 112 and 114 from a wiring different from the wiring 111 or the wiring 113. In particular, the potential V2 is preferably supplied to the wiring 112 in at least one of the operations DR3 to DR8. In order to realize such operation, a wiring to which the potential V2 is supplied and the wiring 112 are preferably connected via a switch (e.g., a transistor). Furthermore, the potential V2 is preferably supplied to the wiring 114 in at least one of the operations DR2 and DR4 to DR8. In order to realize such operation, a wiring to which the potential V2 is supplied and the wiring 114 are preferably connected via a switch (e.g., a transistor). Since the wirings 112 and 114 are in a floating state in the operations DR5 to DR8, the potentials of the wirings 112 and 114 depend on the previous operation. For that reason, by supplying the potential V2 to the wirings 112 and 114, the potentials of the wirings 112 and 114 can be set to the potential V2 regardless of the previous operation. Further, noise is easily generated in the wirings 112 and 114 because the wirings 112 and 114 are in a floating state. Noise can be reduced by supplying the potential V2 to the wirings 112 and 114.

Figure 4A:
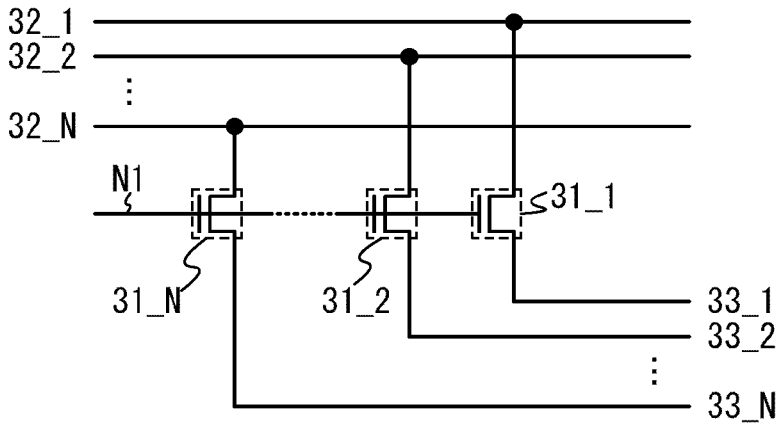
FIGS. 4A to 4C each illustrate a configuration of a circuit according to one embodiment.
Figure 4B:
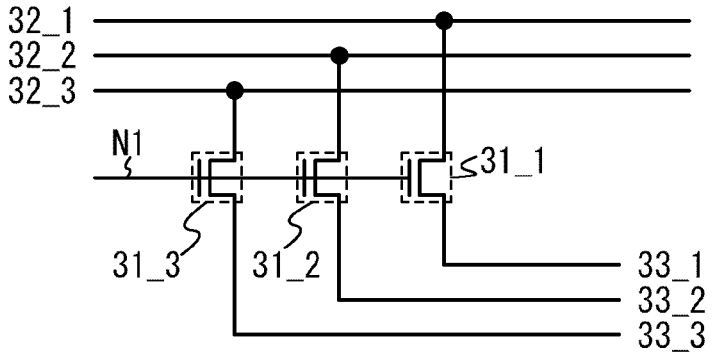
Figure 4C:
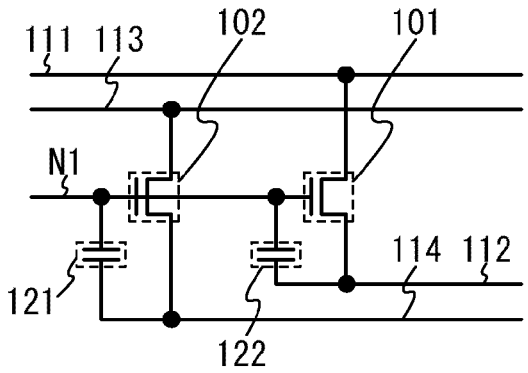

Note that FIG. 1A illustrates an example of the circuit including two transistors; a circuit that realizes a similar function can have various other configurations without limitation to this example. FIGS. 4A to 4C illustrate some examples.

FIG. 4A illustrates an example of a circuit including N transistors 31 (referred to as transistors 31_1 to 31_N, where N is a natural number). First terminals of the N transistors 31 are connected to respective N wirings 32 (referred to as wirings 32_1 to 32_N). Second terminals of the N transistors 31 are connected to respective N wirings 33 (referred to as wirings 33_1 to 33_N). Gates of the N transistors 31 are connected to each other. For example, a first terminal of the transistor 31_i (i is any one of 1 to N) is connected to the wiring 32_i. A second terminal of the transistor 31_i is connected to the wiring 33_i. The transistor 31 has a function similar to that of the transistor 101 or the transistor 102. The wiring 32 has a function similar to that of the wiring 111 or the wiring 113. The wiring 33 has a function similar to that of the wiring 112 or the wiring 114. Note that the circuit size is increased when the number of the transistors 31 is too large. Therefore, N is preferably 2 to 5, more preferably 2 or 3. FIG. 4B illustrates an example of a circuit including three transistors.

A capacitor can be connected between the gate and the second terminal of one or both of the transistors 101 and 102. FIG. 4C illustrates an example where a capacitor 121 is connected between the gate and the second terminal of the transistor 101, and a capacitor 122 is connected between the gate and the second terminal of the transistor 102. In the circuit illustrated in FIG. 4C, operation for raising the potential of the node N1 (bootstrap operation) is sometimes performed using parasitic capacitance between the gate and the second terminal of the transistor 101 or parasitic capacitance between the gate and the second terminal of the transistor 102. In that case, the amount of rise in potential of the node N1 can be increased when a capacitor is connected between the gate and the second terminal of one or both of the transistors 101 and 102.

Examples of the size of the transistors and the width of the wirings in FIG. 1A and FIGS. 4A to 4C will be described below.

As a load of the wiring and the node is larger, the time of charging and discharging of the load is extended. That is, as a load of the wiring and the node is larger, distortion, delay, or the like of a signal is increased. For that reason, as a load connected to a transistor is larger, the W/L ratio (W:channel width and L:channel length) of the transistor is preferably higher. Thus, distortion or delay of a signal can be reduced. Therefore, when a load such as a pixel is connected to the wiring 114, the load of the wiring 114 is larger than that of the wiring 112. Thus, the channel width of the transistor 102 is preferably larger than that of the transistor 101. The channel width of the transistor 102 is preferably 2 times or more and less than 30 times, more preferably 5 to 20 times, further preferably 8 times or more and less than 15 times as large as that of the transistor 101.

Since the load of the wiring 114 is larger than that of the wiring 112 when a load such as a pixel is connected to the wiring 114, the amount of current flowing through the wiring 113 when electrical continuity is established between the wirings 113 and 114 is larger than that of current flowing through the wiring 111 when electrical continuity is established between the wirings 111 and 112. As a result, the amount of decrease in potential of the wiring 113 due to voltage drop is larger than that of the decrease in potential of the wiring 111 due to voltage drop. Therefore, the width of part of the wiring 113 is preferably larger than that of part of the wiring 111. Thus, the resistance of the wiring 113 can be reduced, so that the amount of decrease in potential of the wiring 113 due to voltage drop can be reduced.

In addition, since the load of the wiring 114 is larger than that of the wiring 112 when a load such as a pixel is connected to the wiring 114, signals are more distorted or delayed in the wiring 114 than in the wiring 112. Therefore, the width of part of the wiring 114 is preferably larger than that of part of the wiring 112. Thus, the resistance of the wiring 114 can be reduced, so that distortion or delay of signals in the wiring 114 can be reduced.

Figure 1B:
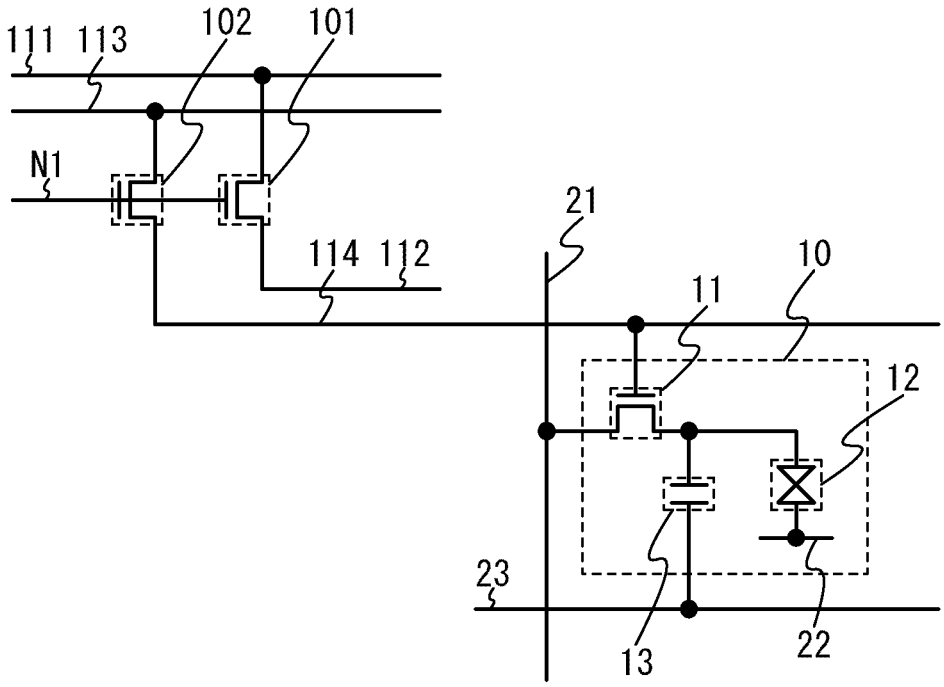

A load such as a transistor provided in a pixel of a display device is sometimes connected to the wiring 112 or the wiring 114. FIG. 1B illustrates an example of the case where a pixel including a liquid crystal element is connected to the wiring 114. A pixel 10 includes a transistor 11, a liquid crystal element 12, and a capacitor 13 (e.g., a storage capacitor). A first terminal of the transistor 11 is connected to a wiring 21 (e.g., a source signal line or a video signal line). A second terminal of the transistor 11 is connected to a first electrode of the liquid crystal element 12 (e.g., a pixel electrode). A gate of the transistor 11 is connected to the wiring 114. A first electrode of the capacitor 13 is connected to a wiring 23 (e.g., a capacitor line). A second electrode of the capacitor 13 is connected to the first electrode of the liquid crystal element 12. A second electrode of the liquid crystal element 12 (e.g., a common electrode) is connected to a wiring 22.

Note that without limitation to the pixel 10 illustrated in FIG. 1B, various other loads can be connected to the wiring 114. For example, a pixel including any of the following elements can be connected to the wiring 114: a light-emitting element (e.g., an EL element), a display element with memory properties (e.g., an electrophoretic display element), a display element whose gray level is changed by electrophoresis, a display element whose gray level is changed by electrodeposition, a display element whose gray level is changed by electrochromism, a display element whose gray level is changed by twisting ball, a display element including electronic ink, and a display element including colored particles. As another example, a protection diode or a circuit such as a demultiplexer can be connected to the wiring 114.

Figure 5A:
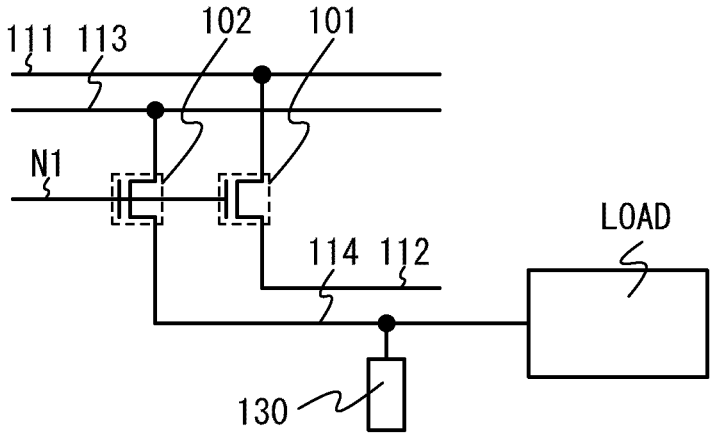
FIGS. 5A to 5C each illustrate a configuration of a circuit according to one embodiment.

When a load such as a transistor is connected to the wiring 114, the wiring 114 is longer than the wiring 112 or the area of the wiring 114 is larger than that of the wiring 112 in some cases. For that reason, when a load is connected to the wiring 114, a protection circuit 130 is preferably connected to the wiring 114 as illustrated in FIG. 5A. Thus, an element included in the load, such as the transistor, can be prevented from being destroyed by electrostatic discharge.

Figure 5B:
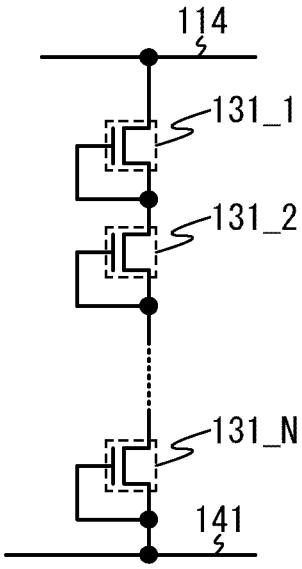

FIG. 5B illustrates an example of the protection circuit 130. The protection circuit 130 in FIG. 5B includes N transistors 131 (referred to as transistors 131_1 to 131_N, where N is a natural number). A first terminal of the transistor 131_i (i is any one of 2 to N−1) is connected to a second terminal of the transistor 131_i−1. A second terminal of the transistor 131_i is connected to a first terminal of the transistor 131_i+1. A gate of the transistor 131_i is connected to the second terminal of the transistor 131_i. Note that a first terminal of the transistor 131_1 is connected to the wiring 114, which is different from the transistor 131_i. A second terminal of the transistor 131_N is connected to a wiring 141, which is different from the transistor 131_i. A predetermined voltage (e.g., the voltage V2) is supplied to the wiring 141.

Figure 5C:
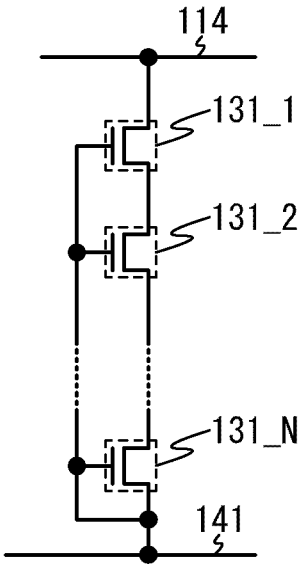

In the protection circuit 130 in FIG. 5B, gates of the transistors 131_1 to 131_N can be connected to the wiring 141 as illustrated in FIG. 5C.

In the case where the voltage V1 is supplied to the wiring 141, in the protection circuit 130 illustrated in FIG. 5B, the gate of the transistor 131_i can be connected to the first terminal of the transistor 131_i, a gate of the transistor 131_1 can be connected to the wiring 114, and a gate of the transistor 131_N can be connected to a first terminal of the transistor 131_N.

In the case where the voltage V1 is supplied to the wiring 141, in the protection circuit 130 illustrated in FIG. 5C, gates of the transistors 131_1 to 131_N can be connected to the wiring 114.

The configurations of the circuits illustrated in FIGS. 1A and 1B, FIGS. 2A and 2B, FIGS. 3A to 3H, FIGS. 4A to 4C, and FIGS. 5A to 5C can be used as part of or the entire configuration of an integrated circuit formed using a semiconductor substrate such as a silicon wafer, an SOI (silicon on insulator) substrate, or the like. As another embodiment, the above-described circuit configuration can be realized using a transistor in which a channel region is formed in a semiconductor film of polycrystalline silicon, amorphous silicon, or the like, provided over an insulating substrate of glass or the like. An oxide semiconductor can also be used as a material for the semiconductor film.

(Signal Processing Circuit According to One Embodiment)

Figure 6:
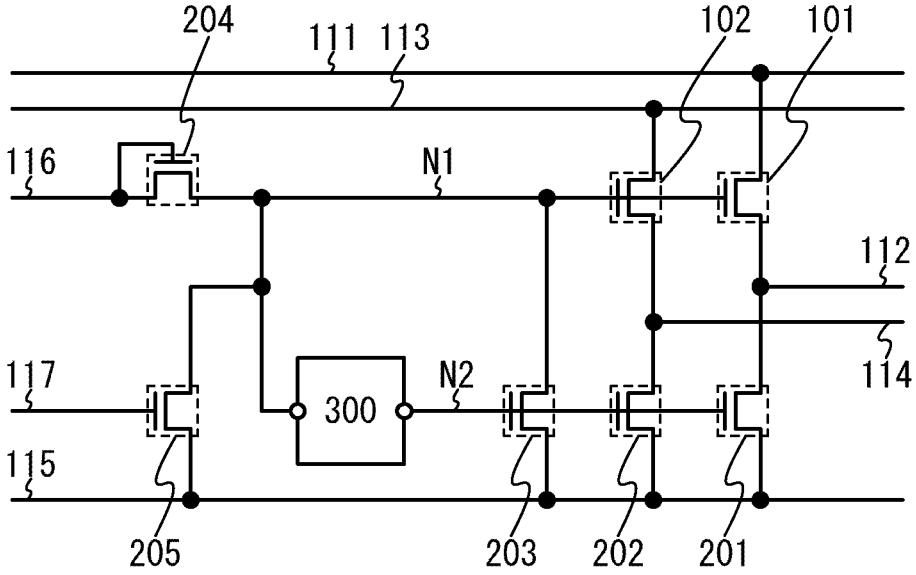
FIG. 6 illustrates a configuration of a signal processing circuit according to one embodiment.

FIG. 6 illustrates an example of a circuit having the configuration illustrated in FIG. 1A. FIG. 6 illustrates an example of a signal processing circuit that can be used in a gate signal line driver circuit, a source signal line (video signal line) driver circuit, and the like in a display device.

The signal processing circuit in FIG. 6 includes a transistor 201, a transistor 202, a transistor 203, a transistor 204, a transistor 205, and a circuit 300 in addition to the transistor 101 and the transistor 102.

The transistors 201 to 205 preferably have the same polarity as the transistors 101 and 102 (e.g., they are preferably n-channel transistors) because the transistors can be formed using a silicon semiconductor, an oxide semiconductor, or the like.

The circuit 300 is constituted by at least one transistor. One or more transistors included in the circuit 300 preferably have the same polarity as the transistors 101 and 102 (e.g., the transistor or transistors is/are preferably n-channel transistors). This is because the transistors can be formed using a silicon semiconductor, an oxide semiconductor, or the like as described above.

The connection relation in the signal processing circuit in FIG. 6 is as follows. A first terminal of the transistor 201 is connected to a wiring 115. A second terminal of the transistor 201 is connected to the wiring 112. A first terminal of the transistor 202 is connected to the wiring 115. A second terminal of the transistor 202 is connected to the wiring 114. A gate of the transistor 202 is connected to a gate of the transistor 201. A first terminal of the transistor 203 is connected to the wiring 115. A second terminal of the transistor 203 is connected to the node N1. A gate of the transistor 203 is connected to the gate of the transistor 201. A first terminal of the transistor 204 is connected to a wiring 116. A second terminal of the transistor 204 is connected to the node N1. A gate of the transistor 204 is connected to the wiring 116. A first terminal of the transistor 205 is connected to the wiring 115. A second terminal of the transistor 205 is connected to the node N1. A gate of the transistor 205 is connected to a wiring 117. The circuit 300 can be connected to a variety of wirings (e.g., one or more of the wirings 111 to 117) depending on the configuration. In the example of FIG. 6, the circuit 300 is connected to the node N1 and the gate of the transistor 201.

Note that a portion where the gate of the transistor 201, the gate of the transistor 202, the gate of the transistor 203, and the circuit 300 are connected is denoted by a node N2.

The wirings 115, 116, and 117 will be described below.

A predetermined voltage (e.g., the voltage V2) is supplied to the wiring 115. That is, the wiring 115 is a wiring for transmitting a voltage (e.g., the voltage V2) to the signal processing circuit in FIG. 6 from an external circuit such as a power supply circuit. Thus, the wiring 115 has a function of a power supply line, a negative power supply line, a ground line, or the like.

A signal (e.g., a start signal) is input to the wiring 116. That is, the wiring 116 is a wiring for transmitting a signal (e.g., a start signal) to the signal processing circuit in FIG. 6 from an external circuit such as a timing controller or another circuit. Thus, the wiring 116 has a function of a signal line or a start signal line. An H-level potential of a signal input to the wiring 116 is approximately equal to the potential V1, and an L-level potential of a signal input to the wiring 116 is approximately equal to the potential V2.

A signal (e.g., a reset signal) is input to the wiring 117. That is, the wiring 117 is a wiring for transmitting a signal (e.g., a reset signal) to the signal processing circuit in FIG. 6 from an external circuit such as a timing controller or another circuit. Thus, the wiring 117 has a function of a signal line or a reset signal line. An H-level potential of a signal input to the wiring 117 is approximately equal to the potential V1, and an L-level potential of a signal input to the wiring 117 is approximately equal to the potential V2.

Note that a voltage can be supplied to the wiring 115 from an external circuit such as a power supply circuit. Moreover, a signal can be input to the wirings 116 and 117 from an external circuit such as a timing controller, or a circuit formed over a substrate where the signal processing circuit is formed.

Examples of functions of the transistors 201 to 205 will be described below.

The transistor 201 has a function of a switch that controls electrical continuity between the wiring 115 and the wiring 112 and/or a function of keeping the potential of the wiring 112 constant (e.g., at the potential of the wiring 115).

The transistor 202 has a function of a switch that controls electrical continuity between the wiring 115 and the wiring 114 and/or a function of keeping the potential of the wiring 114 constant (e.g., at the potential of the wiring 115).

The transistor 203 has a function of a switch that controls electrical continuity between the wiring 115 and the node N1 and/or a function of keeping the potential of the node N1 constant (e.g., at the potential of the wiring 115).

The transistor 204 has a function of a switch that controls electrical continuity between the wiring 116 and the node N1, a function of a diode having an input terminal connected to the wiring 116 and an output terminal connected to the node N1, a function of controlling timing of raising the potential of the node N1, a function of controlling timing of setting the node N1 floating, and/or a function of controlling timing of set operation in the signal processing circuit.

The transistor 205 has a function of a switch that controls electrical continuity between the wiring 115 and the node N1, a function of a switch that controls timing of lowering the potential of the node N1, and/or a function of controlling timing of reset operation in the signal processing circuit.

An example of a function of the circuit 300 will be described below.

The circuit 300 has a function of a control circuit that controls the potential of the node N2, a function of controlling conduction states of the transistors 201 to 203, and/or a function of an inverter circuit that inverts the potential of the node N1 and outputs the resulting potential to the node N2.

As examples of operation of the signal processing circuit in FIG. 6, the following two cases will be described below: the case where both a signal input to the wiring 111 and a signal input to the wiring 113 are in an active state, and the case where a signal input to the wiring 111 is in an active state and a signal input to the wiring 113 is in a non-active state. Note that here, a clock signal is input to the wiring 111; a clock signal whose phase is the same as that of the clock signal input to the wiring 111 is input to the wiring 112 when the wiring 112 is in an active state; and the voltage V2 or an L-level signal is input to the wiring 112 when the wiring 112 is in a non-active state.

Figure 7A:
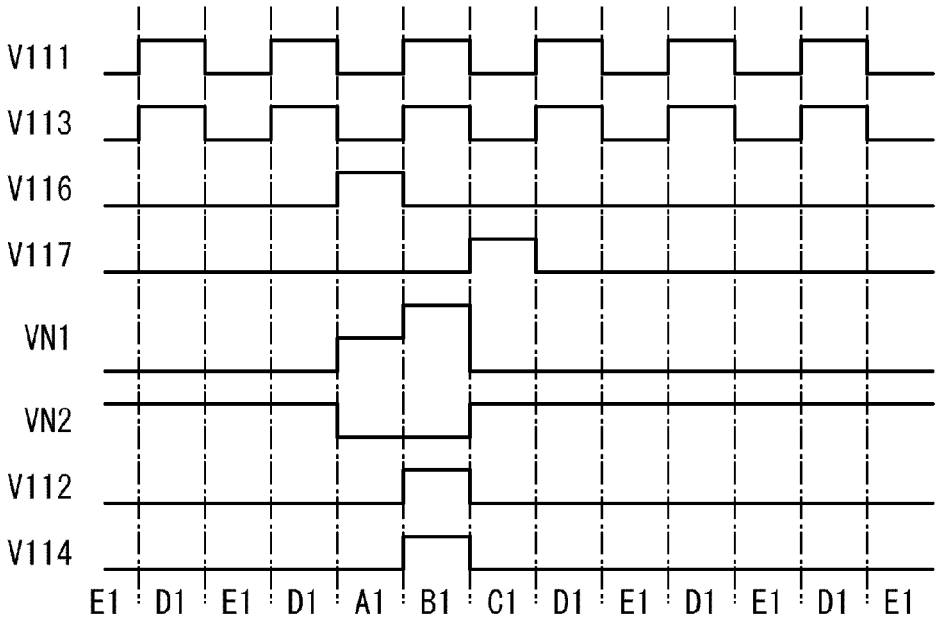
FIGS. 7A and 7B each illustrate an example of a timing chart for explaining operation of the signal processing circuit in FIG. 6.

First, an example of the operation when both the signal input to the wiring 111 and the signal input to the wiring 113 are in an active state will be described with reference to a timing chart illustrated in FIG. 7A. The timing chart in FIG. 7A shows periods A1 to E1 (each period is also referred to as one gate selection period).

In the period A1, the potential of the wiring 111 (shown as V111) is equal to the potential V2. The potential of the wiring 113 (shown as V113) is equal to the potential V2. The potential of the wiring 116 (shown as V116) is equal to the potential V1. The potential of the wiring 117 (shown as V117) is equal to the potential V2. Thus, the transistor 204 is turned on, and electrical continuity is established between the wiring 116 and the node N1. The transistor 205 is turned off, and electrical continuity is not established between the wiring 115 and the node N1. As a result, the potential of the wiring 116 is supplied to the node N1, and the potential of the node N1 (shown as VN1) starts to rise.

After that, the potential of the node N1 rises to a value higher than V2+Vth101 (Vth101 is the threshold voltage of the transistor 101) and higher than V2+Vth102 (Vth102 is the threshold voltage of the transistor 102). At this time, the circuit 300 supplies a potential (e.g., the potential V2) to the node N2, and the potential of the node N2 (shown as VN2) becomes V2. Note that the potential of the node N2 is acceptable as long as it is less than V2+Vth201 (Vth201 is the threshold voltage of the transistor 201), less than V2+Vth202 (Vth202 is the threshold voltage of the transistor 202), and less than V2+Vth203 (Vth203 is the threshold voltage of the transistor 203). Thus, the transistor 101 is turned on, and electrical continuity is established between the wiring 111 and the wiring 112. The transistor 102 is turned on, and electrical continuity is established between the wiring 113 and the wiring 114. The transistor 201 is turned off, and electrical continuity is not established between the wiring 115 and the wiring 112. The transistor 202 is turned off, and electrical continuity is not established between the wiring 115 and the wiring 114. The transistor 203 is turned off, and electrical continuity is not established between the wiring 115 and the node N1. As a result, the potential of the wiring 111 is supplied to the wiring 112, and the potential of the wiring 112 (shown as V112) is equal to the potential V2. The potential of the wiring 113 is supplied to the wiring 114, and the potential of the wiring 114 (shown as V114) is equal to the potential V2.

Figure 8A:
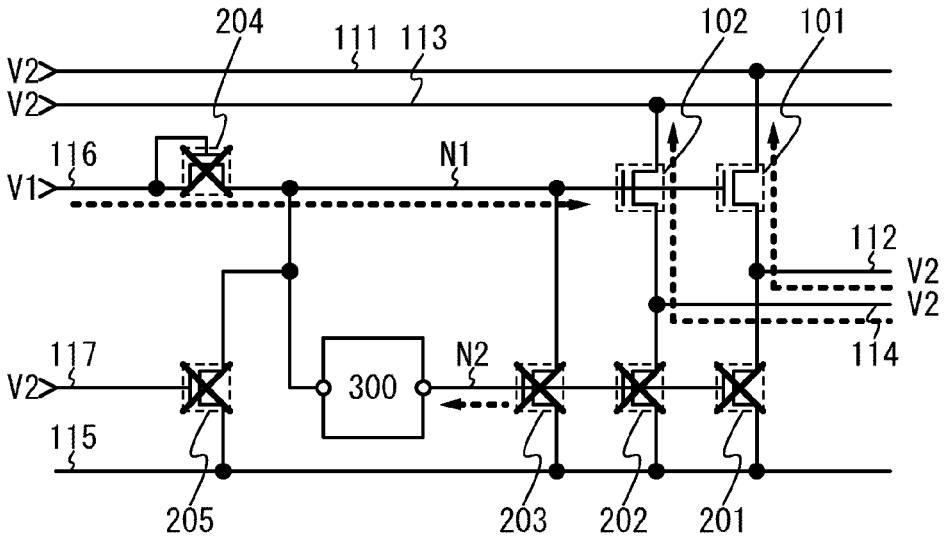
FIGS. 8A and 8B each illustrate an example of a schematic diagram for explaining operation of the signal processing circuit in FIG. 6.

After that, the potential of the node N1 reaches V1−Vth204 (Vth204 is the threshold voltage of the transistor 204). Thus, the transistor 204 is turned off, and electrical continuity between the wiring 116 and the node N1 is broken. As a result, the node N1 enters a floating state, and the potential of the node N1 is kept at V1−Vth204 (see FIG. 8A). In other words, in the period A1, the circuit including the transistors 101 and 102 performs the operation DR4 in FIG. 2A.

In the period B1, the potential of the wiring 111 is equal to the potential V1. The potential of the wiring 113 is equal to the potential V1. The potential of the wiring 116 is equal to the potential V2. The potential of the wiring 117 remains equal to the potential V2. The node N1 remains in a floating state, and the potential of the node N1 remains at V1−Vth204. The potential of the node N2 remains at V2.

Thus, the transistor 201 remains off, and electrical continuity between the wiring 115 and the wiring 112 remains unestablished. The transistor 202 remains off, and electrical continuity between the wiring 115 and the wiring 114 remains unestablished. The transistor 203 remains off, and electrical continuity between the wiring 115 and the node N1 remains unestablished. The transistor 204 remains off, and electrical continuity between the wiring 116 and the node N1 remains unestablished. The transistor 205 remains off, and electrical continuity between the wiring 115 and the node N1 remains unestablished. The transistor 101 remains on, and electrical continuity between the wiring 111 and the wiring 112 remains established. The transistor 102 remains on, and electrical continuity between the wiring 113 and the wiring 114 remains established.

As a result, the potential of the wiring 111 is supplied to the wiring 112, and the potential of the wiring 112 starts to rise. The potential of the wiring 113 is supplied to the wiring 114, and the potential of the wiring 114 starts to rise. At this time, the node N1 remains in a floating state. For that reason, the potential of the node N1 is raised by parasitic capacitance between the gate and the second terminal of the transistor 101 and parasitic capacitance between the gate and the second terminal of the transistor 102.

Figure 8B:
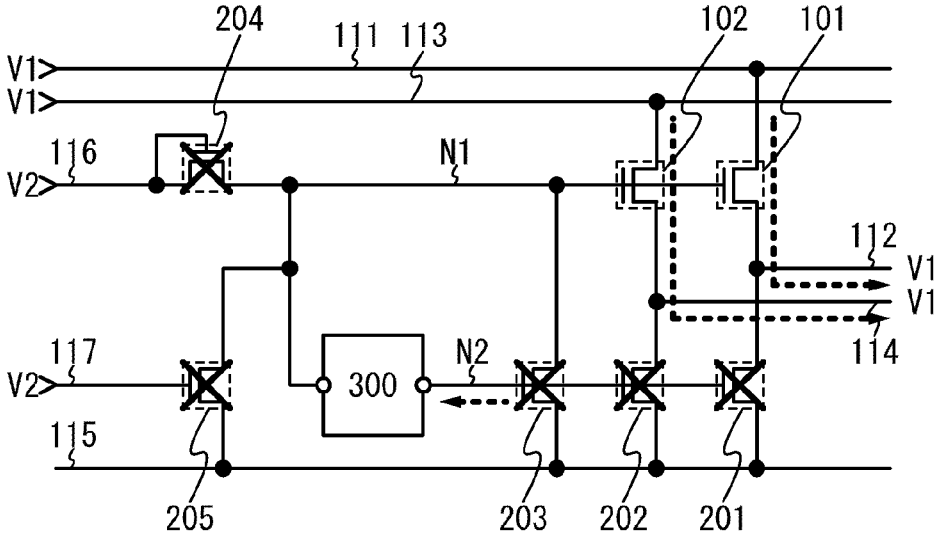

In the end, the potential of the node N1 reaches a value higher than V1+Vth101 and higher than V1+Vth102. Accordingly, the potential of the wiring 112 can rise to a value equal to the potential V1. The potential of the wiring 114 can rise to a value equal to the potential V1 (see FIG. 8B). In other words, in the period B1, the circuit including the transistors 101 and 102 performs the operation DR1 in FIG. 2A.

In the period C1, the potential of the wiring 111 is equal to the potential V2. The potential of the wiring 113 is equal to the potential V2. The potential of the wiring 116 remains equal to the potential V2. The potential of the wiring 117 is equal to the potential V1. Thus, the transistor 204 remains off, and electrical continuity between the wiring 116 and the node N1 remains unestablished. The transistor 205 is turned on, and electrical continuity is established between the wiring 115 and the node N1. As a result, the potential of the wiring 115 is supplied to the node N1, and the potential of the node N1 is equal to the potential V2.

Thus, the transistor 101 is turned off, and electrical continuity between the wiring 111 and the wiring 112 is broken. The transistor 102 is turned off, and electrical continuity between the wiring 113 and the wiring 114 is broken. At this time, the circuit 300 supplies a potential (e.g., the potential V1) to the node N2, and the potential of the node N2 becomes a value that is higher than V2+Vth201, higher than V2+Vth202, and higher than V2+Vth203.

Figure 9A:
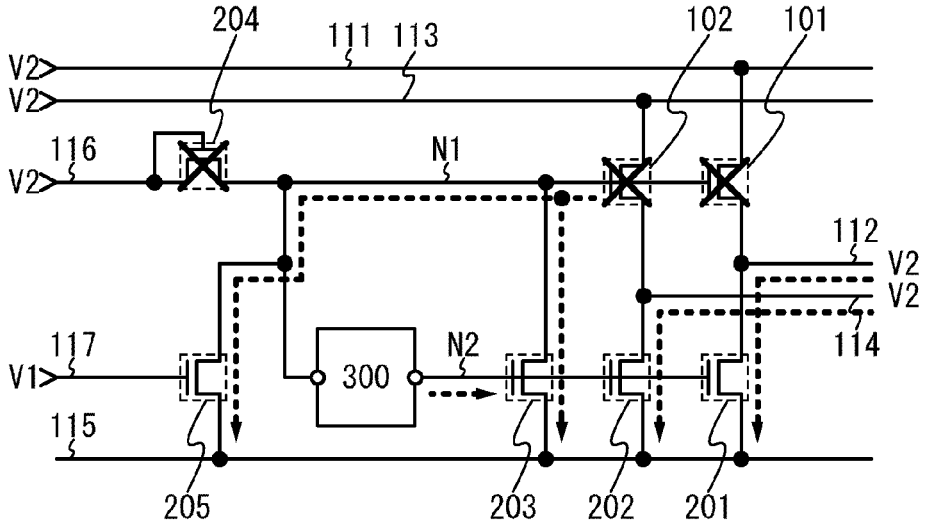
FIGS. 9A and 9B each illustrate an example of a schematic diagram for explaining operation of the signal processing circuit in FIG. 6.

As a result, the transistor 201 is turned on, and electrical continuity is established between the wiring 115 and the wiring 112. The transistor 202 is turned on, and electrical continuity is established between the wiring 115 and the wiring 114. The transistor 203 is turned on, and electrical continuity is established between the wiring 115 and the node N1. Thus, the potential of the wiring 115 is supplied to the wiring 112, and the potential of the wiring 112 is equal to the potential V2. The potential of the wiring 115 is supplied to the wiring 114, and the potential of the wiring 114 is equal to the potential V2 (see FIG. 9A). In other words, in the period C1, the circuit including the transistors 101 and 102 performs the operation DR8 in FIG. 2A.

In the period D1 and the period E1, the potential of the wiring 111 is equal to one of the potential V1 and the potential V2 (the potential V1 in the period D1 and the potential V2 in the period E1). The potential of the wiring 113 is equal to one of the potential V1 and the potential V2 (the potential V1 in the period D1 and the potential V2 in the period E1). The potential of the wiring 116 remains equal to the potential V2. The potential of the wiring 117 is equal to the potential V2. At this time, the circuit 300 keeps supplying a potential (e.g., the potential V1) to the node N2, and the potential of the node N2 remains at the value that is higher than V2+Vth201, higher than V2+Vth202, and higher than V2+Vth203.

Figure 9B:
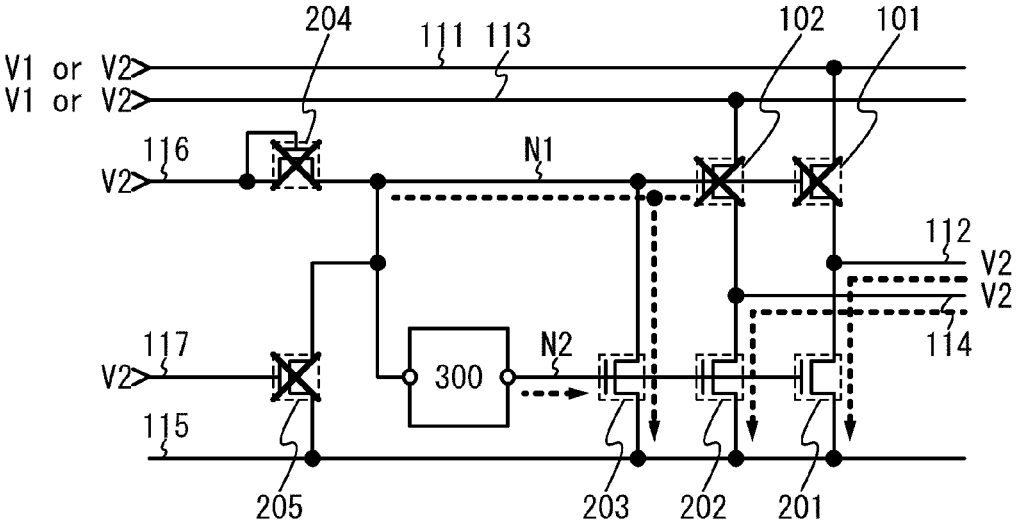

Thus, the transistor 204 remains off, and electrical continuity between the wiring 116 and the node N1 remains unestablished. The transistor 205 is turned off. The transistor 203 remains on, and electrical continuity between the wiring 115 and the node N1 remains established. Accordingly, the potential of the wiring 115 is kept supplied to the node N1, and the potential of the node N1 remains equal to the potential V2. Thus, the transistor 101 remains off, and electrical continuity between the wiring 111 and the wiring 112 remains unestablished. The transistor 102 remains off, and electrical continuity between the wiring 113 and the wiring 114 remains unestablished. The transistor 201 remains on, and electrical continuity between the wiring 115 and the wiring 112 remains established. The transistor 202 remains on, and electrical continuity between the wiring 115 and the wiring 114 remains established. Accordingly, the potential of the wiring 115 is kept supplied to the wiring 112, and the potential of the wiring 112 remains equal to the potential V2. The potential of the wiring 115 is kept supplied to the wiring 114, and the potential of the wiring 114 remains equal to the potential V2 (see FIG. 9B). In other words, in the period D1, the circuit including the transistors 101 and 102 performs the operation DR5 in FIG. 2A. Moreover, in the period E1, the circuit including the transistors 101 and 102 performs the operation DR8 in FIG. 2A.

Figure 7B:
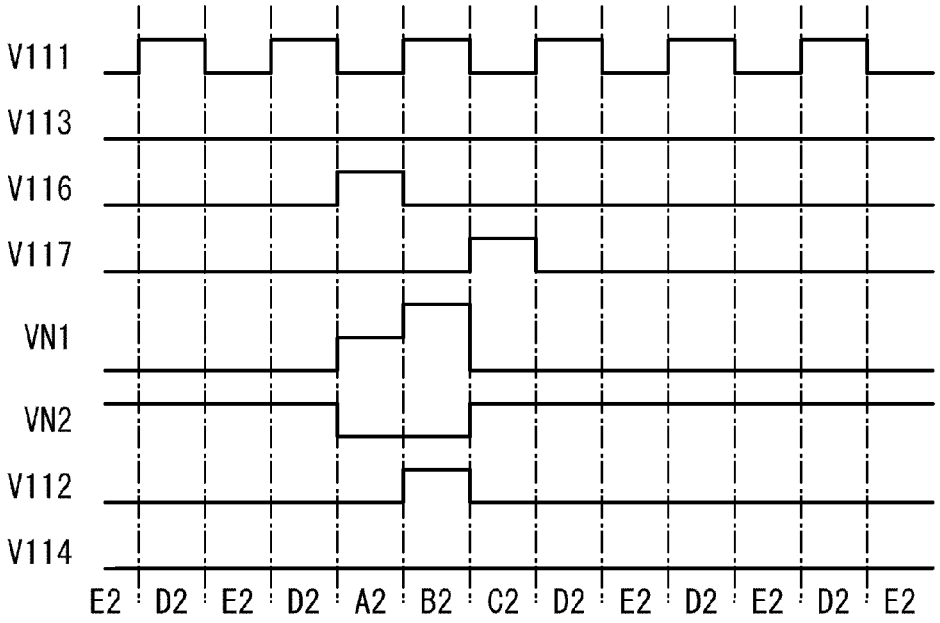

Next, an example of the operation when the signal input to the wiring 111 is in an active state and the signal input to the wiring 113 is in a non-active state will be described with reference to a timing chart illustrated in FIG. 7B. The timing chart in FIG. 7B shows periods A2 to E2 (each period is also referred to as one gate selection period).

In the period A2, the signal processing circuit in FIG. 6 performs operation as in the period A1. Therefore, the description of the operation in the period A2 is omitted. In other words, in the period A2, the circuit including the transistors 101 and 102 performs the operation DR4 in FIG. 2A.

Figure 10A:
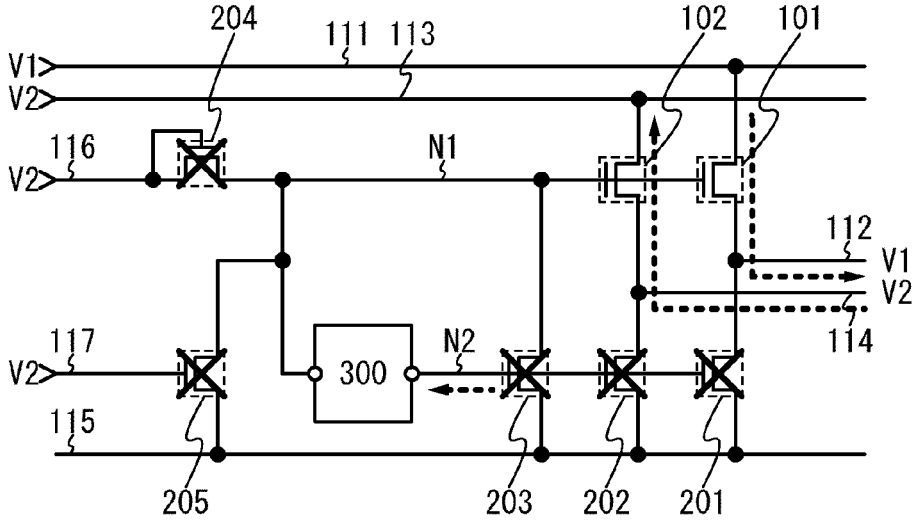
FIGS. 10A and 10B each illustrate an example of a schematic diagram for explaining operation of the signal processing circuit in FIG. 6.

The period B2 differs from the period B1 in that the potential of the wiring 113 remains equal to the potential V2. For that reason, in the period B2, the potential of the wiring 114 remains equal to the potential V2 (see FIG. 10A). In other words, in the period B2, the circuit including the transistors 101 and 102 performs the operation DR2 in FIG. 2A.

In the period C2, the signal processing circuit in FIG. 6 performs operation as in the period C1. Therefore, the description of the operation in the period C2 is omitted. In other words, in the period C2, the circuit including the transistors 101 and 102 performs the operation DR8 in FIG. 2A.

Figure 10B:
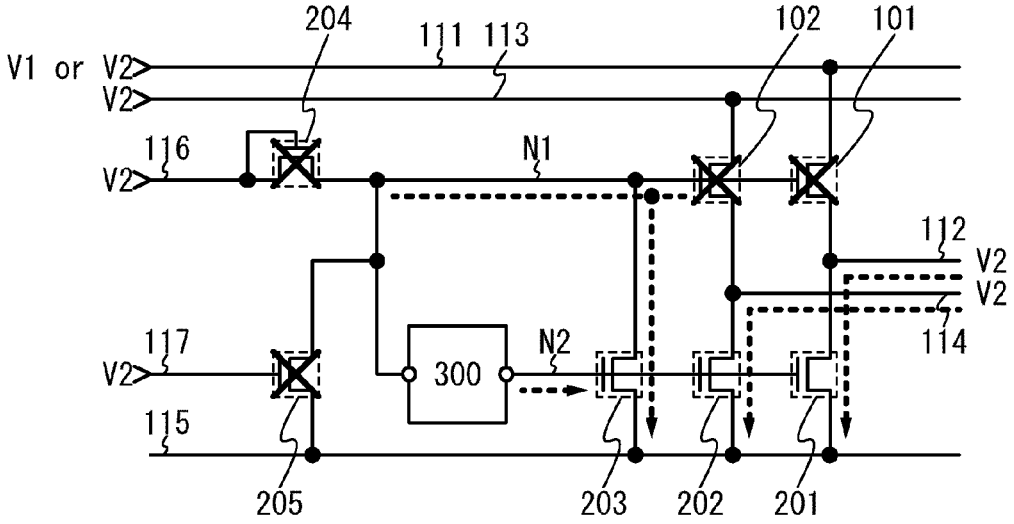

The period D2 and the period E2 differ from the period D1 and the period E1 in that the potential of the wiring 113 remains equal to the potential V2 (see FIG. 10B). In other words, in the period D2, the circuit including the transistors 101 and 102 performs the operation DR6 in FIG. 2A. In the period E2, the circuit including the transistors 101 and 102 performs the operation DR8 in FIG. 2A.

As described above, by controlling whether a signal input to the wiring 113 is in an active state or a non-active state, the signal processing circuit illustrated in FIG. 6 can control whether both the potentials of the wirings 112 and 114 are equal to the potential V1 or whether one of the potentials of the wirings 112 and 114 is equal to the potential V1 and the other is equal to the potential V2.

Without limitation to the above-described signals or voltages, various other signals or voltages can be input to the wirings 115 to 117. One example will be described below.

A signal (e.g., an inverted signal of a signal input to the wiring 111) can be input to the wiring 115. That is, the wiring 115 can be a wiring for transmitting an inverted signal of a signal input to the wiring 111, for example, to the signal processing circuit in FIG. 6. Thus, the wiring 115 can have a function of a signal line, a clock signal line, or an inverted clock signal line. When a signal is input to the wiring 115, a reverse bias can be applied to a transistor connected to the wiring 115 (e.g., the transistor 201, the transistor 202, or the transistor 203); thus, deterioration of the transistor can be suppressed.

Note that in the case where a signal is input to the wiring 115, a signal can be input from an external circuit such as a timing controller, or a circuit formed over a substrate where the signal processing circuit is formed.

For the signal processing circuit in FIG. 6, various other timing charts can be used without limitation to the timing charts illustrated in FIGS. 7A and 7B. Some examples will be described below.

Figure 11A:
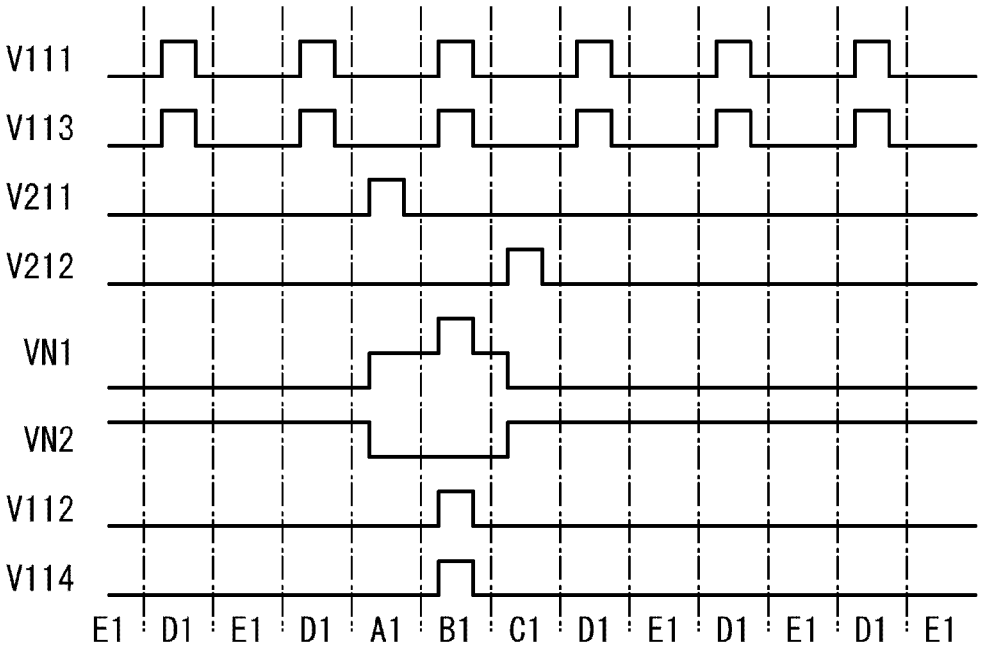
FIGS. 11A and 11B each illustrate an example of a timing chart for explaining operation of the signal processing circuit in FIG. 6.

In the timing chart in FIG. 7A, both the signal input to the wiring 111 and the signal input to the wiring 113 can be unbalanced signals. Similarly, in the timing chart in FIG. 7B, the signal input to the wiring 111 can be an unbalanced signal. A balanced signal means that the time during which the signal is at H level and the time during which the signal is at L level are approximately equal in length. An unbalanced signal is a signal that is not a balanced signal. FIG. 11A is a timing chart in the case where both the signal input to the wiring 111 and the signal input to the wiring 113 are unbalanced in the timing chart in FIG. 7A. FIG. 11A illustrates an example where the time during which the signals input to the wirings 111 and 113 are at H level is shorter than the time during which they are at L level.

Figure 11B:
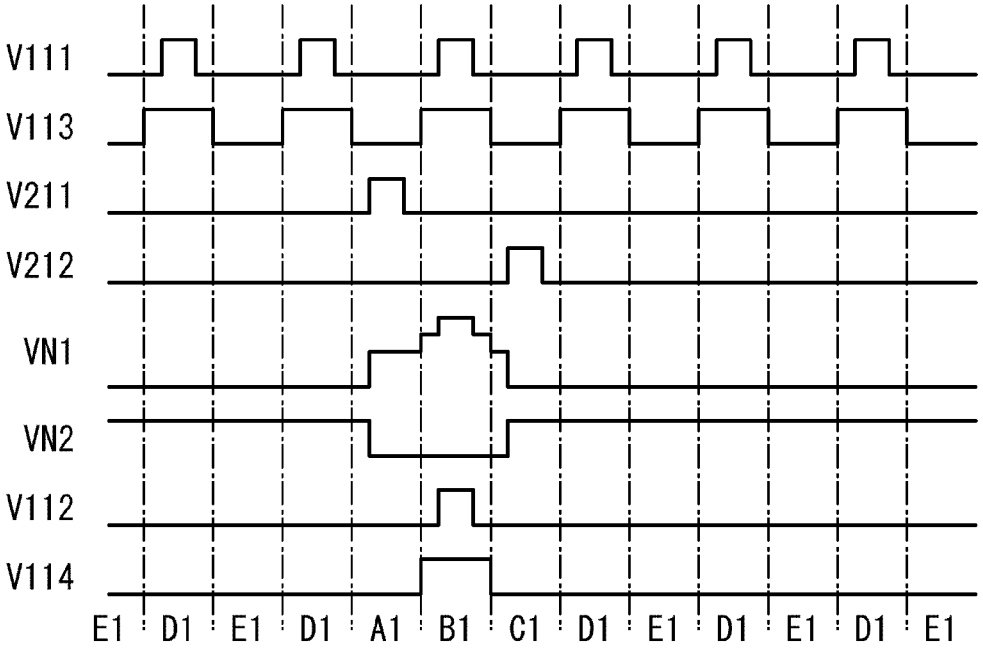

In the timing chart in FIG. 7A, the signal input to the wiring 111 can be an unbalanced signal. Similarly, in the timing chart in FIG. 7B, the signal input to the wiring 111 can be an unbalanced signal. FIG. 11B is a timing chart in the case where the signal input to the wiring 111 is unbalanced in the timing chart in FIG. 7A.

Figure 12A:
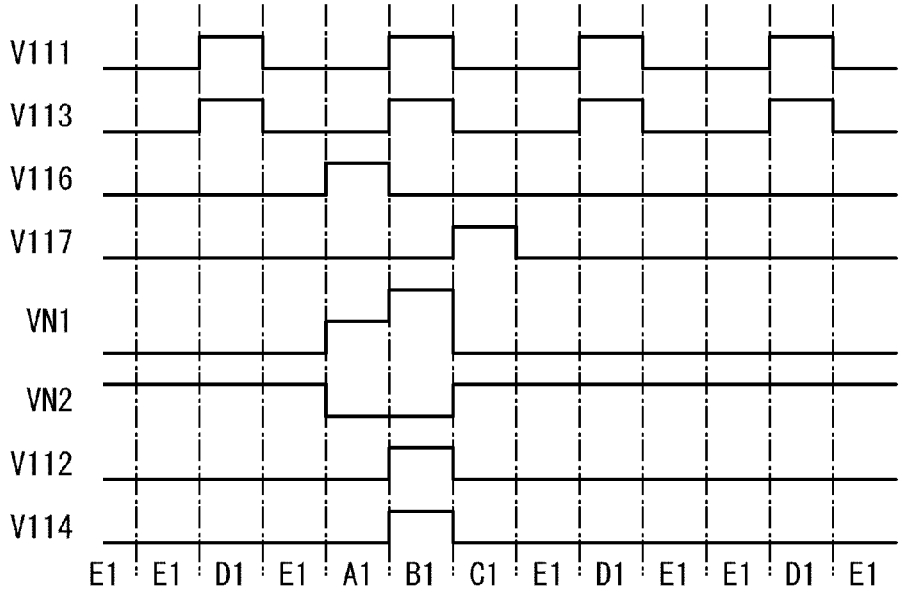
FIGS. 12A and 12B each illustrate an example of a timing chart for explaining operation of the signal processing circuit in FIG. 6.

In the timing chart in each of FIGS. 7A and 7B and FIGS. 11A and 11B, the signal input to the wiring 111 and/or the signal input to the wiring 113 can be a multi-phase clock signal. Note that it is preferable that the signal input to the wiring 111 and/or the signal input to the wiring 113 be a three-phase, four-phase, six-phase, or eight-phase clock signal because power consumption can be reduced and the increase in the number of signals can be suppressed. FIG. 12A illustrates an example in which the signals input to the wirings 111 and 113 are three-phase clock signals in the timing chart in FIG. 7A.

Figure 12B:
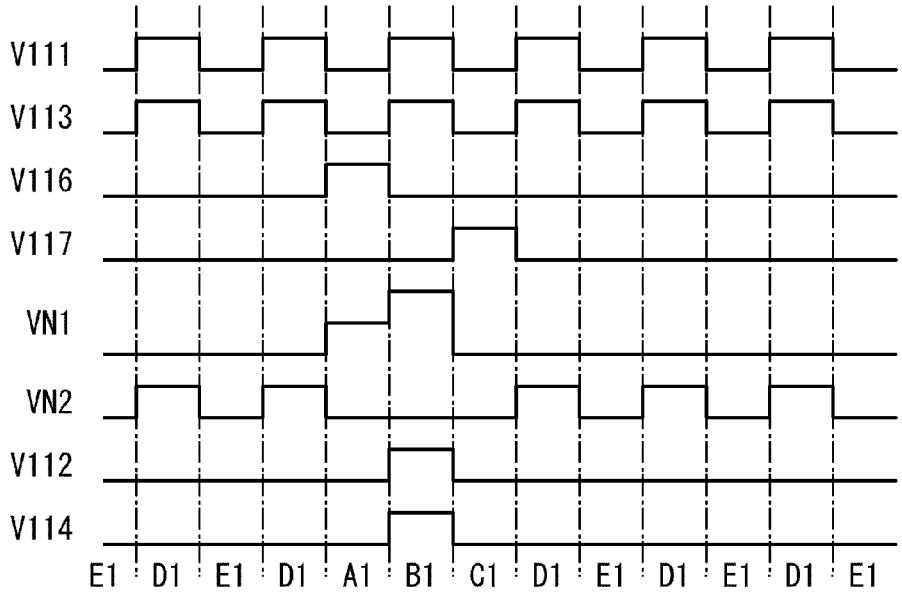

In the timing chart in each of FIGS. 7A and 7B, FIGS. 11A and 11B, and FIG. 12A, the potential of the node N2 in the period E1 can be less than V2+Vth201, V2+Vth202, and V2+Vth203 and can preferably be V2. Thus, the time during which the transistors 201 to 203 are on can be reduced, so that deterioration of the transistors 201 to 203 (e.g., shift of the threshold voltage or decrease in mobility) can be reduced. FIG. 12B is a timing chart in the case where the potential of the node N2 in the period E1 is V2 in the timing chart in FIG. 7A.

A signal processing circuit that can perform the above-described operations is not limited to the circuit in FIG. 6 and can have various other configurations. Some examples will be described below.

Figure 13A:
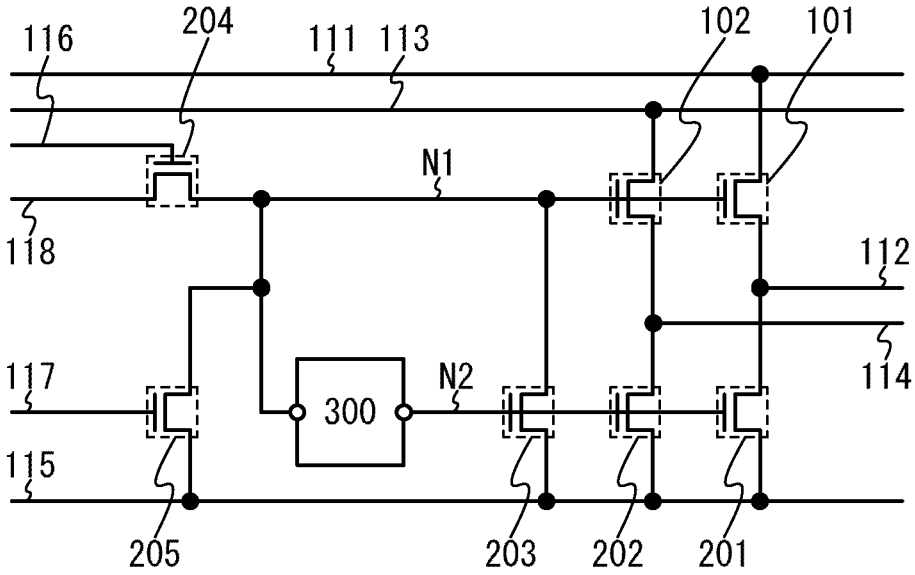
FIGS. 13A and 13B each illustrate a configuration of a signal processing circuit according to one embodiment.

In the signal processing circuit in FIG. 6, the first terminal of the transistor 204 can be connected to a wiring 118. Moreover, a transistor having a first terminal connected to the wiring 118, a second terminal connected to the node N1, and a gate connected to the wiring 116 can be additionally provided in the signal processing circuit in FIG. 6. The wiring 118 is a wiring to which a predetermined voltage (e.g., the voltage V1) is supplied, and has a function of a power supply line or a positive power supply line. Note that a signal that is at H level at least in the periods A1 and A2 (e.g., an inverted signal of the signal input to the wiring 111) can be input to the wiring 118. FIG. 13A illustrates a signal processing circuit in which the first terminal of the transistor 204 in FIG. 6 is connected to the wiring 118.

Figure 13B:
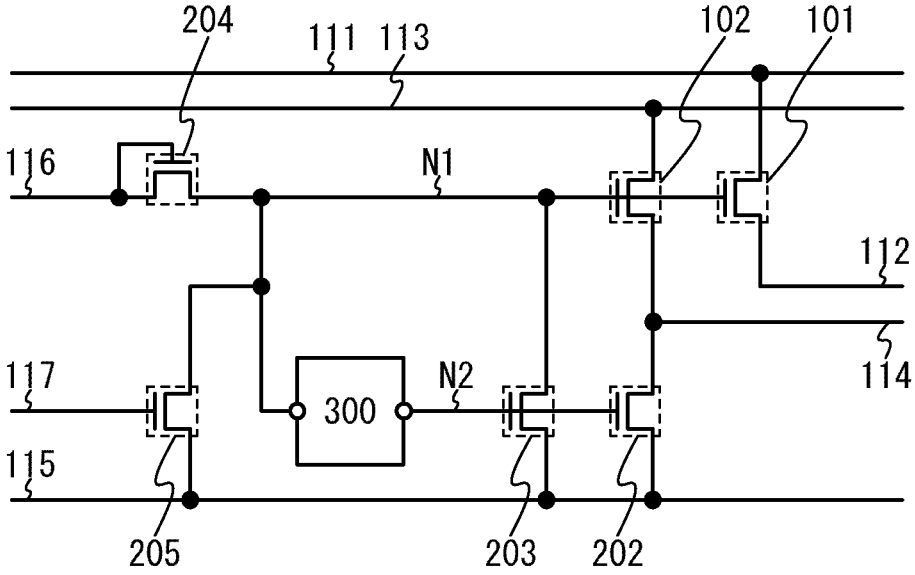

In the signal processing circuits illustrated in FIG. 6 and FIG. 13A, one of the transistors 201 and 202 can be omitted. Thus, the number of transistors can be reduced, so that the yield and reliability can be improved. FIG. 13B illustrates a signal processing circuit in which the transistor 201 in FIG. 6 is omitted. Note that it is preferable to omit the transistor 201 when a load such as a pixel is connected to the wiring 114 or when the signal input to the wiring 113 is in a non-active state.

Figure 14A:
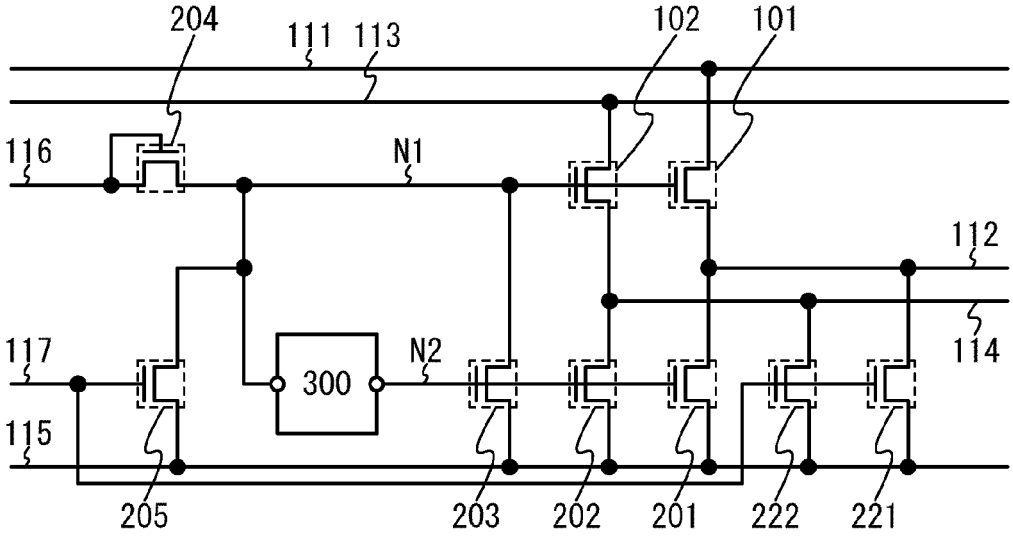
FIGS. 14A and 14B each illustrate a configuration of a signal processing circuit according to one embodiment.

In the signal processing circuits illustrated in FIG. 6 and FIGS. 13A and 13B, a transistor 221 and a transistor 222 can be provided. A first terminal of the transistor 221 is connected to the wiring 115. A second terminal of the transistor 221 is connected to the wiring 112. A gate of the transistor 221 is connected to the wiring 117. A first terminal of the transistor 222 is connected to the wiring 115. A second terminal of the transistor 222 is connected to the wiring 114. A gate of the transistor 222 is connected to the wiring 117. In the period C1 and the period C2, the transistor 221 is turned on, and electrical continuity is established between the wiring 115 and the wiring 112. Thus, the fall time of the potential of the wiring 112 can be shortened in the periods C1 and C2. In the periods C1 and C2, the transistor 222 is turned on, and electrical continuity is established between the wiring 115 and the wiring 114. Thus, the fall time of the potential of the wiring 114 can be shortened in the periods C1 and C2. FIG. 14A illustrates a signal processing circuit in which the transistor 221 and the transistor 222 are provided in FIG. 6.

In the signal processing circuits illustrated in FIG. 6 and FIGS. 13A and 13B, only one of the transistors 221 and 222 can be provided. In particular, it is preferable to provide only the transistor 222 when a load such as a pixel is connected to the wiring 114 or when the signal input to the wiring 113 is in a non-active state.

Figure 14B:
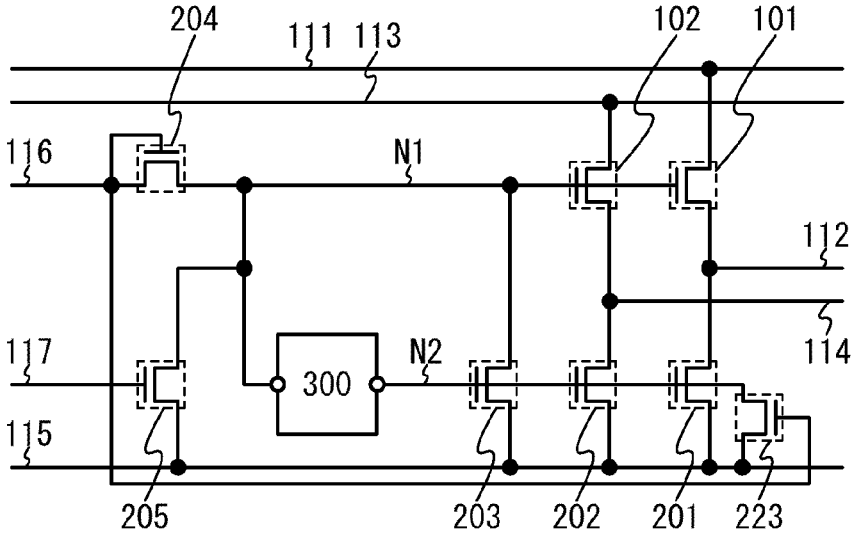

In the signal processing circuits illustrated in FIG. 6, FIGS. 13A and 13B, and FIG. 14A, a transistor 223 can be provided. A first terminal of the transistor 223 is connected to the wiring 115. A second terminal of the transistor 223 is connected to the node N2. A gate of the transistor 223 is connected to the wiring 116. In the period A1 and the period A2, the transistor 223 is turned on, and electrical continuity is established between the wiring 115 and the node N2. Thus, the fall time of the potential of the node N2 can be shortened in the periods A1 and A2. FIG. 14B illustrates a signal processing circuit in which the transistor 223 is provided in FIG. 6.

Figure 15A:
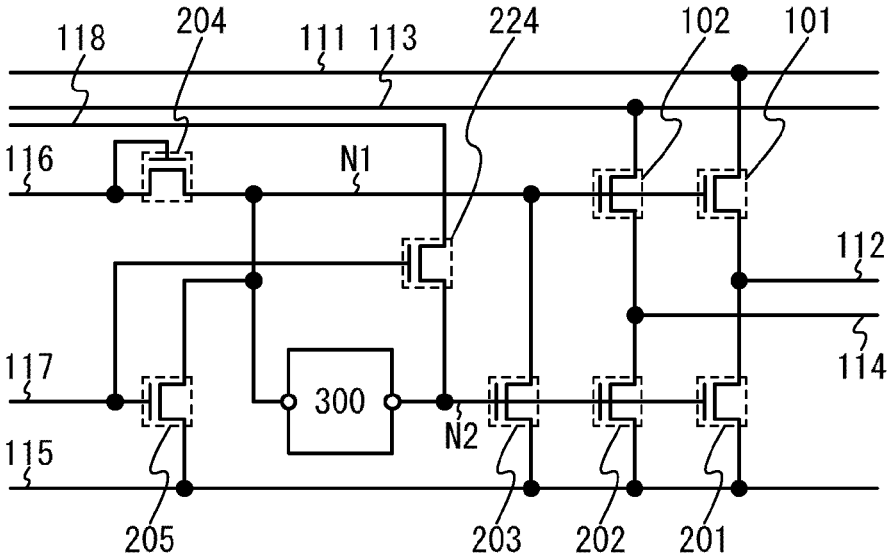
FIGS. 15A and 15B each illustrate a configuration of a signal processing circuit according to one embodiment.

In the signal processing circuits illustrated in FIG. 6, FIGS. 13A and 13B, and FIGS. 14A and 14B, a transistor 224 can be provided. A first terminal of the transistor 224 is connected to the wiring 118. A second terminal of the transistor 224 is connected to the node N2. A gate of the transistor 224 is connected to the wiring 117. In the period C1 and the period C2, the transistor 224 is turned on, and electrical continuity is established between the wiring 118 and the node N2. Thus, the rise time of the potential of the node N2 can be shortened in the periods C1 and C2. FIG. 15A illustrates a signal processing circuit in which the transistor 224 is provided in FIG. 6.

Figure 15B:
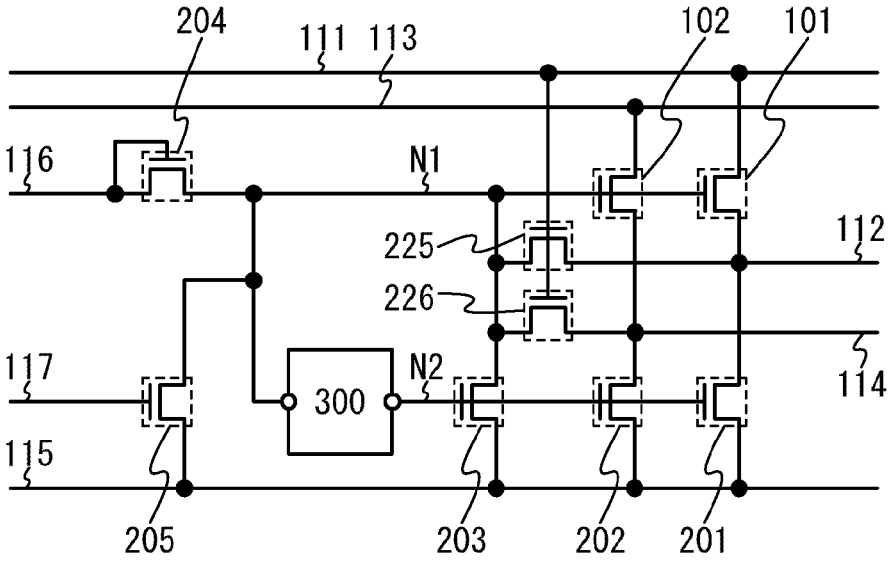

In the signal processing circuits illustrated in FIG. 6, FIGS. 13A and 13B, FIGS. 14A and 14B, and FIG. 15A, a transistor 225 and a transistor 226 can be provided. A first terminal of the transistor 225 is connected to the wiring 112. A second terminal of the transistor 225 is connected to the node N1. A gate of the transistor 225 is connected to the wiring 111. A first terminal of the transistor 226 is connected to the wiring 114. A second terminal of the transistor 226 is connected to the node N1. A gate of the transistor 226 is connected to the wiring 111. In the period D1 and the period D2, the transistor 225 is turned on, and electrical continuity is established between the wiring 112 and the node N1. In the period D1 and the period D2, the transistor 226 is turned on, and electrical continuity is established between the wiring 114 and the node N1. FIG. 15B illustrates a signal processing circuit in which the transistor 225 and the transistor 226 are provided in FIG. 6.

In the signal processing circuits illustrated in FIG. 6, FIGS. 13A and 13B, FIGS. 14A and 14B, and FIG. 15A, only one of the transistors 225 and 226 can be provided. In particular, it is preferable to provide only the transistor 226 when a load such as a pixel is connected to the wiring 114 or when the signal input to the wiring 113 is in a non-active state.

Note that the gate of the transistor 225 can be connected to the wiring 113. Further, the gate of the transistor 226 can be connected to the wiring 113.

Note that when the transistor 225 or the transistor 226 is provided, the transistor 203 can be omitted.

Figure 16A:
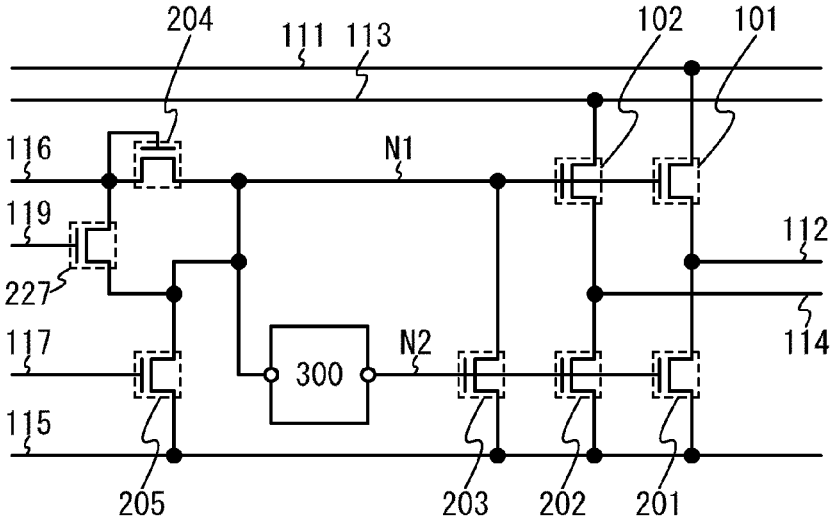
FIGS. 16A and 16B each illustrate a configuration of a signal processing circuit according to one embodiment.

In the signal processing circuits illustrated in FIG. 6, FIGS. 13A and 13B, FIGS. 14A and 14B, and FIGS. 15A and 15B, a transistor 227 can be provided. A first terminal of the transistor 227 is connected to the wiring 116. A second terminal of the transistor 227 is connected to the node N1. A gate of the transistor 227 is connected to a wiring 119. The wiring 119 is a wiring to which a signal (e.g., an inverted signal of the signal input to the wiring 111 or a signal whose phase is shifted from the signal input to the wiring 111) is input, and has a function of a signal line, a clock signal line, an inverted clock signal line, or the like. A signal input to the wiring 119 is a digital signal. An H-level potential of the signal input to the wiring 119 is approximately equal to the H-level potential (e.g., the potential V1) of the signal input to the wiring 111. An L-level potential of the signal input to the wiring 119 is approximately equal to the L-level potential (e.g., the potential V2) of the signal input to the wiring 111. For example, in the periods A1, C1, E1, A2, C2, and D2, the transistor 227 is turned on, and electrical continuity is established between the wiring 116 and the node N1. FIG. 16A illustrates a signal processing circuit in which the transistor 227 is provided in FIG. 6.

Figure 16B:
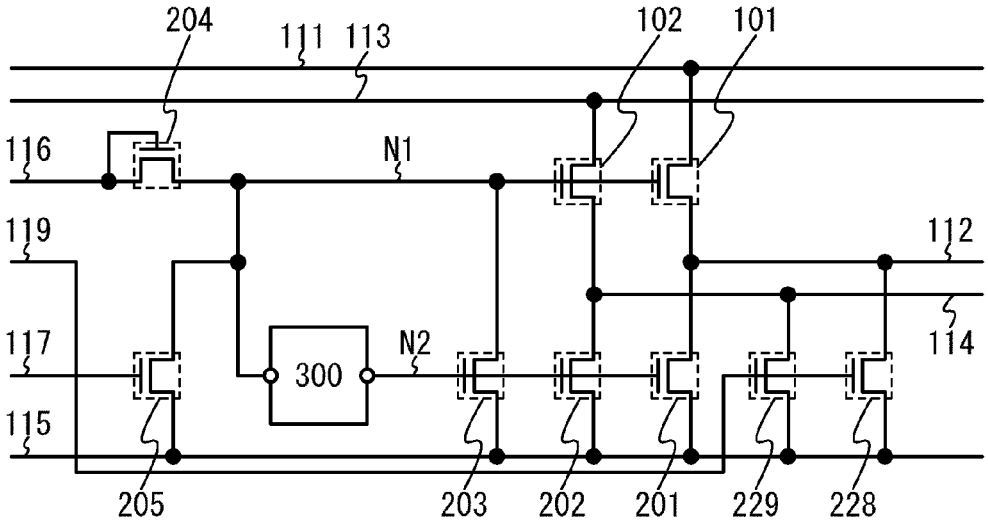

In the signal processing circuits illustrated in FIG. 6, FIGS. 13A and 13B, FIGS. 14A and 14B, FIGS. 15A and 15B, and FIG. 16A, a transistor 228 and a transistor 229 can be provided. A first terminal of the transistor 228 is connected to the wiring 115. A second terminal of the transistor 228 is connected to the wiring 112. A gate of the transistor 228 is connected to the wiring 119. A first terminal of the transistor 229 is connected to the wiring 115. A second terminal of the transistor 229 is connected to the wiring 114. A gate of the transistor 229 is connected to the wiring 119. For example, in the periods A1, C1, E1, A2, C2, and E2, the transistor 228 is turned on, and electrical continuity is established between the wiring 115 and the wiring 112. In the periods A1, C1, E1, A2, C2, and E2, the transistor 229 is turned on, and electrical continuity is established between the wiring 115 and the wiring 114. FIG. 16B illustrates a signal processing circuit in which the transistor 228 and the transistor 229 are provided in FIG. 6.

In the signal processing circuits illustrated in FIG. 6, FIGS. 13A and 13B, FIGS. 14A and 14B, FIGS. 15A and 15B, and FIG. 16A, only one of the transistors 228 and 229 can be provided. In particular, it is preferable to provide only the transistor 229 when a load such as a pixel is connected to the wiring 114 or when the signal input to the wiring 113 is in a non-active state.

The circuit 300 can have a variety of configurations. Some examples will be described below.

Figure 17A:
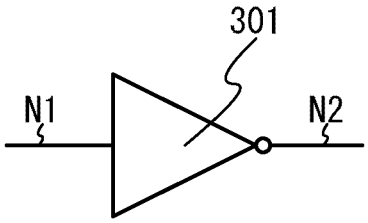
FIGS. 17A to 17E each illustrate an example of a configuration of part of a circuit included in a signal processing circuit.

FIG. 17A illustrates an example where an inverter circuit 301 is used as the circuit 300. An input terminal of the inverter circuit 301 is connected to the node N1. An output terminal of the inverter circuit 301 is connected to the node N2. Note that the input terminal of the inverter circuit 301 can be connected to the wiring 112, the wiring 114, the wiring 111, or the like without limitation to the node N1.

Figure 17B:
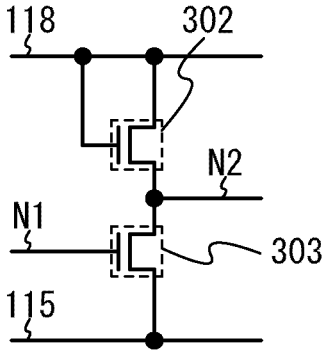
Figure 17C:
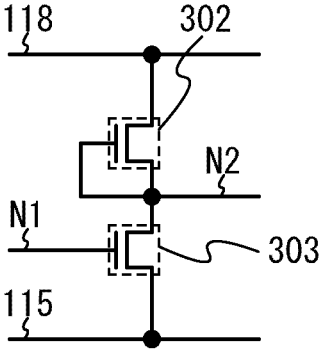
Figure 17D:
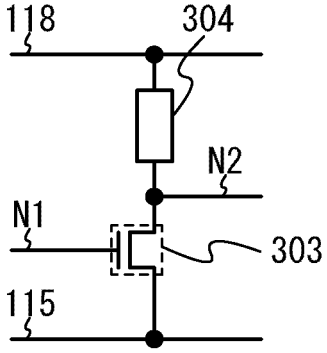

FIG. 17B illustrates an example of the circuit 300 including a transistor 302 and a transistor 303. The circuit 300 in FIG. 17B has a function of an inverter circuit. A first terminal of the transistor 302 is connected to the wiring 118. A second terminal of the transistor 302 is connected to the node N2. A gate of the transistor 302 is connected to the wiring 118. A first terminal of the transistor 303 is connected to the wiring 115. A second terminal of the transistor 303 is connected to the node N2. A gate of the transistor 303 is connected to the node N1. As illustrated in FIG. 17C, the gate of the transistor 302 can be connected to the node N2 in the circuit 300 in FIG. 17B. As illustrated in FIG. 17D, the transistor 302 can be replaced with a resistor 304 in the circuit 300 in FIG. 17B. The resistor 304 is connected between the wiring 118 and the node N2. Note that in the circuits 300 illustrated in FIGS. 17B to 17D, the gate of the transistor 303 can be connected to the wiring 112 or the wiring 114.

Figure 17E:
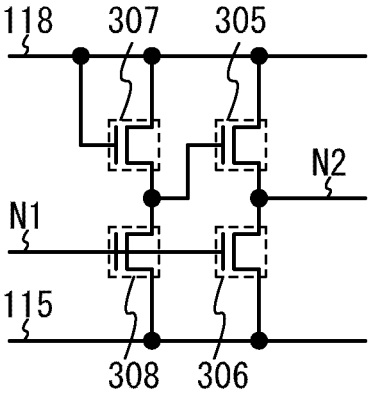

FIG. 17E illustrates an example of the circuit 300 including a transistor 305, a transistor 306, a transistor 307, and a transistor 308. The circuit 300 in FIG. 17E has a function of an inverter circuit. A first terminal of the transistor 305 is connected to the wiring 118. A second terminal of the transistor 305 is connected to the node N2. A first terminal of the transistor 306 is connected to the wiring 115. A second terminal of the transistor 306 is connected to the node N2. A gate of the transistor 306 is connected to the node N1. A first terminal of the transistor 307 is connected to the wiring 118. A second terminal of the transistor 307 is connected to a gate of the transistor 305. A gate of the transistor 307 is connected to the wiring 118. A first terminal of the transistor 308 is connected to the wiring 115. A second terminal of the transistor 308 is connected to the gate of the transistor 305. A gate of the transistor 308 is connected to the node N1. Note that in the circuit 300 in FIG. 17E, the gate of the transistor 306 can be connected to the wiring 112 or the wiring 114. Moreover, in the circuit 300 in FIG. 17E, the gate of the transistor 308 can be connected to the wiring 112 or the wiring 114.

Figure 18A:
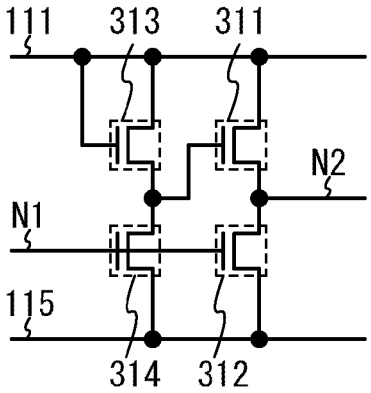
FIGS. 18A to 18C each illustrate an example of a configuration of part of a circuit included in a signal processing circuit.
Figure 18B:
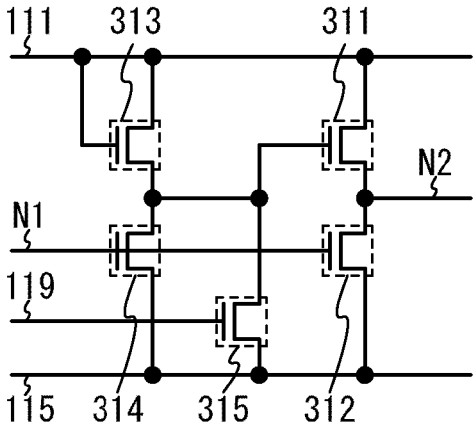
Figure 18C:
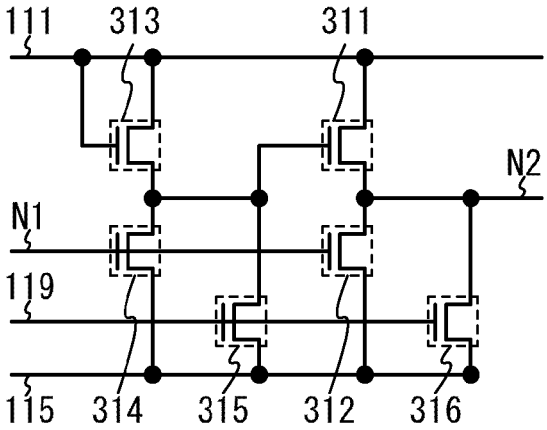

FIG. 18A illustrates an example of the circuit 300 including a transistor 311, a transistor 312, a transistor 313, and a transistor 314. When the circuit 300 has the configuration illustrated in FIG. 18A, the timing chart in FIG. 12B can be realized. A first terminal of the transistor 311 is connected to the wiring 111. A second terminal of the transistor 311 is connected to the node N2. A first terminal of the transistor 312 is connected to the wiring 115. A second terminal of the transistor 312 is connected to the node N2. A gate of the transistor 312 is connected to the node N1. A first terminal of the transistor 313 is connected to the wiring 111. A second terminal of the transistor 313 is connected to a gate of the transistor 311. A gate of the transistor 313 is connected to the wiring 111. A first terminal of the transistor 314 is connected to the wiring 115. A second terminal of the transistor 314 is connected to the gate of the transistor 311. A gate of the transistor 314 is connected to the node N2. As illustrated in FIG. 18B, a transistor 315 can be provided in the circuit 300 in FIG. 18A. A first terminal of the transistor 315 is connected to the wiring 115. A second terminal of the transistor 315 is connected to the gate of the transistor 311. A gate of the transistor 315 is connected to the wiring 119. As illustrated in FIG. 18C, the transistor 315 and a transistor 316 can be provided in the circuit 300 in FIG. 18A. A first terminal of the transistor 316 is connected to the wiring 115. A second terminal of the transistor 316 is connected to the node N2. A gate of the transistor 316 is connected to the wiring 119. Note that in the circuits 300 illustrated in FIGS. 18A to 18C, the gate of the transistor 312 can be connected to the wiring 112 or the wiring 114. Moreover, in the circuits 300 illustrated in FIGS. 18A to 18C, the gate of the transistor 314 can be connected to the wiring 112 or the wiring 114.

Examples of the proportion of the size of the transistors will be described below.

In the case where a load such as a pixel is connected to the wiring 114, the load of the wiring 114 is larger than that of the wiring 112. For that reason, the W/L ratio of the transistor 202 is preferably higher than that of the transistor 201. Thus, the fall time of the signal in the wiring 114 can be shortened and the layout area can be reduced. It is preferable that the W/L ratio of the transistor 202 be higher than that of the transistor 201 and be 10 times or less as high as that of the transistor 201. The W/L ratio of the transistor 202 is more preferably 1.2 to 7 times, further preferably 2 to 5 times as high as that of the transistor 201.

When a load such as a pixel is connected to the wiring 114, the load of the wiring 114 is larger than that of the wiring 112. Moreover, the channel width of the transistors 101 and 102 is large. Thus, the load of the node N1 is smaller than that of the wiring 114 and larger than that of the wiring 112. Therefore, the W/L ratio of the transistor 203 is preferably higher than that of the transistor 201. The W/L ratio of the transistor 203 is preferably lower than that of the transistor 202.

When a load such as a pixel is connected to the wiring 114, the load of the wiring 114 is larger than that of the wiring 112.

Moreover, the load of the node N1 is smaller than that of the wiring 114 and larger than that of the wiring 112. Therefore, the W/L ratio of the transistor 204 is preferably higher than that of the transistor 101. The W/L ratio of the transistor 204 is preferably lower than that of the transistor 102.

When a load such as a pixel is connected to the wiring 114, the load of the wiring 114 is larger than that of the wiring 112. Therefore, the W/L ratio of the transistor 222 is preferably higher than that of the transistor 221. Thus, the fall time of the signal in the wiring 114 can be shortened and the layout area can be reduced.

When a load such as a pixel is connected to the wiring 114, the load of the wiring 114 is larger than that of the wiring 112. Moreover, the load of the node N2 is smaller than that of the wiring 114 and larger than that of the wiring 112. Therefore, the W/L ratio of the transistor 223 is preferably higher than that of the transistor 201. The W/L ratio of the transistor 223 is preferably lower than that of the transistor 202.

In the period C1 or the period C2, the timing at which the transistors 201 and 202 are turned on can be advanced by advancing the timing at which the potential of the node N2 rises. In order to realize this, the W/L ratio of the transistor 224 is preferably high. On the other hand, in the period C1 or the period C2, the timing at which the transistors 101 and 102 are turned off can be delayed by delaying the timing at which the potential of the node N1 decreases. Thus, the potential V2 of the wiring 111 and the potential V2 of the wiring 113 can be supplied to the wiring 112 and the wiring 114, respectively, so that the fall time of the signals in the wirings 112 and 114 can be shortened. In view of the above, the W/L ratio of the transistor 224 is preferably higher than that of the transistor 205.

In the case where a load such as a pixel is connected to the wiring 114, the load of the wiring 114 is larger than that of the wiring 112. For that reason, the W/L ratio of the transistor 226 is preferably higher than that of the transistor 225.

The transistors 225 and 201 have a function of keeping the potential of the wiring 112 or the node N1 at the potential V2. Note that when the W/L ratio of the transistor 225 is too high, the potential of the node N1 might decrease in the period B1 and the period B2 so that a malfunction may occur. Therefore, the W/L ratio of the transistor 225 is preferably lower than that of the transistor 201.

The transistors 226 and 202 have a function of keeping the potential of the wiring 114 or the node N1 at the potential V2. Note that when the W/L ratio of the transistor 226 is too high, the potential of the node N1 might decrease in the period B1 and the period B2 so that a malfunction may occur. Therefore, the W/L ratio of the transistor 226 is preferably lower than that of the transistor 202.

In the case where a load such as a pixel is connected to the wiring 114, the load of the wiring 114 is larger than that of the wiring 112. For that reason, the W/L ratio of the transistor 229 is preferably higher than that of the transistor 228.

An embodiment of the present invention includes any of the following configurations for a display device including the above-described transistors.

A display device includes a driver circuit and a pixel. The driver circuit includes a first transistor and a second transistor. The pixel includes a third transistor and a liquid crystal element. A first terminal of the first transistor is electrically connected to a first wiring. A second terminal of the first transistor is electrically connected to a second wiring. A first terminal of the second transistor is electrically connected to a third wiring. A second terminal of the second transistor is electrically connected to a fourth wiring. A gate of the second transistor is electrically connected to a gate of the first transistor. A first terminal of the third transistor is electrically connected to a fifth wiring. A second terminal of the third transistor is electrically connected to one of electrodes of the liquid crystal element. A gate of the third transistor is electrically connected to the fourth wiring. The channel width of the first transistor is smaller than that of the second transistor.

A display device includes a driver circuit, a pixel, and a protection circuit. The driver circuit includes a first transistor and a second transistor. The pixel includes a third transistor and a liquid crystal element. A first terminal of the first transistor is electrically connected to a first wiring. A second terminal of the first transistor is electrically connected to a second wiring. A first terminal of the second transistor is electrically connected to a third wiring. A second terminal of the second transistor is electrically connected to a fourth wiring. A gate of the second transistor is electrically connected to a gate of the first transistor. A first terminal of the third transistor is electrically connected to a fifth wiring. A second terminal of the third transistor is electrically connected to one of electrodes of the liquid crystal element. A gate of the third transistor is electrically connected to the fourth wiring. The protection circuit is electrically connected to the fourth wiring.

A display device includes a driver circuit and a pixel. The driver circuit includes a first transistor, a second transistor, a third transistor, and an inverter circuit. The pixel includes a fourth transistor and a liquid crystal element. A first terminal of the first transistor is electrically connected to a first wiring. A second terminal of the first transistor is electrically connected to a second wiring. A first terminal of the second transistor is electrically connected to a third wiring. A second terminal of the second transistor is electrically connected to a fourth wiring. A gate of the second transistor is electrically connected to a gate of the first transistor. A first terminal of the third transistor is electrically connected to a fifth wiring. A second terminal of the third transistor is electrically connected to the gate of the first transistor. An input terminal of the inverter circuit is electrically connected to the gate of the first transistor. An output terminal of the inverter circuit is electrically connected to a gate of the third transistor. A first terminal of the fourth transistor is electrically connected to a sixth wiring. A second terminal of the fourth transistor is electrically connected to one of electrodes of the liquid crystal element. A gate of the fourth transistor is electrically connected to the fourth wiring.

(Configuration of Shift Register According to One Embodiment)

Figure 19:
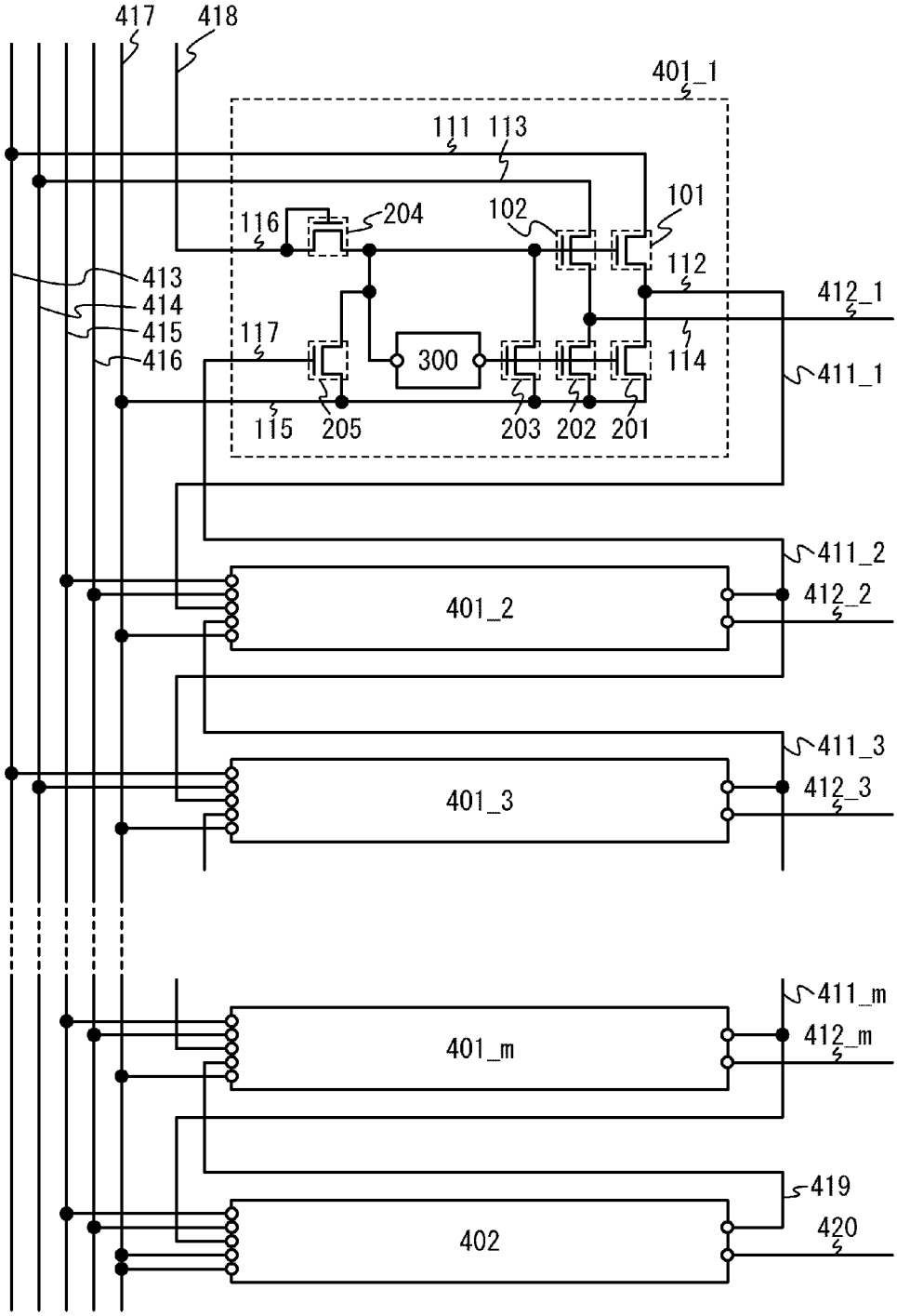
FIG. 19 illustrates an example of a configuration of a shift register circuit according to one embodiment.

FIG. 19 illustrates an example of a shift register circuit. The shift register circuit includes the signal processing circuit illustrated in FIG. 6. Note that any of the signal processing circuits illustrated in FIGS. 13A and 13B, FIGS. 14A and 14B, FIGS. 15A and 15B, and FIGS. 16A and 16B can be applied instead of the signal processing circuit in FIG. 6.

The shift register circuit in FIG. 19 includes m circuits 401 (referred to as circuits 401_1 to 401_m, where m is a natural number) and a circuit 402. FIG. 19 illustrates an example where the signal processing circuit in FIG. 6 is used as the circuit 401.

The circuit 402 has a function of a dummy circuit. The configuration of the circuit 402 can be the same as or different from that of the circuit 401. For example, one or more of the transistors 101, 201, and 205 can be omitted in the circuit 402. Alternatively, the circuit 402 can be omitted.

The shift register circuit in FIG. 19 is connected to m wirings 411 (referred to as wirings 411_1 to 411_m), m wirings 412 (referred to as wirings 412_1 to 412_m), a wiring 413, a wiring 414, a wiring 415, a wiring 416, a wiring 417, a wiring 418, a wiring 419, and a wiring 420. Note that when the dummy circuit is omitted, the wirings 419 and 420 can be omitted.

The connection relation of the circuit 401 will be described below. Here, the connection relation of the circuit 401_i (i is a natural number of 2 or more and less than m) is described as an example. The circuit 401_i is connected to the wiring 411_i−1, the wiring 411_i, the wiring 411_i+1, the wiring 412_i, one of the wiring 413 and the wiring 415, one of the wiring 414 and the wiring 416, and the wiring 417. Specifically, in the circuit 401_i, the wiring 111 is connected to one of the wiring 413 and the wiring 415. The wiring 112 is connected to the wiring 411_i. The wiring 113 is connected to one of the wiring 414 and the wiring 416. The wiring 114 is connected to the wiring 412_i. The wiring 115 is connected to the wiring 417. The wiring 116 is connected to the wiring 411_i−1. The wiring 117 is connected to the wiring 411_i+1. Note that the wiring 116 in the circuit 401_1 is connected to the wiring 418, which is different from the circuit 401_i. The wiring 117 in the circuit 401_m is connected to the wiring 420, which is different from the circuit 401_i.

The connection relation of the circuit 402 will be described below. The circuit 402 is connected to the wiring 419, the wiring 420, the wiring 411_m, one of the wiring 413 and the wiring 415, one of the wiring 414 and the wiring 416, and the wiring 417. Specifically, in the circuit 402, the wiring 111 is connected to one of the wiring 413 and the wiring 415. The wiring 112 is connected to the wiring 419. The wiring 113 is connected to one of the wiring 414 and the wiring 416. The wiring 114 is connected to the wiring 420. The wiring 115 is connected to the wiring 417. The wiring 116 is connected to the wiring 411_m. The wiring 117 is connected to the wiring 417.

Examples of the wirings 411 to 418 will be described below.

An output signal of the circuit 401 is output from the wiring 411. That is, the wiring 411 is a wiring for transmitting an output signal of the circuit 401 to a circuit to which the wiring 411 is connected, and has a function of a signal line. For example, the wiring 411_i is a wiring for transmitting an output signal of the circuit 401_i to the circuits 401_i−1 and 401_i+1. Specifically, an output signal output from the wiring 411 is input to the wiring 116 in the subsequent-stage circuit 401. Moreover, an output signal output from the wiring 411 is input to the wiring 117 in the preceding-stage circuit 401. That is, the output signal output from the wiring 411 has a function of a start signal and/or a reset signal.

An output signal of the circuit 401 is output from the wiring 412. That is, the wiring 412 is a wiring for transmitting an output signal of the circuit 401 to a load connected to the wiring 412, and has a function of a signal line. Specifically, when a pixel is connected to the wiring 412, the output signal of the circuit 401, which is transmitted through the wiring 412, serves as a signal for controlling the timing of selecting a pixel and has a function of a gate signal or a scan signal. Furthermore, the wiring 412 has a function of a gate signal line or a scan line.

A signal such as a clock signal is input to the wiring 413. That is, the wiring 413 is a wiring for transmitting a signal such as a clock signal to the shift register circuit, and has a function of a signal line or a clock signal line.

A signal that is in either an active state or a non-active state is input to the wiring 414. When the signal input to the wiring 414 is in an active state, a signal whose phase is the same as that of the signal input to the wiring 413 is input to the wiring 414. On the other hand, when the signal input to the wiring 414 is in a non-active state, an L-level signal or the potential V2 is input to the wiring 414. That is, the wiring 414 is a wiring for transmitting a signal in either an active state or a non-active state to the shift register circuit, and has a function of a signal line or a clock signal line.

A signal such as an inverted signal of the signal input to the wiring 413 (e.g., an inverted clock signal) or a signal whose phase is shifted from the signal input to the wiring 413 is input to the wiring 415. That is, the wiring 415 is a wiring for transmitting a signal such as an inverted signal of the signal input to the wiring 413 (e.g., an inverted clock signal) or a signal whose phase is shifted from the signal input to the wiring 413, to the shift register circuit. The wiring 415 has a function of a signal line, a clock signal line, or an inverted clock signal line.

A signal that is in either an active state or a non-active state is input to the wiring 416. When the signal input to the wiring 416 is in an active state, a signal whose phase is the same as that of the signal input to the wiring 415 is input to the wiring 416. On the other hand, when the signal input to the wiring 416 is in a non-active state, an L-level signal or the potential V2 is input to the wiring 416. That is, the wiring 416 is a wiring for transmitting a signal in either an active state or a non-active state to the shift register circuit, and has a function of a signal line or a clock signal line.

A predetermined voltage such as the voltage V2 is supplied to the wiring 417. That is, the wiring 417 is a wiring for supplying a predetermined voltage such as the voltage V2 to the shift register circuit and has a function of a power supply line, a negative power supply line, or a ground line.

A signal such as a start signal is input to the wiring 418. That is, the wiring 418 is a wiring for transmitting a signal such as a start signal to the shift register circuit (particularly to the circuit 401_1) and has a function of a signal line.

Note that a signal can be input to the wirings 413, 414, 415, 416, and 418 from an external circuit such as a timing controller. Note that a signal generated based on the signal input to the wiring 413 may be input to the wiring 414. Further, a signal generated based on the signal input to the wiring 415 may be input to the wiring 416.

Note that a voltage can be supplied to the wiring 417 from an external circuit such as a power supply circuit.

Figure 20:
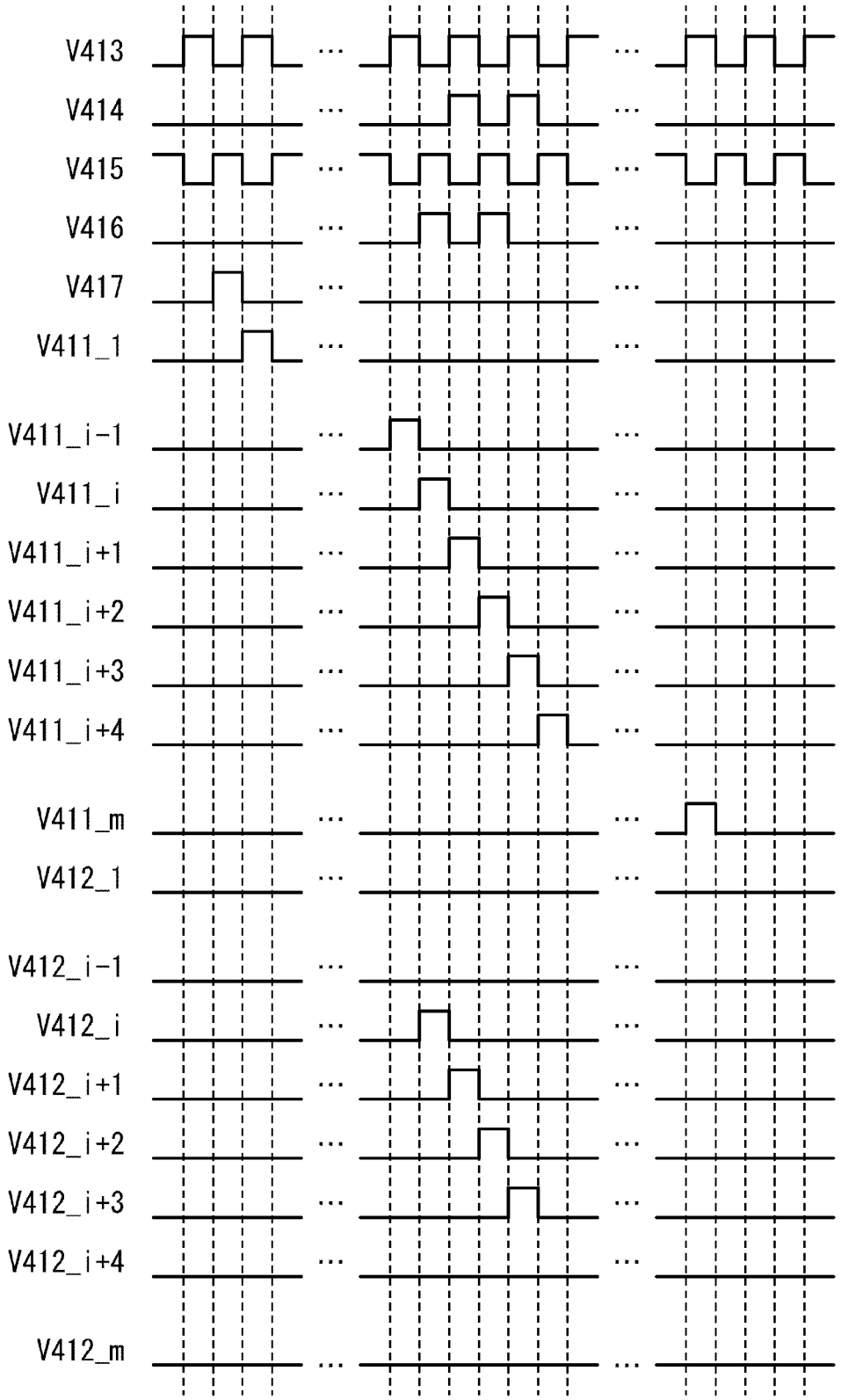
FIG. 20 illustrates an example of a timing chart for explaining operation of the shift register circuit in FIG. 19.

An example of operation of the shift register circuit illustrated in FIG. 19 will be described. FIG. 20 is an example of a timing chart for explaining operation of the shift register circuit. The timing chart in FIG. 20 shows an example where only the wirings 412_i to 412_i+3 are selected among the wirings 412_1 to 412_m. FIG. 20 illustrates the potential of the wiring 413 (shown as V413), the potential of the wiring 414 (shown as V414), the potential of the wiring 415 (shown as V415), the potential of the wiring 416 (shown as V416), the potential of the wiring 417 (shown as V417), the potentials of the wirings 411_1 to 411_m (shown as V411_1 to V411_m), and the potentials of the wirings 412_1 to 412_m (shown as V412_1 to V412_m).

As signals input to the wiring 417 are shifted, the potentials of the wirings 411_1 to 411_m sequentially become H level from the wiring 411_1.

For example, when the potential of the wiring 411_i−1 becomes H level, the circuit 401_i performs the operation in the period A1 or the period A2 illustrated in FIGS. 7A and 7B. Thus, the potential of the wiring 411_i becomes L level.

After that, the signal input to the wiring 413 and the signal input to the wiring 415 are inverted. Then, the circuit 401_i performs the operation in the period B1 or the period B2 illustrated in FIGS. 7A and 7B. Thus, the potential of the wiring 411_i becomes H level.

After that, the signal input to the wiring 413 and the signal input to the wiring 415 are inverted, and the potential of the wiring 411_i+1 becomes H level. Then, the circuit 401_i performs the operation in the period C1 or the period C2 illustrated in FIGS. 7A and 7B. Thus, the potential of the wiring 411_i becomes L level.

After that, the circuit 401_i alternately performs the operation in the period D1 or the period D2 in FIGS. 7A and 7B and the operation in the period E1 or the period E2 in FIGS. 7A and 7B every time the signal input to the wiring 413 and the signal input to the wiring 415 are inverted. Thus, the potential of the wiring 411_i remains at L level.

Here, in order to select only the wirings 412_i to 412_i+3 among the wirings 412_1 to 412_m, the signal input to the wiring 414 and the signal input to the wiring 416 are made in a non-active state (e.g., at a constant potential (the potential V2)) in a period during which the potentials of the wirings 411_1 to 411_i−1 sequentially become H level.

After that, the signal input to the wiring 414 and the signal input to the wiring 416 are made in an active state in a period during which the potentials of the wirings 411_i to 411_i+3 sequentially become H level.

After that, the signal input to the wiring 414 and the signal input to the wiring 416 are made in a non-active state (e.g., at a constant potential (the potential V2)) in a period during which the potentials of the wirings 411_i+3 to 411_m sequentially become H level.

By controlling an active state and a non-active state of the signals input to the wirings 414 and 416 as described above, the potentials of the wirings 412_1 to 412_i−1 and the wirings 412_i+4 to 412_m can remain at L level and the potentials of the wirings 412_i to 412_i+3 can be sequentially set to H level.

As described above, by selecting whether the signals input to the wirings 414 and 416 are in an active state or a non-active state, the wirings 412_1 to 412_m can be partly selected. That is, partial driving can be realized.

In a conventional display device, a plurality of start signals are required in order to realize partial driving. That is, the number of signals is increased. Therefore, when a gate driver circuit is formed over a substrate where a pixel portion is formed, the number of connections between the substrate where the pixel portion is formed and an external circuit is increased. For that reason, the yield is decreased, the reliability is reduced, or costs are increased. In contrast, in the semiconductor device in this embodiment, the increase in the number of signals can be suppressed. Alternatively, the increase in the number of connections between a substrate where a pixel portion is formed and an external circuit can be suppressed; the yield can be increased; the reliability can be improved; or costs can be reduced.

In addition, in a conventional display device, a plurality of start signals need to be controlled at different timings. Thus, the size of a timing controller is increased, power consumption of the timing controller is increased, or costs for the timing controller are increased. In contrast, in the semiconductor device, the display device, or the like that includes the above-described shift register circuit, the increase in size of a timing controller can be suppressed. Alternatively, the increase in power consumption of the timing controller can be suppressed, or the increase in costs for the timing controller can be suppressed.

Further, in a conventional display device, a gate driver circuit is divided into a plurality of groups and start signals input to the plurality of groups are controlled so that partial driving is realized. Therefore, there are limitations on a combination of pixels or rows that can be selected partly, and selection of only a given pixel or only a given row cannot be achieved. Thus, pixels or rows that do not need to be selected have to be selected depending on an image. For that reason, power consumption cannot be sufficiently reduced. In contrast, in the display device including the above-described shift register circuit, a pixel or a row to be selected can be decided depending on whether a signal (e.g., a clock signal or an inverted clock signal) is in an active state or a non-active state. Thus, only a given pixel or only a given row can be selected, or only a pixel or a row that needs to be selected can be selected. Alternatively, power consumption can be sufficiently reduced.

Furthermore, in a conventional display device, when the group is switched to another, an output signal deviates because of delay of a plurality of start signals, or the like. As a result, a wrong video signal is input to a pixel or the image quality is degraded. In contrast, in the display device including the above-described shift register circuit, deviation of an output signal does not occur. Alternatively, a wrong video signal can be prevented from being input to a pixel, or the reduction in image quality can be prevented.

(Structure of Display Device According to One Embodiment)

Figure 21A:
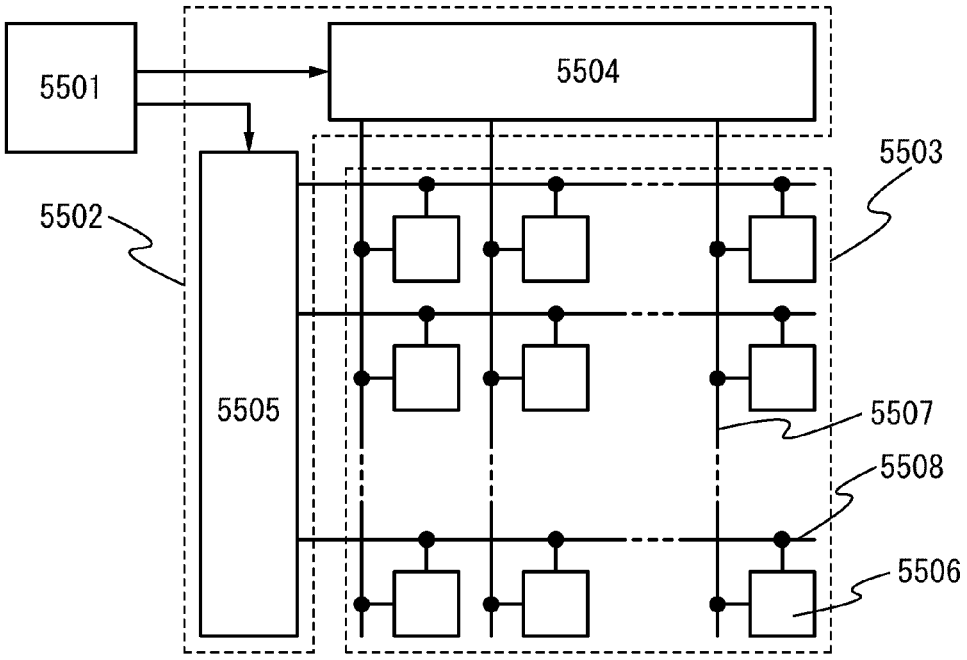
FIGS. 21A to 21E each illustrate an example of a structure of a display device according to one embodiment.

FIG. 21A illustrates an example of a display device including the above-described shift register circuit. The display device in FIG. 21A includes a circuit 5501 (e.g., a timing controller), a circuit 5502 (e.g., a driver circuit), and a pixel portion 5503. The circuit 5502 includes a circuit 5504 (e.g., a source driver circuit) and a circuit 5505 (e.g., a gate driver circuit). A plurality of wirings 5507 (e.g., signal lines, source signal lines, or video signal lines) extended from the circuit 5504 and a plurality of wirings 5508 (e.g., signal lines, gate signal lines, or scan lines) extended from the circuit 5505 are placed in the pixel portion 5503. Pixels 5506 are placed in regions where the plurality of wirings 5507 and the plurality of wirings 5508 intersect with each other, so as to be arranged in matrix. The pixel 5506 is connected to the wiring 5507 and the wiring 5508. The circuit 5501 is connected to the circuit 5504 and the circuit 5505.

A variety of wirings can be provided in the pixel portion 5503 depending on the configuration of the pixel 5506. Some examples will be described below. For example, when the pixel 5506 includes a liquid crystal element, a display element with memory properties, or the like, a capacitor line is preferably provided in the pixel portion 5503. As another example, when the pixel 5506 includes a light-emitting element such as an EL element, a power supply line such as an anode line is preferably provided in the pixel portion 5503. As another example, when the pixel 5506 includes a plurality of switches, transistors, or the like, a wiring having a function similar to that of the wiring 5508 (e.g., a signal line, a gate signal line, or a scan line) can be formed in the pixel portion 5503. In that case, it is preferable to additionally provide a circuit having a function similar to that of the circuit 5505 (e.g., a gate driver circuit).

All or part of the circuits 5501, 5504, and 5505 may be formed over a substrate where the pixel portion 5503 is formed. Alternatively, all the circuits 5501, 5504, and 5505 may be formed over a substrate different from the substrate where the pixel portion 5503 is formed. Some examples will be described with reference to FIGS. 21B to 21E.

Figure 21B:
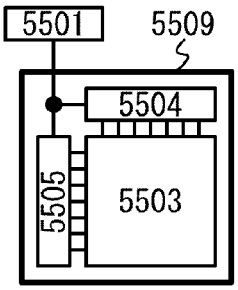

FIG. 21B illustrates an example in which the circuits 5504 and 5505 are formed over a substrate where the pixel portion 5503 is formed (referred to as a substrate 5509) and the circuit 5501 is formed over a substrate (e.g., a silicon substrate or an SOI substrate) different from the substrate where the pixel portion 5503 is formed. With this structure, the number of connections between the substrate where the pixel portion 5503 is formed and an external circuit can be reduced. Thus, improvement in reliability, increase in yield, reduction in manufacturing cost, and the like can be realized.

The substrate where the pixel portion 5503 is formed and the external circuit are preferably connected through an FPC pad or the like. The external circuit is preferably mounted on an FPC (flexible printed circuit) by TAB (tape automated bonding). Alternatively, the external circuit is preferably mounted on the substrate 5509 by COG (chip on glass).

Figure 21C:
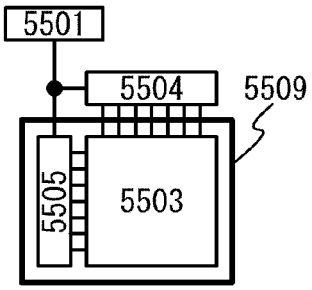

FIG. 21C illustrates an example in which the circuit 5505 is formed over the substrate where the pixel portion 5503 is formed and the circuits 5501 and 5504 are formed over a substrate (e.g., a silicon substrate or an SOI substrate) different from the substrate where the pixel portion 5503 is formed. In this structure, the circuit 5505 can be formed over the substrate where the pixel portion 5503 is formed. The driving frequency of the circuit 5505 can be lower than that of the circuit 5504. Therefore, the pixel portion 5503 and the circuit 5505 can be formed using a transistor including amorphous silicon, microcrystalline silicon, an oxide semiconductor, or an organic semiconductor. Thus, it is possible to achieve reduction in the number of steps, reduction in manufacturing cost, improvement in reliability, increase in yield, and the like. Moreover, the size of the pixel portion 5503 can be increased, so that the size of a display portion of the display device can be increased.

Figure 21D:
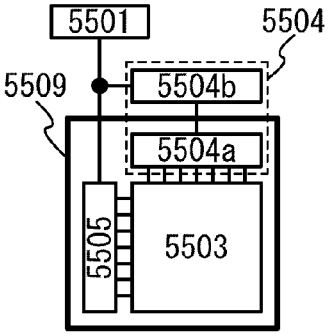

FIG. 21D illustrates an example in which part of the circuit 5504 (referred to as a circuit 5504*a*) and the circuit 5505 are formed over the substrate where the pixel portion 5503 is formed and the circuit 5501 and another part of the circuit 5504 (referred to as a circuit 5504*b*) are formed over a substrate different from the substrate where the pixel portion 5503 is formed. The driving frequency of the circuit 5504*a* is lower than that of the circuit 5504*b*. Therefore, as in the display device in FIG. 21B, the pixel portion 5503 and the circuits 5504*a* and 5505 can be formed using a transistor including amorphous silicon, microcrystalline silicon, an oxide semiconductor, or an organic semiconductor. The circuit 5504*a* is preferably constituted by one or more of a switch, an inverter circuit, a selector circuit, a demultiplexer circuit, a shift register circuit, a decoder circuit, and a buffer circuit. The circuit 5504*b* is preferably constituted by one or more of a shift register circuit, a decoder circuit, a latch circuit, a D/A conversion circuit, a level shifter circuit, and a buffer circuit.

Figure 21E:
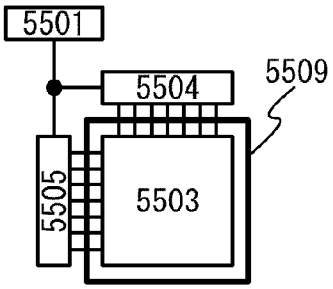

FIG. 21E illustrates an example in which the circuits 5501, 5504, and 5505 are formed over a substrate different from the substrate where the pixel portion 5503 is formed.

By using the shift register circuit in FIG. 19 as a gate driver circuit in such a display device, the display portion can be partly scanned. Thus, the area where an image displayed on the display portion is rewritten can be reduced, so that power consumption can be reduced.

(Circuit Configuration of Pixel According to One Embodiment)

Figure 22A:
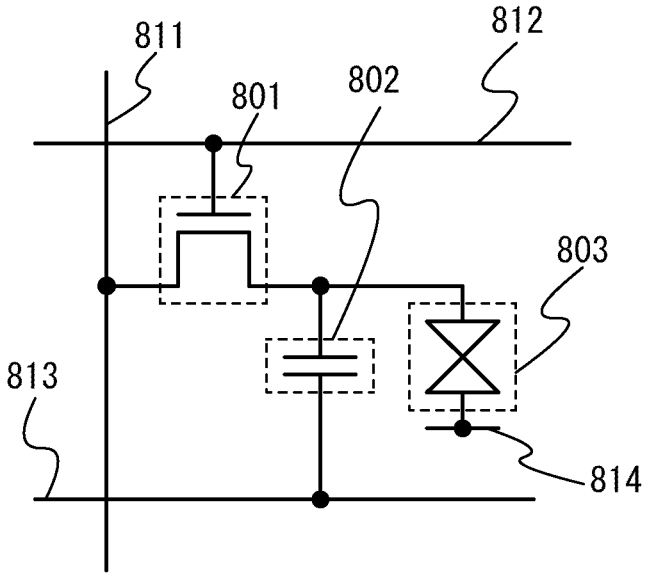
FIGS. 22A and 22B each illustrate an example of a configuration of a pixel in a display device according to one embodiment.

FIG. 22A illustrates a circuit configuration of a pixel including a liquid crystal element. The pixel in FIG. 22A includes a transistor 801, a capacitor 802, and a liquid crystal element 803. A first terminal of the transistor 801 is connected to a wiring 811. A second terminal of the transistor 801 is connected to one of electrodes of the capacitor 802 and one of electrodes of the liquid crystal element 803 (e.g., a pixel electrode). A gate of the transistor 801 is connected to a wiring 812. The other of the electrodes of the capacitor 802 is connected to a wiring 813. The other of the electrodes of the liquid crystal element 803 is connected to a common electrode 814 (also referred to as a cathode or a counter electrode). Note that the pixel in this embodiment is not limited to having the structure illustrated in FIG. 22A and can have a variety of other structures.

A signal for controlling the gray level or a voltage applied to the liquid crystal element 803 (e.g., a video signal) is input to the wiring 811. Therefore, the wiring 811 has a function of a video signal line. A signal for controlling a conduction state of the transistor 801 (e.g., a gate signal) is input to the wiring 812. Therefore, the wiring 812 has a function of a gate signal line. A predetermined voltage is supplied to the wiring 813. Therefore, the wiring 813 has a function of a power supply line or a capacitor line. A predetermined voltage (e.g., a common voltage) is supplied to the common electrode 814. Note that without limitation to the above, various other signals, voltages, or the like can be input to the wirings 811 to 813 and the common electrode 814. For example, the voltage supplied to the wiring 813 can be changed; thus, the voltage applied to the liquid crystal element 803 can be controlled. As another example, the voltage supplied to the common electrode 814 can be changed; thus, common inversion driving can be realized.

The transistor 801 has a function of a switch that controls electrical continuity between the wiring 811 and one of the electrodes of the liquid crystal element 803. The timing of inputting the potential of the wiring 811 to the pixel can be controlled by the transistor 801. The capacitor 802 has a function of a storage capacitor that maintains a potential difference between one of the electrodes of the liquid crystal element 803 and the wiring 813. The potential of one of the electrodes of the liquid crystal element 803 can be kept at a given value by the capacitor 802 even in a period during which the transistor 801 is off. That is, a voltage can continue to be applied to the liquid crystal element 803. Note that the transistor 801 and the capacitor 802 are not limited to having the above functions and can have various other functions.

Operation of the pixel in FIG. 22A is briefly described. The gray level of the liquid crystal element 803 is controlled by application of a voltage to the liquid crystal element 803 to generate electric fields in the liquid crystal element 803. The voltage applied to the liquid crystal element 803 is controlled by controlling the potential of one of the electrodes of the liquid crystal element 803, and more specifically by controlling a signal input to the wiring 811. The signal input to the wiring 811 is supplied to one of the electrodes of the liquid crystal element 803 when the transistor 801 is turned on. Note that a voltage continues to be applied to the liquid crystal element 803 by the capacitor 802 even when the transistor 801 is off.

Figure 22B:
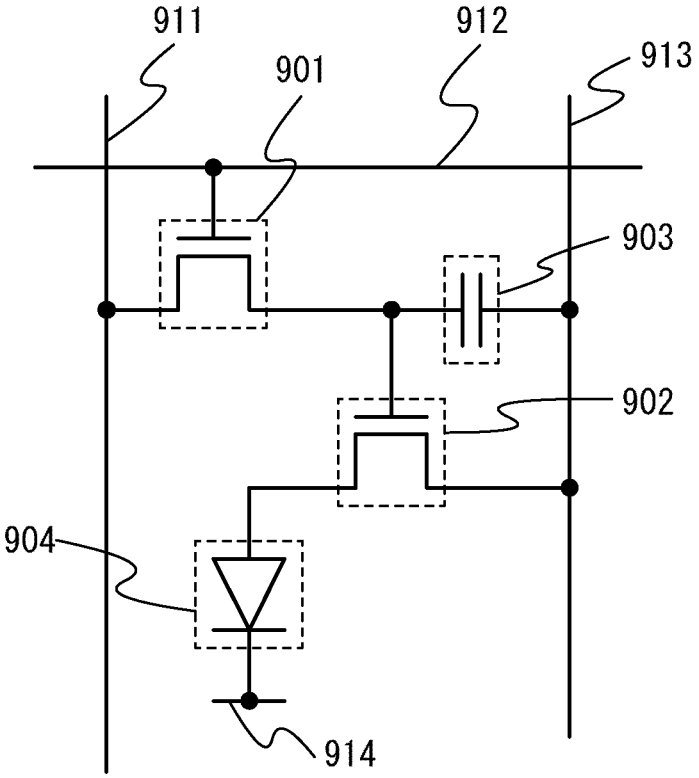

Next, a pixel including a light-emitting element such as an electroluminescent element (an EL element) will be described. FIG. 22B illustrates a circuit configuration of a pixel including a light-emitting element. The pixel in FIG. 22B includes a transistor 901, a transistor 902, a capacitor 903, and a light-emitting element 904. A first terminal of the transistor 901 is connected to a wiring 911. A second terminal of the transistor 901 is connected to a gate of the transistor 902. A gate of the transistor 901 is connected to a wiring 912. A first terminal of the transistor 902 is connected to a wiring 913. A second terminal of the transistor 902 is connected to one of electrodes of the light-emitting element 904. One of electrodes of the capacitor 903 is connected to the gate of the transistor 902. The other of the electrodes of the capacitor 903 is connected to the wiring 913. The other of the electrodes of the liquid crystal element 904 is connected to a common electrode 914. Note that the pixel in this embodiment is not limited to having the structure illustrated in FIG. 22B and can have a variety of other structures.

A signal for controlling the gray level of the light-emitting element 904 or a current supplied to the light-emitting element 904 (e.g., a video signal) is input to the wiring 911. Therefore, the wiring 911 has a function of a video signal line. A signal for controlling a conduction state of the transistor 901 (e.g., a gate signal) is input to the wiring 912. Therefore, the wiring 912 has a function of a gate signal line. A predetermined voltage (e.g., an anode voltage) is supplied to the wiring 913. Therefore, the wiring 913 has a function of a power supply line or an anode line. A predetermined voltage (e.g., a cathode voltage) is supplied to the common electrode 914. Note that without limitation to the above, various other signals, voltages, or the like can be input to the wirings 911 to 913 and the common electrode 914.

The transistor 901 has a function of a switch that controls electrical continuity between the wiring 911 and the gate of the transistor 902. The timing of inputting the potential of the wiring 911 to the pixel can be controlled by the transistor 901. The transistor 902 has a function of a driving transistor that controls a current supplied to the light-emitting element 904. The capacitor 903 has a function of a storage capacitor that maintains a potential difference between the gate of the transistor 902 and the wiring 913. The potential of the gate of the transistor 902 can be kept at a given value by the capacitor 903 even in a period during which the transistor 901 is off. In other words, the potential difference between the gate and the source of the transistor 902 can be kept at a given value, so that a current can continue to be supplied to the light-emitting element 904. Note that the transistors 901 and 902 and the capacitor 903 are not limited to having the above functions and can have various other functions.

Operation of the pixel in FIG. 22B is briefly described. The gray level of the light-emitting element 904 is controlled by controlling the potential of the gate of the transistor 902 to control a current supplied to the light-emitting element 904. The potential of the gate of the transistor 902 is controlled by controlling a signal input to the wiring 911. The signal input to the wiring 911 is supplied to the gate of the transistor 902 when the transistor 901 is turned on. Note that the potential of the gate of the transistor 902 is kept at a given value by the capacitor 903 even when the transistor 901 is off. Therefore, a current continues to be supplied to the light-emitting element 904 even when the transistor 901 is off.

Note that at least one of a transistor and a capacitor can be additionally provided in the pixel in FIG. 22B to compensate the threshold voltage or mobility of the transistor 902.

The configuration of the pixel illustrated in each of FIGS. 22A and 22B can be employed in the display devices illustrated in FIGS. 21A to 21E. Moreover, the pixels in FIGS. 22A and 22B can be used as a load connected to the circuit illustrated in FIG. 1A, FIG. 6, or the like.

(Structure of Pixel According to One Embodiment)

Figure 23A:
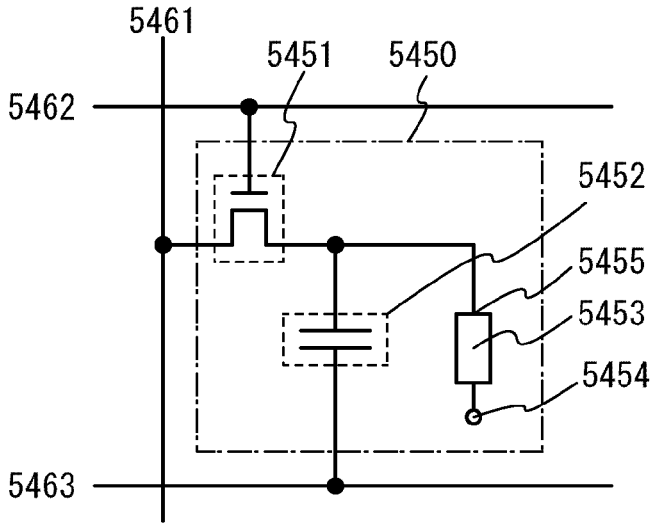
FIG. 23A illustrates an example of a circuit diagram of a pixel in a display device according to one embodiment.

FIG. 23A illustrates an example of a circuit diagram of a pixel that can be applied to any of the above-described display devices. A pixel 5450 includes a transistor 5451, a capacitor 5452, and a display element 5453. A first terminal of the transistor 5451 is connected to a wiring 5461. A second terminal of the transistor 5451 is connected to one of electrodes of the capacitor 5452 and one of electrodes of the display element 5453 (also referred to as a pixel electrode). A gate of the transistor 5451 is connected to a wiring 5462. The other of the electrodes of the capacitor 5452 is connected to a wiring 5463. The other of the electrodes of the display element 5453 is connected to an electrode 5454 (also referred to as a common electrode, a counter electrode, or a cathode electrode). Note that one of the electrodes of the display element 5453 is referred to as an electrode 5455.

The display element 5453 preferably has memory properties. Examples of the display element 5453 and a method for driving the display element 5453 are microcapsule electrophoresis, microcup electrophoresis, horizontal electrophoresis, vertical electrophoresis, twisting ball, liquid powder display, electronic liquid powder (registered trademark), a cholesteric liquid crystal element, chiral nematic liquid crystal, anti-ferroelectric liquid crystal, polymer dispersed liquid crystal, charged toner, electrowetting, electrochromism, and electrodeposition.

Figure 23B:
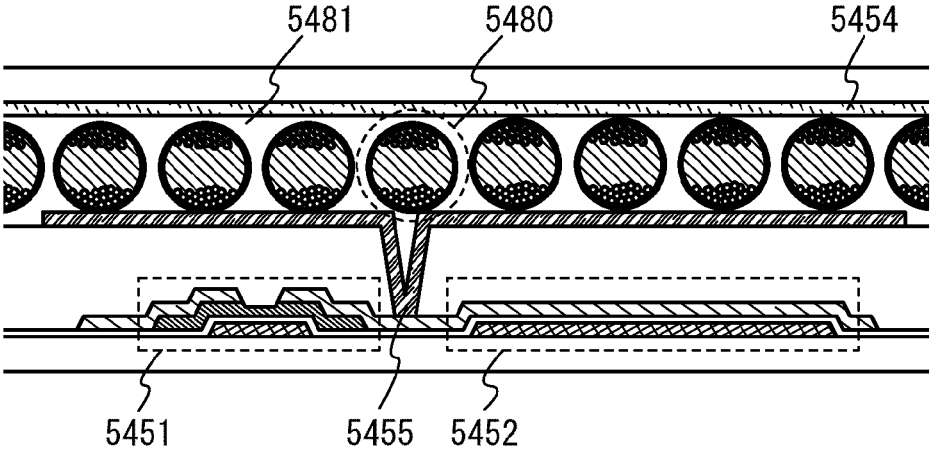
FIG. 23B illustrates an example of a structure of a pixel.

FIG. 23B is a cross-sectional view of a pixel using microcapsule electrophoresis. A plurality of microcapsules 5480 are placed between an electrode 5454 and an electrode 5455. The plurality of microcapsules 5480 are fixed by a resin 5481. The resin 5481 functions as a binder. The resin 5481 preferably has light-transmitting properties. A space formed by the electrode 5454, the electrode 5455, and the microcapsule 5480 can be filled with a gas such as air or an inert gas. In such a case, a layer including a glue, an adhesive, or the like is preferably formed on one or both of the electrodes 5454 and 5455 to fix the microcapsules 5480. At least two kinds of particles composed of pigments are included in the microcapsules 5480. The particles of one kind preferably have a different color from the particles of the other kind. For example, the microcapsule 5480 includes particles composed of a black pigment and particles composed of a white pigment.

Figure 24A:
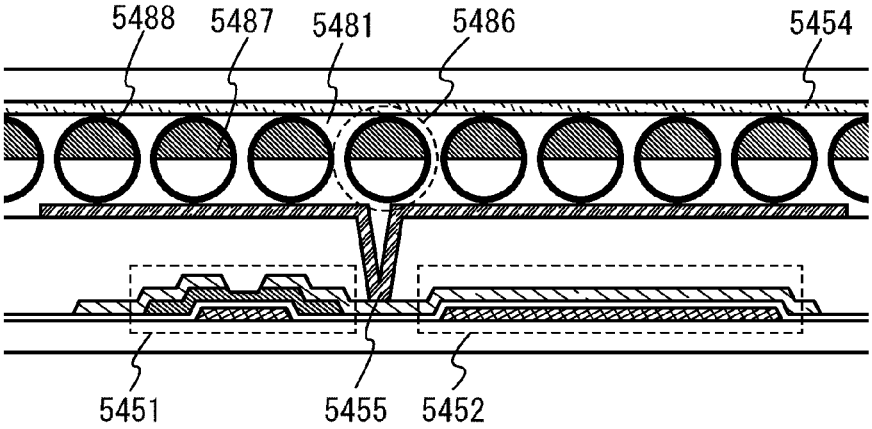
FIGS. 24A to 24C each illustrate an example of a structure of a pixel in a display device according to one embodiment.

FIG. 24A is a cross-sectional view of a pixel in the case where a twisting ball display method is used for the display element 5453. In the twisting ball display method, the reflectance is changed by rotation of a display element in order to control the gray level. The difference from FIG. 23B is that instead of the microcapsule 5480, a twisting ball 5486 is placed between the electrode 5454 and the electrode 5455. The twisting ball 5486 includes a particle 5487 and a cavity 5488 formed around the particle 5487. The particle 5487 is a spherical particle in which a surface of one hemisphere is colored in a given color and a surface of the other hemisphere is colored in a different color. Here, the particle 5487 has a white hemisphere and a black hemisphere. Note that there is a difference in electric charge density between the two hemispheres. For that reason, by generating a potential difference between the electrode 5454 and the electrode 5455, the particle 5487 can be rotated in accordance with the direction of electric fields. The cavity 5488 is filled with a liquid. As the liquid, a liquid similar to the liquid 5483 can be used. Note that the structure of the twisting ball 5486 is not limited to the structure illustrated in FIG. 24A. For example, the twisting ball 5486 can be a cylinder, an ellipse, or the like.

Figure 24B:
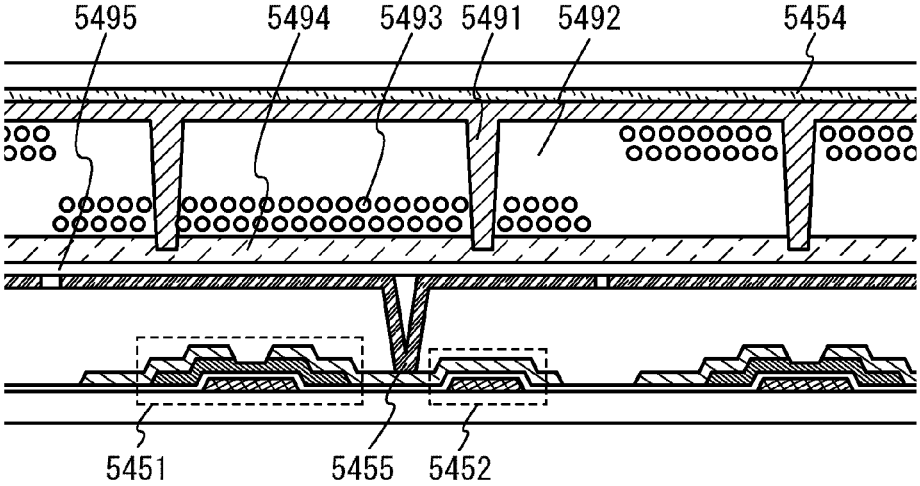

FIG. 24B is a cross-sectional view of a pixel in the case where a microcup electrophoresis method is used for the display element 5453. A microcup array can be formed in the following manner: a microcup 5491 that is formed using a UV curable resin or the like and has a plurality of recessed portions is filled with charged pigment particles 5493 dispersed in a dielectric solvent 5492, and sealing is performed with a sealing layer 5494. An adhesive layer 5495 is preferably formed between the sealing layer 5494 and the electrode 5455. As the dielectric solvent 5492, a colorless solvent can be used or a colored solvent of red, blue, or the like can be used. This embodiment shows the case where one kind of charged pigment particles is used; alternatively, two or more kinds of charged pigment particles may be used. The microcup has a wall by which cells are separated, and thus has sufficiently high resistance to shock and pressure. Moreover, since the components of the microcup are tightly sealed, adverse effects due to change in environment can be reduced.

Figure 24C:
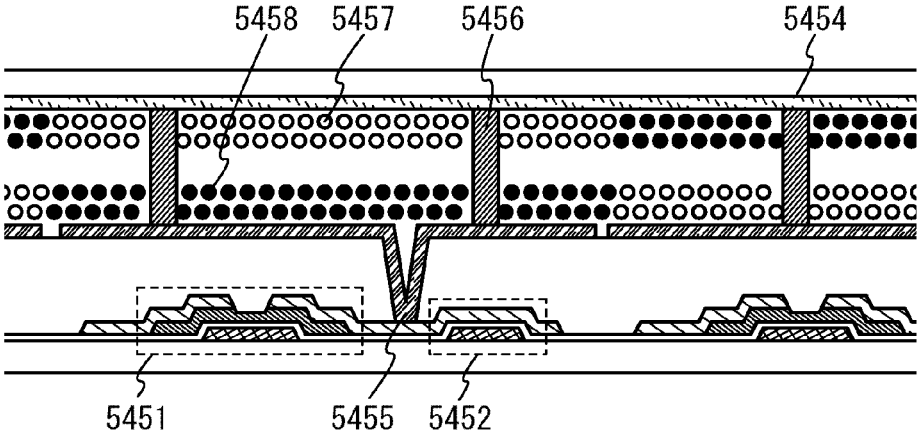

FIG. 24C is a cross-sectional view of a pixel in the case where an electronic liquid powder (registered trademark) display method is used for the display element 5453. Liquid powder used here has fluidity and is a substance having properties of fluid and properties of a particle. In this method, cells are separated by partitions 5456, and liquid powders 5457 and liquid powders 5458 are placed in the cell. As the liquid powder 5457 and the liquid powder 5458, a white particle and a black particle are preferably used. Note that the kinds of the liquid powders 5457 and 5458 are not limited thereto. For example, colored particles of two colors which are not white and black can be used as the liquid powders 5457 and 5458. As another example, one of the liquid powder 5457 and the liquid powder 5458 can be omitted.

As illustrated in FIG. 23A, a signal is input to the wiring 5461. Specifically, a signal for controlling the gray level of the display element 5453 (e.g., a video signal) is input to the wiring 5461. Accordingly, the wiring 5461 has a function of a signal line or a source signal line (also referred to as a video signal line or a source line). A signal is input to the wiring 5462. Specifically, a signal for controlling a conduction state of the transistor 5451 (e.g., a gate signal, a scan signal, or a selection signal) is input to the wiring 5462. Accordingly, the wiring 5462 has a function of a signal line or a gate signal line (also referred to as a scan signal line or a gate line). A predetermined voltage is supplied to the wiring 5463. The wiring 5463 is connected to the capacitor 5452. Accordingly, the wiring 5463 has a function of a power supply line or a capacitor line. A predetermined voltage is supplied to the electrode 5454. The electrode 5454 is shared with a plurality of pixels or all the pixels. Accordingly, the electrode 5454 has a function of a common electrode (also referred to as a counter electrode or a cathode electrode).

Note that the signals or voltages input to the wirings 5461 to 5463 and the electrode 5454 are not limited to the above, and various other signals or voltages can be input. For example, a signal can be input to the wiring 5463. Thus, the potential of the electrode 5455 can be controlled, so that the amplitude voltage of a signal input to the wiring 5461 can be reduced. Accordingly, the wiring 5463 can have a function of a signal line. As another example, by changing a voltage supplied to the electrode 5454, a voltage applied to the display element 5453 can be adjusted. Thus, the amplitude voltage of a signal input to the wiring 5461 can be reduced.

The transistor 5451 has a function of controlling electrical continuity between the wiring 5461 and the electrode 5455, a function of controlling the timing of supplying the potential of the wiring 5461 to the electrode 5455, and/or a function of controlling the timing of selecting the pixel 5450. In such a manner, the transistor 5451 has a function of a switch or a selection transistor. The transistor 5451 is an n-channel transistor. For that reason, the transistor 5451 is turned on when an H signal is input to the wiring 5462, and is turned off when an L signal is input to the wiring 5462. Note that transistor 5451 is not limited to an n-channel transistor and can be a p-channel transistor. In that case, the transistor 5451 is turned on when an L signal is input to the wiring 5462, and is turned off when an H signal is input to the wiring 5462. The capacitor 5452 has a function of holding the potential difference between the electrode 5455 and the wiring 5463, and/or a function of keeping the potential of the electrode 5455 at a predetermined value. Thus, a voltage can continue to be applied to the display element 5453 even when the transistor 5451 is off. In such a manner, the capacitor 5452 has a function of a storage capacitor. Note that functions of the transistor 5451 and the capacitor 5452 are not limited to the above, and the transistor 5451 and the capacitor 5452 can have various other functions.

Next, operation of the pixel in FIG. 23A will be roughly described. The gray level of the display element 5453 is controlled by applying a voltage to the display element 5453 so that an electric field is generated in the display element 5453. A voltage applied to the display element 5453 is controlled by controlling the potential of the electrode 5454 and the potential of the electrode 5455. Specifically, the potential of the electrode 5454 is controlled by controlling a voltage applied to the electrode 5454. The potential of the electrode 5455 is controlled by controlling a signal input to the wiring 5461. The signal input to the wiring 5461 is supplied to the electrode 5455 when the transistor 5451 is turned on.

Note that the gray level of the display element 5453 can be controlled by controlling at least one of the intensity of electric fields applied to the display element 5453, the direction of electric fields applied to the display element 5453, the time during which electric fields are applied to the display element 5453, and the like. Note that the gray level of the display element 5453 can be maintained by not generating a potential difference between the electrode 5454 and the electrode 5455.

Figure 25A:
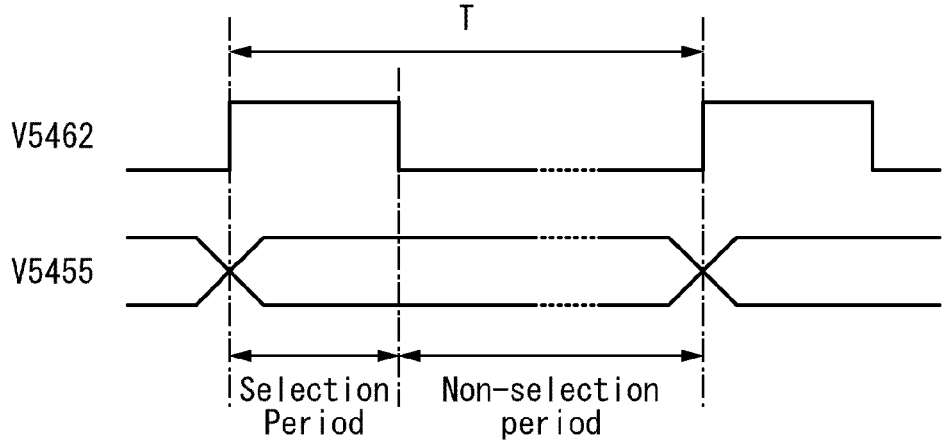
FIGS. 25A to 25C each illustrate an example of a timing chart for explaining operation of a pixel in a display device according to one embodiment.

Next, an example of operation of the pixel will be described. The timing chart in FIG. 25A shows a period T including a selection period and a non-selection period. The period T is a period from the start of a selection period until the start of the next selection period.

In the selection period, an H signal is input to the wiring 5462, so that the potential of the wiring 5462 (shown as a potential V5462) is at H level. For that reason, the transistor 5451 is turned on, so that electrical continuity is established between the wiring 5461 and the electrode 5455. Thus, a signal input to the wiring 5461 is supplied to the electrode 5455 via the transistor 5451, and the potential of the electrode 5455 (shown as a potential V5455) becomes a value equal to the signal input to the wiring 5461. At this time, the capacitor 5452 holds a potential difference between the electrode 5455 and the wiring 5463. In the non-selection period, an L signal is input to the wiring 5462, so that the potential of the wiring 5462 is at L level. For that reason, the transistor 5451 is turned off, and electrical continuity between the wiring 5461 and the electrode 5455 is broken. Then, the electrode 5455 is set in a floating state. At this time, the capacitor 5452 holds the potential difference in the selection period between the electrode 5455 and the wiring 5463. For that reason, the potential of the electrode 5455 remains equal to the signal input to the wiring 5461 in the selection period. In such a manner, in the non-selection period, a voltage can continue to be applied to the display element 5453 even when the transistor 5451 is off As described above, by controlling a signal input to the wiring 5461 in the selection period, a voltage applied to the display element 5453 can be controlled. That is, the gray level of the display element 5453 can be controlled by controlling a signal input to the wiring 5461 in the selection period.

The potential of the electrode 5455 in the non-selection period may be different from the signal input to the wiring 5461 in the selection period because of adverse effects of at least one of the off-state current of the transistor 5451, feedthrough of the transistor 5451, charge injection of the transistor 5451, and the like.

Figure 25B:
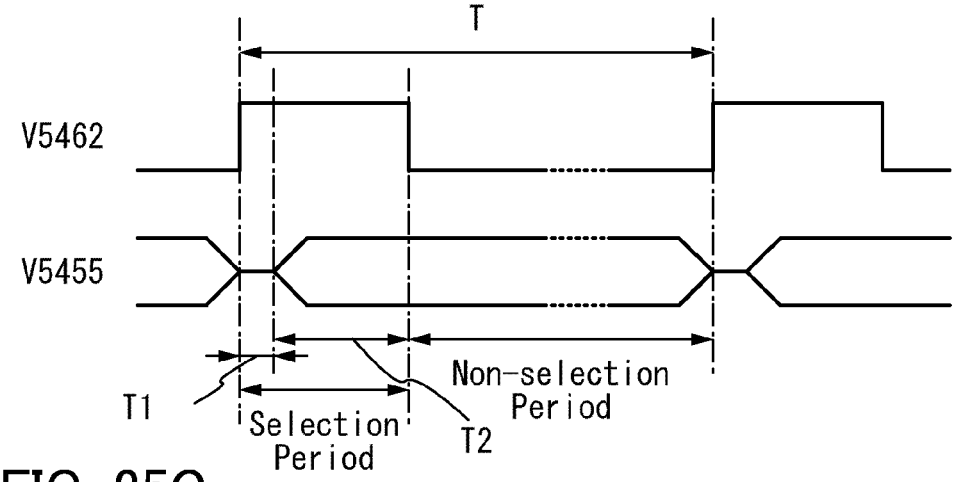

As illustrated in FIG. 25B, the potential of the electrode 5455 can be equal to that of the electrode 5454 in part of the selection period. Accordingly, even if the same signal continues to be input to the pixel 5450 every time the pixel 5450 is selected, the intensity of electric fields applied to the display element 5453 can be changed by changing the potential of the electrode 5455 in part of the selection period. Therefore, afterimages can be reduced; the response speed can be increased; or variations in response speed between pixels can be reduced so that unevenness or afterimages can be prevented. In order to realize such a driving method, the selection period is preferably divided into a period T1 and a period T2. In the period T1, the potential of the signal input to the wiring 5461 is preferably equal to that of the electrode 5454. In the period T2, the signal input to the wiring 5461 preferably has various values in order to control the gray level of the display element 5453. Note that when the period T1 is too long, the time during which a signal for controlling the gray level of the display element 5453 is written into the pixel 5450 becomes short. Therefore, the period T1 is preferably shorter than the period T2. Specifically, the period T1 accounts for preferably 1 to 20%, more preferably 3 to 15%, further preferably 5 to 10% of the selection period.

Figure 25C:
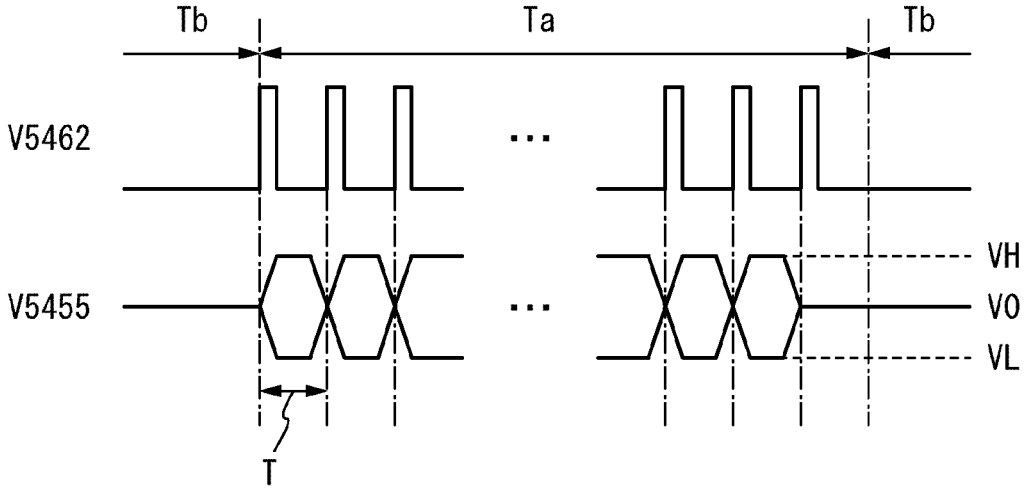

Next described is an example of operation of the pixel in this embodiment, in which the gray level of the display element 5453 is controlled by the time during which a voltage is applied to the display element 5453. The timing chart in FIG. 25C shows a period Ta and a period Tb. The period Ta includes N periods T (N is a natural number). The N periods T are similar to the period T illustrated in FIG. 25A or FIG. 25B. The period Ta is a period for changing the gray level of the display element 5453 (e.g., an address period, a writing period, or an image rewriting period). The period Tb is a period during which the gray level of the display element 5453 in the period Ta is held (i.e., a holding period).

A voltage V0 is supplied to the electrode 5454, so that the electrode 5454 is at a potential V0. A signal having at least three values is input to the wiring 5461. Three potentials of the signal are a potential VH (VH>V0), the potential V0, and a potential VL (VL<V0). Accordingly, the potential VH, the potential V0, and the potential VL are selectively applied to the electrode 5455.

In each of the N periods T in the period Ta, by controlling a potential applied to the electrode 5455, a voltage applied to the display element 5453 can be controlled. For example, when the potential VH is applied to the electrode 5455, the potential difference between the electrode 5454 and the electrode 5455 becomes VH−V0. Thus, a positive voltage can be applied to the display element 5453. When the potential V0 is applied to the electrode 5455, the potential difference between the electrode 5454 and the electrode 5455 becomes zero. Thus, zero voltage can be applied to the display element 5453. When the potential VL is applied to the electrode 5455, the potential difference between the electrode 5454 and the electrode 5455 becomes VL−V0. Thus, a negative voltage can be applied to the display element 5453. As described above, in the period Ta, a positive voltage (VH−V0), a negative voltage (VL−V0), and zero voltage can be applied to the display element 5453 in a variety of orders. Thus, the gray level of the display element 5453 can be minutely controlled; afterimages can be reduced; or the response speed can be increased.

Note that when a positive voltage is applied to the display element 5453, the gray level of the display element 5453 is close to black (also referred to as a first gray level). When a negative voltage is applied to the display element 5453, the gray level of the display element 5453 is close to white (also referred to as a second gray level). When zero voltage is applied to the display element 5453, the gray level of the display element 5453 is maintained.

In the period Tb, a signal input to the wiring 5461 is not written into the pixel 5450. Therefore, a potential applied to the electrode 5455 in the N-th period T in the period Ta continues to be applied in the period Tb. Specifically, in the period Tb, the gray level of the display element 5453 is preferably maintained by not generating electric fields in the display element 5453. For that reason, in the N-th period T in the period Ta, the potential V0 is preferably applied to the electrode 5455. Thus, the potential V0 is applied to the electrode 5455 also in the period Tb, so that zero voltage is applied to the display element 5453. In such a manner, the gray level of the display element 5453 can be maintained.

As the gray level to be subsequently expressed by the display element 5453 is closer to the first gray level, the time during which the potential VH is applied to the electrode 5455 is preferably longer in the period Ta. Alternatively, the frequency of application of the potential VH to the electrode 5455 is preferably higher in the N periods T. Alternatively, in the period Ta, it is preferable to increase a time obtained by subtracting the time during which the potential VL is applied to the electrode 5455 from the time during which the potential VH is applied to the electrode 5455. Further alternatively, in the N periods T, it is preferable to increase a frequency obtained by subtracting the frequency of application of the potential VL to the electrode 5455 from the frequency of application of the potential VH to the electrode 5455.

As the gray level to be subsequently expressed by the display element 5453 is closer to the second gray level, the time during which the potential VL is applied to the electrode 5455 is preferably longer in the period Ta. Alternatively, the frequency of application of the potential VL to the electrode 5455 is preferably higher in the N periods T. Alternatively, in the period Ta, it is preferable to increase a time obtained by subtracting the time during which the potential VH is applied to the electrode 5455 from the time during which the potential VL is applied to the electrode 5455. Further alternatively, in the N periods T, it is preferable to increase a frequency obtained by subtracting the frequency of application of the potential VH to the electrode 5455 from the frequency of application of the potential VL to the electrode 5455.

In the period Ta, a combination of potentials (the potential VH, the potential V0, and the potential VL) applied to the electrode 5455 can depend not only on the gray level to be subsequently expressed by the display element 5453, but also on the gray level that has been expressed by the display element 5453. For that reason, if a different gray level has been expressed by the display element 5453, a combination of potentials applied to the electrode 5455 may vary even when the gray level to be subsequently expressed by the display element 5453 is the same.

For example, in the period Ta for expressing the gray level that has been expressed by the display element 5453, the time during which the potential VL is applied to the electrode 5455 is preferably longer in the period Ta in any of the following cases: the case where the time during which the potential VH is applied to the electrode 5455 is longer; the case where a time obtained by subtracting the time during which the potential VL is applied to the electrode 5455 from the time during which the potential VH is applied to the electrode 5455 is longer; the case where the frequency of application of the potential VH to the electrode 5455 is higher in the N periods T; or the case where a frequency obtained by subtracting the frequency of application of the potential VL to the electrode 5455 from the frequency of application of the potential VH to the electrode 5455 is higher in the N periods T. Alternatively, the frequency of application of the potential VL to the electrode 5455 is preferably higher in the N periods T. Alternatively, in the period Ta, it is preferable to increase a time obtained by subtracting the time during which the potential VH is applied to the electrode 5455 from the time during which the potential VL is applied to the electrode 5455. Further alternatively, in the N periods T, it is preferable to increase a frequency obtained by subtracting the frequency of application of the potential VH to the electrode 5455 from the frequency of application of the potential VL to the electrode 5455. In such a manner, afterimages can be reduced.

As another example, in the period Ta for expressing the gray level that has been expressed by the display element 5453, the time during which the potential VH is applied to the electrode 5455 is preferably longer in the period Ta in any of the following cases: the case where the time during which the potential VL is applied to the electrode 5455 is longer; the case where a time obtained by subtracting the time during which the potential VH is applied to the electrode 5455 from the time during which the potential VL is applied to the electrode 5455 is longer; the case where the frequency of application of the potential VL to the electrode 5455 is higher in the N periods T; or the case where a frequency obtained by subtracting the frequency of application of the potential VH to the electrode 5455 from the frequency of application of the potential VL to the electrode 5455 is higher in the N periods T. Alternatively, the frequency of application of the potential VH to the electrode 5455 is preferably higher in the N periods T. Alternatively, in the period Ta, it is preferable to increase a time obtained by subtracting the time during which the potential VL is applied to the electrode 5455 from the time during which the potential VH is applied to the electrode 5455. Further alternatively, in the N periods T, it is preferable to increase a frequency obtained by subtracting the frequency of application of the potential VL to the electrode 5455 from the frequency of application of the potential VH to the electrode 5455. In such a manner, afterimages can be reduced.

The N periods T have the same length; however, the length of the N periods T is not limited thereto and the lengths of at least two of the N periods T can be different from each other. It is particularly preferable that the length of the N periods T be weighted. For example, in the case where N is 4 and the length of the first period T is denoted by a time h, the length of the second period T is preferably a time h×2, the length of the third period T is preferably a time h×4, and the length of the fourth period T is preferably a time h×8. When the length of the N periods T is weighted in such a manner, the frequency of selection of the pixels 5450 can be reduced and the time during which a voltage is applied to the display element 5453 can be minutely controlled. Thus, power consumption can be reduced.

The potential VH and the potential VL can be selectively applied to the electrode 5454. In this case, it is preferable that the potential VH and the potential VL be selectively applied also to the electrode 5455. For example, in the case where the potential VH is applied to the electrode 5454, zero voltage is applied to the display element 5453 when the potential VH is applied to the electrode 5455, whereas a negative voltage is applied to the display element 5453 when the potential VL is applied to the electrode 5455. On the other hand, in the case where the potential VL is applied to the electrode 5454, a positive voltage is applied to the display element 5453 when the potential VH is applied to the electrode 5455, whereas zero voltage is applied to the display element 5453 when the potential VL is applied to the electrode 5455. In such a manner, the signal input to the wiring 5461 can have two values (i.e., the signal can be a digital signal). For that reason, it is possible to simplify a circuit that outputs a signal to the wiring 5461.

In the period Tb or part of the period Tb, it is possible not to input a signal to the wiring 5461 and the wiring 5462. That is, the wiring 5461 and the wiring 5462 can be set in a floating state. Moreover, in the period Tb or part of the period Tb, it is possible not to input a signal to the wiring 5463. That is, the wiring 5463 can be set in a floating state. Furthermore, in the period Tb or part of the period Tb, it is possible not to supply a voltage to the electrode 5454. That is, the electrode 5454 can be set in a floating state.

The pixel illustrated in FIG. 23A can be used in the display devices illustrated in FIGS. 21A to 21E. The pixel in FIG. 23A can be used as a load connected to the circuit illustrated in FIG. 1A, FIG. 6, or the like. The pixel in FIG. 23A includes a display element with memory properties. For that reason, the pixel in FIG. 23A and the shift register circuit in FIG. 19 are preferably used in combination. In the case where the pixel in FIG. 23A is driven with the shift register circuit in FIG. 19, a video signal can be input to a pixel only when the gray level is to be changed. On the other hand, when the gray level is not changed, the gray level can be maintained for a long time without a video signal input to the pixel, because the display element has memory properties.

(Structure of Pixel According to One Embodiment)

Figure 26A:
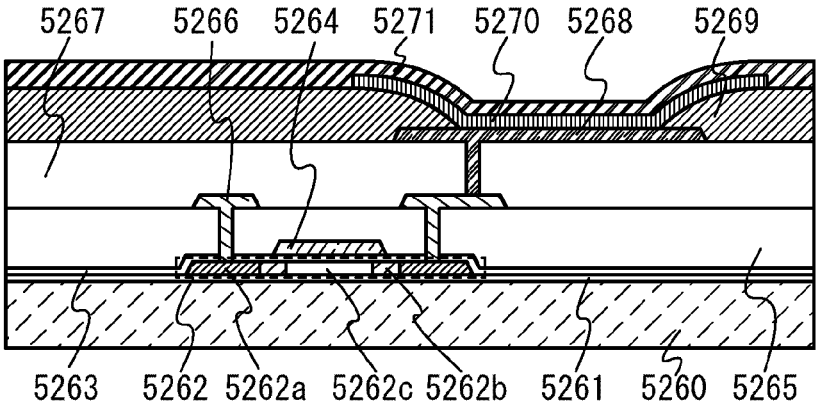
FIGS. 26A to 26C each illustrate an example of a structure of a pixel in a display device according to one embodiment.

As an example of the structure of the above-described pixel, FIG. 26A illustrates an example of a top-gate transistor and an example of a display element formed over the transistor. The structure of the transistor in FIG. 26A will be described below. The transistor in FIG. 26A includes a substrate 5260, an insulating layer 5261 (e.g., a base film), a semiconductor layer 5262, an insulating layer 5263 (e.g., a gate insulating film), a conductive layer 5264 (e.g., a gate electrode or a wiring), an insulating layer 5265 (e.g., an interlayer film or a planarization film) having opening portions, and a conductive layer 5266 (e.g., a source electrode of the transistor, a drain electrode of the transistor, an electrode of the capacitor, or a wiring). The insulating layer 5261 is formed over the substrate 5260. The semiconductor layer 5262 is formed over the insulating layer 5261. The insulating layer 5263 is formed so as to cover the semiconductor layer 5262. The conductive layer 5264 is formed over the semiconductor layer 5262 and the insulating layer 5263. The insulating layer 5265 is formed over the insulating layer 5263 and the conductive layer 5264. The conductive layer 5266 is formed over the insulating layer 5265 and in the opening portions formed in the insulating layer 5265.

The semiconductor layer 5262 includes a region 5262*a*, a region 5262*b*, and a region 5262*c*. The region 5262*a* is a region to which an impurity is added, and has a function of a source region or a drain region. The region 5262*b* is a region to which an impurity is added at a lower concentration than the region 5262*a*, and has a function of an LDD (lightly doped drain) region. The region 5262*c* is a region to which an impurity is not added, and has a function of a channel region. Note that an impurity can be added to the region 5262*c*. Thus, characteristics of the transistor can be improved or the threshold voltage can be controlled. Note that the concentration of the impurity added to the region 5262*c* is preferably lower than that of the impurity added to the region 5262*a* and the region 5262*b*. Thus, the off-state current can be reduced. Note that the region 5262*b* can be omitted.

Figure 26B:
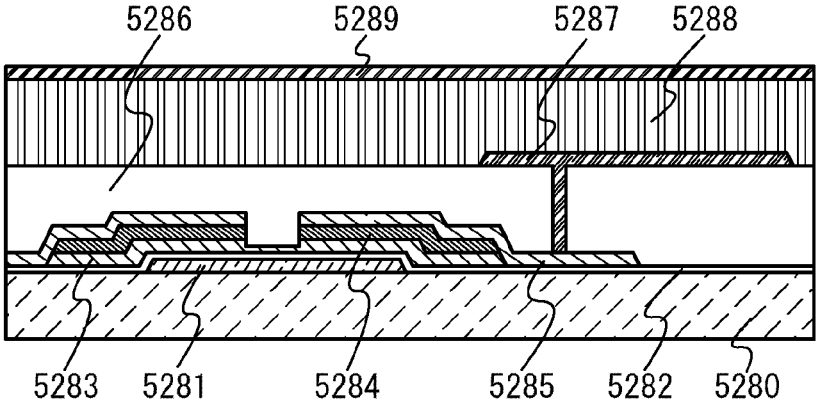

FIG. 26B illustrates an example of a bottom-gate transistor and an example of a display element formed over the transistor. The structure of the transistor in FIG. 26B will be described below. The transistor in FIG. 26B includes a substrate 5280, a conductive layer 5281 (e.g., a gate electrode or a wiring), an insulating layer 5282 (e.g., a gate insulating film), a semiconductor layer 5283, a semiconductor layer 5284, and a conductive layer 5285 (e.g., a source electrode of the transistor, a drain electrode of the transistor, an electrode of the capacitor, or a wiring). The conductive layer 5281 is formed over the substrate 5280. The insulating layer 5282 is formed so as to cover the conductive layer 5281. The semiconductor layer 5283 is formed over the conductive layer 5281 and the insulating layer 5282. The semiconductor layer 5284 is formed over the semiconductor layer 5283. The conductive layer 5285 is formed over the semiconductor layer 5284 and the insulating layer 5282.

An impurity (e.g., phosphorus) is added to the semiconductor layer 5284, so that the semiconductor layer 5284 has n-type conductivity. The semiconductor layer 5283 is preferably intrinsic or close to intrinsic. Alternatively, the semiconductor layer 5283 preferably has a lower impurity concentration than the semiconductor layer 5284.

Figure 26C:
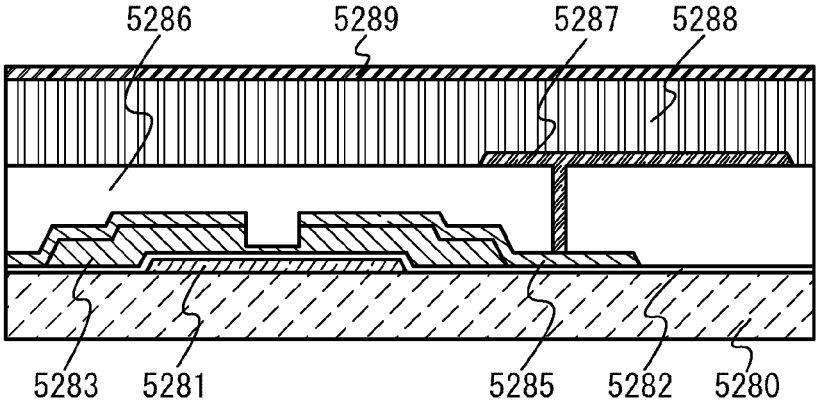

When an oxide semiconductor or a compound semiconductor is used for the semiconductor layer 5283, the semiconductor layer 5284 is preferably omitted (see FIG. 26C).

Here, a variety of layers can be provided over the transistors illustrated in FIGS. 26A to 26C. Some examples will be described below.

For example, over the transistors illustrated in FIGS. 26A to 26C, an insulating layer 5267 (e.g., an interlayer film or a partition) having an opening portion, a conductive layer 5268 (e.g., a pixel electrode, a counter electrode, or a wiring), an insulating layer 5269 (e.g., a partition) having an opening portion, a light-emitting layer 5270, and a conductive layer 5271 (e.g., a common electrode or a counter electrode) can be provided (see FIG. 26A). The insulating layer 5267 is formed over the conductive layer 5266 and the insulating layer 5265. The conductive layer 5268 is formed over the insulating layer 5267 and in the opening portion formed in the insulating layer 5267. The insulating layer 5269 is formed over the insulating layer 5267 and the conductive layer 5268. The light-emitting layer 5270 is formed over the insulating layer 5269 and in the opening portion formed in the insulating layer 5269. The conductive layer 5271 is formed over the insulating layer 5269 and the light-emitting layer 5270.

As another example, over the transistors illustrated in FIGS. 26A to 26C, an insulating layer 5286 (e.g., an interlayer film or a planarization film) having an opening portion, a conductive layer 5287 (e.g., a pixel electrode, a counter electrode, or a wiring), a liquid crystal layer 5288, and a conductive layer 5289 (e.g., a common electrode or a counter electrode) can be provided. The insulating layer 5286 is formed over the insulating layer 5282 and the conductive layer 5285. The conductive layer 5287 is formed over the insulating layer 5286 and in the opening portion formed in the insulating layer 5286. The liquid crystal layer 5288 is formed over the insulating layer 5286 and the conductive layer 5287. The conductive layer 5289 is formed over the liquid crystal layer 5288. Note that at least one of an alignment film and a protrusion can be provided over the insulating layer 5286 and the conductive layer 5287. Moreover, at least one of a protrusion, a color filter, and a black matrix can be provided over the conductive layer 5289. An alignment film can be provided below the conductive layer 5289.

Examples of a material for the semiconductor layer are a non-single-crystal semiconductor (e.g., amorphous silicon, polycrystalline silicon, and microcrystalline silicon), a single crystal semiconductor (e.g., single crystal silicon), a compound semiconductor (e.g., SiGe and GaAs), an oxide semiconductor (e.g., ZnO, InGaZnO, IZO (indium zinc oxide), ITO (indium tin oxide), SnO, TiO, and AlZnSnO (AZTO)), an organic semiconductor, and a carbon nanotube.

An oxide semiconductor material will be described in detail. Examples of the oxide semiconductor are an In—Sn—Ga—Zn—O-based oxide semiconductor which is an oxide of four metal elements; an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor which are oxides of three metal elements; an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, and an In—Mg—O-based oxide semiconductor which are oxides of two metal elements; and an In—O-based oxide semiconductor, a Sn—O-based oxide semiconductor, and a Zn—O-based oxide semiconductor. In particular, an In—Ga—Zn—O-based oxide semiconductor material has sufficiently high resistance when there is no electric field and can realize a sufficiently small off-state current. Moreover, the In—Ga—Zn—O-based oxide semiconductor material has high field-effect mobility and thus is suitable for a transistor.

Note that a typical example of the In—Ga—Zn—O-based oxide semiconductor material is an oxide semiconductor material represented by $InGaO_3(ZnO)_m$ (m is larger than 0 and is not a natural number). Moreover, there is an oxide semiconductor material represented by $InMO_3(ZnO)_m$ (m is larger than 0 and is not a natural number), using M instead of Ga. Here, M denotes one or more metal elements selected from gallium (Ga), aluminum (Al), iron (Fe), nickel (Ni), manganese (Mn), cobalt (Co), and the like. For example, M may be Ga, Ga and Al, Ga and Fe, Ga and Ni, Ga and Mn, or Ga and Co. Note that the above-described compositions are derived from the crystal structures that the oxide semiconductor material can have and are mere examples. The hydrogen concentration of an oxide semiconductor layer is preferably $5\times10^{19}$ (atoms/cm$^3$) or less.

The field-effect mobility of a transistor including the above oxide semiconductor can be 1 cm$^2$/Vsec or higher, preferably 10 cm$^2$/Vsec or higher; thus, a pixel circuit can operate even when the display screen has high definition. Moreover, the signal processing circuit according to one embodiment can be constituted by such transistors.

(Various Devices According to One Embodiment)

FIGS. 27A to 27H and FIGS. 28A to 28D each illustrate an electronic device. These electronic devices can include a housing 5000, a display portion 5001, a speaker 5003, an LED lamp 5004, operation keys 5005 (including a power switch or an operation switch), a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared ray), a microphone 5008, and the like.

Figure 27A:
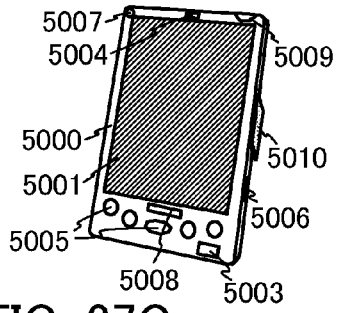
FIGS. 27A to 27H each illustrate an example of a mode of a device embodying a technical idea of the present invention.
Figure 27B:
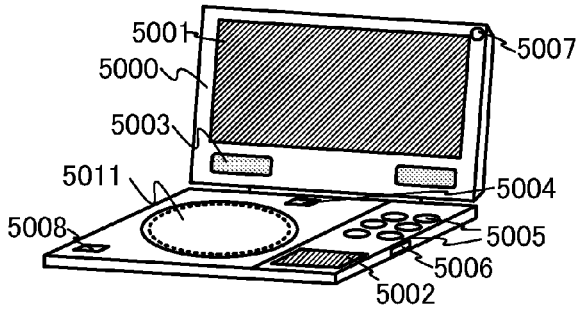
Figure 27C:
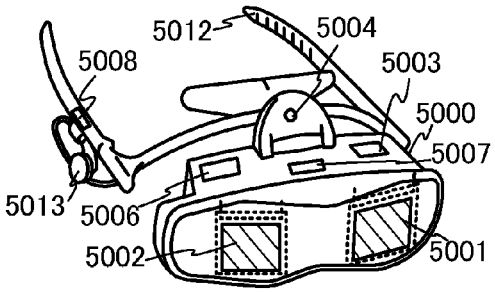
Figure 27D:
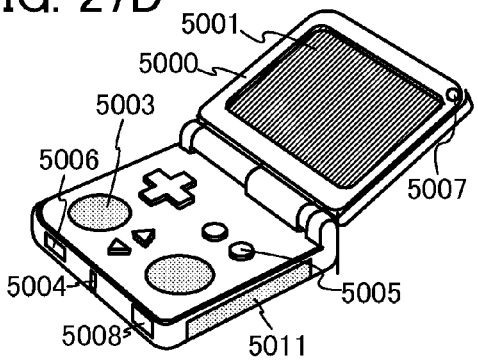
Figure 27E:
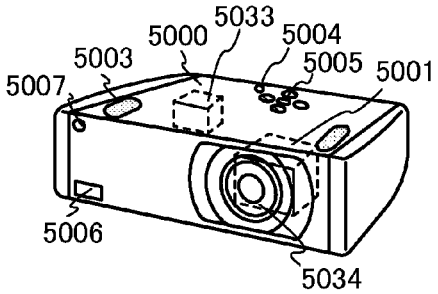
Figure 27F:
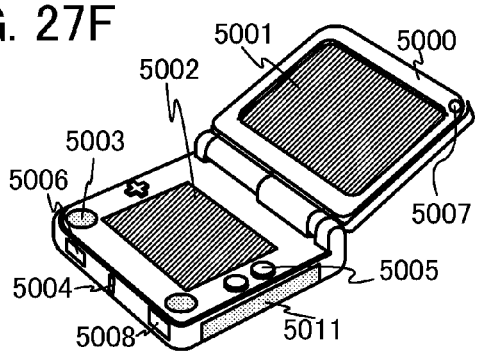
Figure 27G:
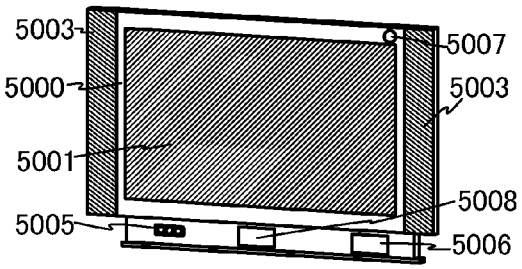
Figure 27H:
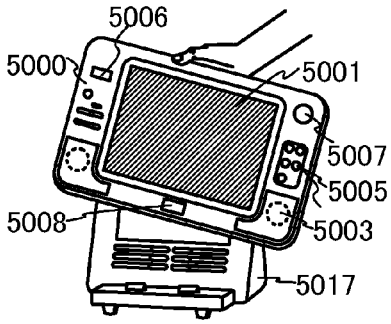
Figure 28A:
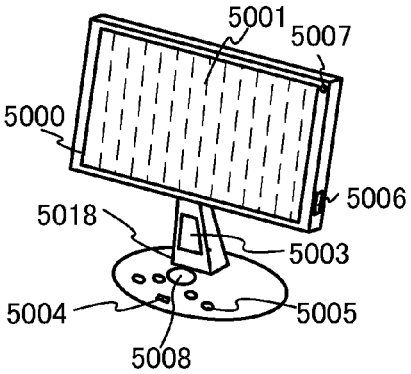
FIGS. 28A to 28H each illustrate an example of a mode of a device embodying a technical idea of the present invention.
Figure 28B:
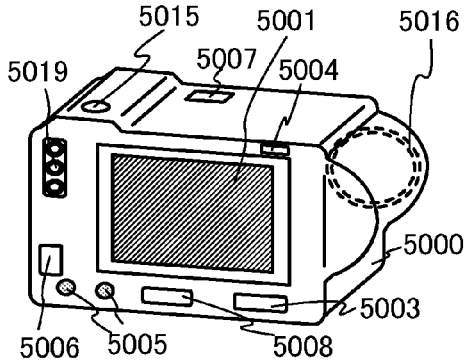
Figure 28C:
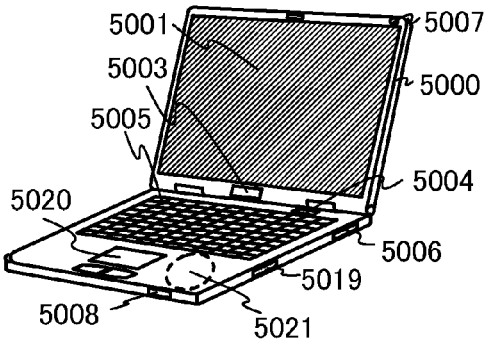
Figure 28D:
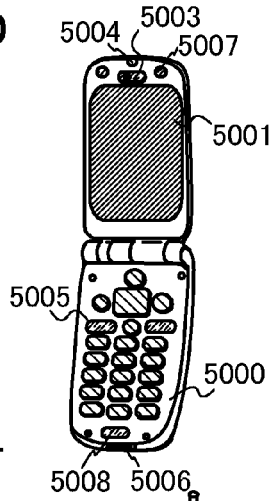

FIG. 27A illustrates a mobile computer that can include a switch 5009, an infrared port 5010, and the like in addition to the above-described components. FIG. 27B illustrates a portable image reproducing device (e.g., a DVD reproducing device) provided with a memory medium, and the image reproducing device can include a second display portion 5002, a memory medium reading portion 5011, and the like in addition to the above components. FIG. 27C illustrates a goggle-type display that can include second display portion 5002, a support portion 5012, an earphone 5013, and the like in addition to the above components. FIG. 27D illustrates a portable game machine that can include the memory medium reading portion 5011 and the like in addition to the above components. FIG. 27E illustrates a projector that can include a light source 5033, a projector lens 5034, and the like in addition to the above components. FIG. 27F illustrates a portable game machine that can include the second display portion 5002, the memory medium reading portion 5011, and the like in addition to the above components. FIG. 27G illustrates a television set that can include a tuner, an image processing portion, and the like in addition to the above components. FIG. 27H illustrates a portable television receiver that can include a charger 5017 capable of transmitting and receiving signals and the like in addition to the above components. FIG. 28A illustrates a display that can include a support base 5018 and the like in addition to the above-described components. FIG. 28B illustrates a camera that can include an external connection port 5019, a shutter button 5015, an image receiving portion 5016, and the like in addition to the above components. FIG. 28C illustrates a computer that can include a pointing device 5020, the external connection port 5019, a reader/writer 5021, and the like in addition to the above components. FIG. 28D illustrates a mobile phone that can include an antenna 5014, a tuner of one-segment (1 seg digital TV broadcasts) partial reception service for mobile phones and mobile terminals, and the like in addition to the above components.

The electronic devices illustrated in FIGS. 27A to 27H and FIGS. 28A to 28D can have a variety of functions, for example, a function of displaying a variety of information (a still image, a moving image, a text image, and the like) on a display portion; a touch panel function; a function of displaying a calendar, date, time, and the like; a function of controlling process with a variety of software (programs); a wireless communication function; a function of being connected to a variety of computer networks with a wireless communication function; a function of transmitting and receiving a variety of data with a wireless communication function; and a function of reading a program or data stored in a memory medium and displaying the program or data on a display portion. Further, the electronic device including a plurality of display portions can have a function of displaying image information mainly on one display portion and displaying text information on another display portion, a function of displaying a three-dimensional image by displaying images where parallax is considered on a plurality of display portions, or the like. Furthermore, the electronic device including an image receiving portion can have a function of photographing a still image, a function of photographing a moving image, a function of automatically or manually correcting a photographed image, a function of storing a photographed image in a memory medium (an external memory medium or a memory medium incorporated in a camera), a function of displaying a photographed image on a display portion, or the like. Note that functions which can be provided for the electronic devices illustrated in FIGS. 27A to 27H and FIGS. 28A to 28D are not limited to those described above, and the electronic devices can have a variety of functions.

The above-described electronic devices each include a display portion for displaying some kind of information. When a circuit for driving the display portion has the structure according to one embodiment, only part of an image can be rewritten. Thus, power consumption can be reduced.

Figure 28E:
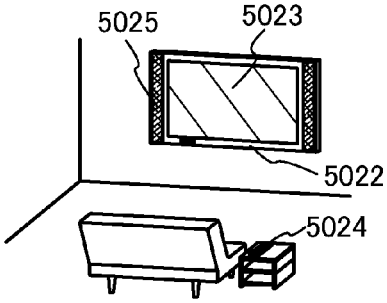

FIG. 28E illustrates an example in which a display device is incorporated in a building structure. FIG. 28E illustrates a housing 5022, a display portion 5023, a remote controller 5024 which is an operation portion, a speaker 5025, and the like. The display device is incorporated in the building as a wall-hanging type and can be provided without requiring a large space.

Figure 28F:
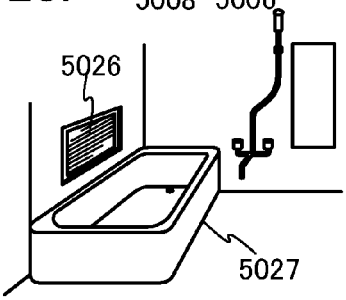

FIG. 28F illustrates another example in which a display device is incorporated in a building. A display panel 5026 is integrated with a prefabricated bath 5027, so that a person who takes a bath can watch the display panel 5026.

Note that although the wall and the prefabricated bath are given as examples of the building, this embodiment is not limited to these examples and the display device can be provided in a variety of buildings.

Figure 28G:
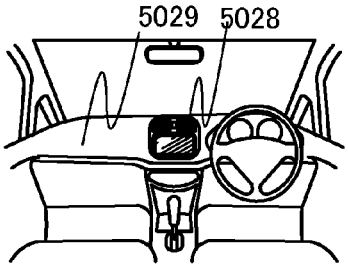

Next, examples in which a display device is incorporated with a moving object will be described. FIG. 28G illustrates an example in which the display device is provided in a car. A display panel 5028 is provided in a body 5029 of the car and can display information related to the operation of the car or information input from inside or outside of the car on demand. Note that a navigation function may be provided.

Figure 28H:
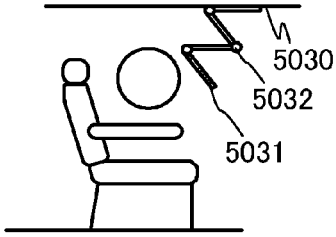

FIG. 28H illustrates an example in which the display device is incorporated in a passenger airplane. FIG. 28H shows a usage pattern when a display panel 5031 is provided for a ceiling 5030 above a seat of the airplane. The display panel 5031 is integrated with the ceiling 5030 through a hinge portion 5032, and a passenger can watch the display panel 5031 by extending and contracting the hinge portion 5032. The display panel 5031 has a function of displaying information when operated by the passenger.

Note that although the body of the car and the body of the plane are given as examples of the moving body, this embodiment is not limited to these examples. The display device can be provided for a variety of moving bodies such as a two-wheel motor vehicle, a four-wheel vehicle (including a car, bus, and the like), a train (including a monorail, a railway, and the like), and a ship.

This application is based on Japanese Patent Application serial no. 2010-024872 filed with Japan Patent Office on Feb. 5, 2010, the entire contents of

EXPLANATION OF REFERENCE

10: pixel, 11: transistor, 12: liquid crystal element, 13: capacitor, 21: wiring, 22: wiring, 23: wiring, 31: transistor, 32: wiring, 33: wiring, 101: transistor, 102: transistor, 111: wiring, 112: wiring, 113: wiring, 114: wiring, 115: wiring, 116: wiring, 117: wiring, 118: wiring, 119: wiring, 121: capacitor, 122: capacitor, 130: protection circuit, 131: transistor, 141: wiring, 201: transistor, 202: transistor, 203: transistor, 204: transistor, 205: transistor, 221: transistor, 222: transistor, 223: transistor, 224: transistor, 225: transistor, 226: transistor, 227: transistor, 228: transistor, 229: transistor, 300: circuit, 301: inverter circuit, 302: transistor, 303: transistor, 304: resistor, 305: transistor, 306: transistor, 307: transistor, 308: transistor, 311: transistor, 312: transistor, 313: transistor, 314: transistor, 315: transistor, 316: transistor, 401: circuit, 402: circuit, 411: wiring, 412: wiring, 413: wiring, 414: wiring, 415: wiring, 416: wiring, 417: wiring, 418: wiring, 419: wiring, 420: wiring, 801: transistor, 802: capacitor, 803: liquid crystal element, 811: wiring, 812: wiring, 813: wiring, 814: common electrode, 901: transistor, 902: transistor, 903: capacitor, 904: light-emitting element, 911: wiring, 912: wiring, 913: wiring, 914: common electrode, 5000: housing, 5001: display portion, 5002: display portion, 5003: speaker, 5004: LED lamp, 5005: operation key, 5006: connection terminal, 5007: sensor, 5008: microphone, 5009: switch, 5010: infrared port, 5011: memory medium reading portion, 5012: support portion, 5013: earphone, 5014: antenna, 5015: shutter button, 5016: image receiving portion, 5017: charger, 5018: support base, 5019: external connection port, 5020: pointing device, 5021: reader/writer, 5022: housing, 5023: display portion, 5024: remote controller, 5025: speaker, 5026: display panel, 5027:

prefabricated bath, 5028: display panel, 5029: body, 5030: ceiling, 5031: display panel, 5032: hinge portion, 5033: light source, 5034: projector lens, 5260: substrate, 5261: insulating layer, 5262: semiconductor layer, 5263: insulating layer, 5264: conductive layer, 5265: insulating layer, 5266: conductive layer, 5267: insulating layer, 5268: conductive layer, 5269: insulating layer, 5270: light-emitting layer, 5271: conductive layer, 5280: substrate, 5281: conductive layer, 5282: insulating layer, 5283: semiconductor layer, 5284: semiconductor layer, 5285: conductive layer, 5286: insulating layer, 5287: conductive layer, 5288: liquid crystal layer, 5289: conductive layer, 5450: pixel, 5451: transistor, 5452: capacitor, 5453: display element, 5454: electrode, 5455: electrode, 5456: partition, 5457: liquid powder, 5458: liquid powder, 5461: wiring, 5462: wiring, 5463: wiring, 5480: microcapsule, 5481: resin, 5483: liquid, 5486: twisting ball, 5487: particle, 5488: cavity, 5491: microcup, 5492: dielectric solvent, 5493: charged pigment particle, 5494: sealing layer, 5495: adhesive layer, 5501: circuit, 5502: circuit, 5503: pixel portion, 5504: circuit, 5505: circuit, 5506: pixel, 5507: wiring, 5508: wiring, 5509: substrate, 5262*a*: region, 5262*b*: region, 5262*c*: region, 5504*a*: circuit, 5504*b*: circuit

The invention claimed is:

1. A display device comprising:

a pixel portion and a driver circuit, the driver circuit comprising:

first to fourth signal lines;

a power source line; and first and second signal processing circuits, each signal processing circuit comprising:

first to seventh wirings;

a first transistor, a first terminal of the first transistor electrically connected to the first wiring, and a second terminal of the first transistor electrically connected to the second wiring; and a second transistor, a first terminal of the second transistor electrically connected to the third wiring, a second terminal of the second transistor electrically connected to the fourth wiring, and a gate of the second transistor electrically connected to a gate of the first transistor, wherein the fifth wiring is electrically connected to the power source line, wherein the sixth wiring of the second signal processing circuit is electrically connected to the second wiring of the first signal processing circuit, wherein the seventh wiring of the first signal processing circuit is electrically connected to the second wiring of the second signal processing circuit, wherein the first wiring and the third wiring of the first signal processing circuit are electrically connected to the first signal line and the second signal line, respectively, and wherein the first wiring and the third wiring of the second signal processing circuit are electrically connected to the third signal line and the fourth signal line, respectively.

2. The display device according to claim 1, wherein each signal processing circuit further comprises:

a third transistor, a first terminal of the third transistor electrically connected to the fifth wiring, and a second terminal of the third transistor electrically connected to the second terminal of the first transistor; and a fourth transistor, a first terminal of the fourth transistor electrically connected to the fifth wiring, a second terminal of the fourth transistor electrically connected to the second terminal of the second transistor, and a gate of the fourth transistor electrically connected to a gate of the third transistor.

3. The display device according to claim 2, wherein the first to fourth transistors have the same conductivity type.

4. The display device according to claim 1, wherein each signal processing circuit further comprises an inverter circuit.

5. The display device according to claim 1, wherein each signal processing circuit further comprises a protection circuit connected to the fourth wiring.

6. The display device according to claim 1, wherein the display device is incorporated in an electronic device selected from a group consisting of a mobile computer, a portable image reproducing device, a goggle-type display, a portable game machine, a projector, a television set, a portable television receiver, a camera, a computer, and a mobile phone.

7. A display device comprising:

a pixel portion and a driver circuit, the driver circuit comprising:

first to fourth signal lines;

a power source line; and first, second, and third signal processing circuits, each signal processing circuit comprising:

first to seventh wirings;

a first transistor, a first terminal of the first transistor electrically connected to the first wiring, and a second terminal of the first transistor electrically connected to the second wiring; and a second transistor, a first terminal of the second transistor electrically connected to the third wiring, a second terminal of the second transistor electrically connected to the fourth wiring, and a gate of the second transistor electrically connected to a gate of the first transistor, wherein the fifth wiring is electrically connected to the power source line, wherein the sixth wiring of the second signal processing circuit is electrically connected to the second wiring of the first signal processing circuit, wherein the seventh wiring of the second signal processing circuit is electrically connected to the second wiring of the third signal processing circuit, wherein the first wiring and the third wiring of the first signal processing circuit are electrically connected to the first signal line and the second signal line, respectively, and wherein the first wiring and the third wiring of the second signal processing circuit are electrically connected to the third signal line and the fourth signal line, respectively.

8. The display device according to claim 7, wherein each signal processing circuit further comprises:

a third transistor, a first terminal of the third transistor electrically connected to the fifth wiring, and a second terminal of the third transistor electrically connected to the second terminal of the first transistor; and a fourth transistor, a first terminal of the fourth transistor electrically connected to the fifth wiring, a second terminal of the fourth transistor electrically connected to the second terminal of the second transistor, and a gate of the fourth transistor electrically connected to a gate of the third transistor.

9. The display device according to claim 8, wherein the first to fourth transistors have the same conductivity type.

10. The display device according to claim 7, wherein each signal processing circuit further comprises an inverter circuit.

11. The display device according to claim 7, wherein each signal processing circuit further comprises a protection circuit connected to the fourth wiring.

12. The display device according to claim 7, wherein the display device is incorporated in an electronic device selected from a group consisting of a mobile computer, a portable image reproducing device, a goggle-type display, a portable game machine, a projector, a television set, a portable television receiver, a camera, a computer, and a mobile phone.

13. A display device comprising:

a pixel portion and a gate driver circuit, the gate driver circuit comprising:

first to fourth signal lines;

a plurality of fifth signal lines;

a plurality of gate signal lines;

a power source line; and a plurality of signal processing circuits, each signal processing circuit comprising:

first to seventh wirings;

a first transistor, a first terminal of the first transistor electrically connected to the first wiring, and a second terminal of the first transistor electrically connected to the second wiring; and a second transistor, a first terminal of the second transistor electrically connected to the third wiring, a second terminal of the second transistor electrically connected to the fourth wiring, and a gate of the second transistor electrically connected to a gate of the first transistor, wherein the fourth wiring is electrically connected to one of the plurality of gate signal lines, wherein the fifth wiring is electrically connected to the power source line, wherein the sixth wiring of a second one of the plurality of signal processing circuits is electrically connected to the second wiring of a first one of the plurality of signal processing circuits through a first one of the plurality of fifth signal lines, wherein the seventh wiring of the first one of the plurality of signal processing circuits is electrically connected to the second wiring of the second one of the plurality of signal processing circuits through a second one of the plurality of fifth signal lines, wherein the first wiring and the third wiring of the first one of the plurality of signal processing circuits are electrically connected to the first signal line and the second signal line, respectively, and wherein the first wiring and the third wiring of the second one of the plurality of signal processing circuits are electrically connected to the third signal line and the fourth signal line, respectively.

14. The display device according to claim 13, wherein each signal processing circuit further comprises:

a third transistor, a first terminal of the third transistor electrically connected to the fifth wiring, and a second terminal of the third transistor electrically connected to the second terminal of the first transistor; and a fourth transistor, a first terminal of the fourth transistor electrically connected to the fifth wiring, a second terminal of the fourth transistor electrically connected to the second terminal of the second transistor, and a gate of the fourth transistor electrically connected to a gate of the third transistor.

15. The display device according to claim 14, wherein the first to fourth transistors have the same conductivity type.

16. The display device according to claim 13, wherein each signal processing circuit further comprises an inverter circuit.

17. The display device according to claim 13, wherein each signal processing circuit further comprises a protection circuit connected to the fourth wiring.

18. The display device according to claim 13, wherein the display device is incorporated in an electronic device selected from a group consisting of a mobile computer, a portable image reproducing device, a goggle-type display, a portable game machine, a projector, a television set, a portable television receiver, a camera, a computer, and a mobile phone.

* * * * *